US010555873B2

(12) United States Patent
Poirier et al.

(10) Patent No.: US 10,555,873 B2
(45) Date of Patent: Feb. 11, 2020

(54) MODULAR MEDICATION DISPENSING SYSTEM

(71) Applicants: Michel Poirier, Lac-Beauport (CA); Paul-Andre Bouchard, Outrement (CA)

(72) Inventors: Michel Poirier, Lac-Beauport (CA); Paul-Andre Bouchard, Outrement (CA)

( * ) Notice: Subject to any disclaimer, the term of this patent is extended or adjusted under 35 U.S.C. 154(b) by 0 days.

(21) Appl. No.: 15/576,958

(22) PCT Filed: May 26, 2016

(86) PCT No.: PCT/IB2016/053104

§ 371 (c)(1),
(2) Date: Nov. 27, 2017

(87) PCT Pub. No.: WO2016/189497

PCT Pub. Date: Dec. 1, 2016

(65) Prior Publication Data

US 2018/0147120 A1 May 31, 2018

Related U.S. Application Data

(60) Provisional application No. 62/166,231, filed on May 26, 2015.

(51) Int. Cl.

| | |
|---|---|
| ***A61J 7/00*** | (2006.01) |
| ***B65D 83/04*** | (2006.01) |
| ***A61J 7/04*** | (2006.01) |

(52) U.S. Cl.

CPC ..... *A61J 7/0076* (2013.01); *A61J 7/0436* (2015.05); *A61J 7/0445* (2015.05); *A61J 7/0472* (2013.01);

(Continued)

(58) Field of Classification Search

CPC ..... A61J 7/0076; A61J 7/0436; A61J 7/0445; A61J 7/0472; A61J 2200/30; B65D 83/04; B65D 83/0409

(Continued)

(56) References Cited

U.S. PATENT DOCUMENTS 3,344,951 A 10/1967 Gervais
3,563,410 A * 2/1971 Murray ..... A61J 7/0084 221/1

(Continued)

FOREIGN PATENT DOCUMENTS

CA 2806903 A1 10/2013
EP 2201925 A1 6/2010

(Continued)

OTHER PUBLICATIONS

International Search Report and Written Opinion issued in corresponding International Application No. PCT/IB2016/053104 dated Sep. 6, 2016, 16 pages.

*Primary Examiner* — Rakesh Kumar
(74) *Attorney, Agent, or Firm* — Snyder, Clark, Lesch & Chung, LLP

(57) ABSTRACT

There is provided a modular medication dispensing system for managing and automatically dispensing pills from a plurality of portable medication dispensers, the modular system comprising: a base equipped with rotation means and being removably installed on a plane surface, a circular magazine comprising a plurality of adaptors for receiving a plurality of portable medication dispensers, the circular magazine being rotatably mounted on the base, an actuator for actuating a portable dispenser from the plurality of portable dispensers when the portable dispenser is in the dispensing position, a plurality of autonomous portable dispensers being removably received in the plurality of adaptors and operating autonomously or in synchronization (Continued)

with the modular system, a filling assembly comprising movable means for automatically filling a portable dispenser, and an electronic system comprised in each portable dispenser and in the base for permanently communicating between the plurality of portable dispensers and the base or between the base and a doctor, a pharmacist or one's smart phone or between the portable dispensers and a doctor, a pharmacist or one's smart phone using network protocols and for automatically dispensing medication once dispensing periods are reached.

22 Claims, 69 Drawing Sheets

(52) U.S. Cl.
CPC ..... *B65D 83/0409* (2013.01); *A61J 2200/30* (2013.01)

(58) Field of Classification Search
USPC ..... 221/12
See application file for complete search history.

(56) References Cited

U.S. PATENT DOCUMENTS 3,612,348 A 10/1971 Thomas
3,612,349 A 10/1971 Thomas
3,688,945 A * 9/1972 Arlington, Jr. .... B65D 83/0418 206/534
3,762,539 A 10/1973 Kerr
3,854,626 A * 12/1974 Krechmar ..... B65D 83/0418 221/264
4,572,403 A * 2/1986 Benaroya ..... A61J 7/04 221/15
4,573,606 A * 3/1986 Lewis ..... A61J 7/0481 221/15
4,809,877 A * 3/1989 Albright ..... A61J 7/0481 221/121
4,838,453 A * 6/1989 Luckstead ..... A61J 7/0481 221/12
4,872,591 A * 10/1989 Konopka ..... A61J 7/0481 221/3
4,911,327 A * 3/1990 Shepherd ..... A61J 7/0481 221/15
4,984,709 A * 1/1991 Weinstein ..... B65D 83/0409 206/536
5,080,258 A * 1/1992 Hinterreiter ..... B65D 83/0418 221/198
5,097,982 A * 3/1992 Kedem ..... A61J 7/0084 221/3
5,152,422 A * 10/1992 Springer ..... A61J 7/0084 221/113
5,502,944 A * 4/1996 Kraft ..... G07F 17/0092 53/55
5,522,525 A * 6/1996 McLaughlin ..... A61J 7/0481 221/4
5,523,816 A * 6/1996 Sherman, Jr. ..... G03D 13/005 221/131
5,605,249 A * 2/1997 Gonyea ..... G07F 11/54 221/11
5,646,912 A * 7/1997 Cousin ..... A61J 7/0481 368/10
5,752,621 A * 5/1998 Passamante ..... A61J 7/0481 221/13
5,755,357 A * 5/1998 Orkin ..... A61J 7/0084 221/120
5,954,225 A * 9/1999 Powe ..... A61J 7/0481 206/459.1
5,971,594 A * 10/1999 Sahai ..... A61J 7/0481 700/242
6,021,918 A * 2/2000 Dumont ..... A61J 7/0481 221/132
6,194,995 B1 * 2/2001 Gates ..... A61J 7/0481 206/531
6,216,910 B1 * 4/2001 Numerick ..... G07F 11/52 221/7
6,263,259 B1 * 7/2001 Bartur ..... A61J 7/0481 700/236
6,481,180 B1 * 11/2002 Takahashi ..... B65B 5/103 221/133
6,732,884 B2 * 5/2004 Topliffe ..... A61J 7/0481 221/3
6,805,259 B2 * 10/2004 Stevens ..... B65B 5/103 198/757
7,213,721 B2 * 5/2007 Abdulhay ..... G07F 11/10 221/124
7,711,449 B2 * 5/2010 Abdulhay ..... G07F 11/10 221/13
7,715,277 B2 * 5/2010 de la Huerga ..... A61J 7/0084 368/10
7,854,326 B1 * 12/2010 Beckett ..... B65D 83/0454 206/534
7,950,206 B2 * 5/2011 Knoth ..... B65B 5/103 221/1
8,141,550 B2 * 3/2012 Lawrence ..... A61M 15/009 128/200.14
8,195,330 B2 * 6/2012 Coe ..... A61J 7/0481 700/243
8,453,874 B2 * 6/2013 Simpson ..... A61J 7/0084 221/197
8,600,549 B2 * 12/2013 Park ..... A61J 7/0409 221/122
8,874,260 B2 * 10/2014 Saltsov ..... A61J 7/0076 700/244
9,043,015 B2 * 5/2015 Ratnakar ..... A61J 7/02 700/241
9,150,346 B1 * 10/2015 Aramian ..... A61J 7/0084
9,218,458 B2 * 12/2015 Baarman ..... A61J 7/0084
9,492,357 B2 * 11/2016 MacVittie ..... A61J 7/0472
9,501,626 B2 * 11/2016 Zhang ..... G07F 17/0092
9,597,261 B2 * 3/2017 Baarman ..... A61J 7/0084
9,836,583 B2 * 12/2017 Garcia ..... G06F 19/3462
10,073,954 B2 * 9/2018 Chen ..... A61J 1/03
2006/0144846 A1 * 7/2006 Varis ..... A61J 7/0084 221/2
2006/0163267 A1 * 7/2006 Lapsker ..... G07F 11/54 221/2
2009/0281657 A1 * 11/2009 Gak ..... A61J 7/0481 700/242
2011/0208352 A1 * 8/2011 Knoth ..... B65B 5/103 700/243
2012/0055948 A1 * 3/2012 Leifeld ..... A61J 7/0076 221/1
2012/0259456 A1 * 10/2012 Saltsov ..... A61J 7/0076 700/236
2013/0008918 A1 1/2013 Cronin
2013/0292398 A1 11/2013 Cote
2014/0097194 A1 * 4/2014 Lai ..... B65D 83/0454 221/13
2014/0131378 A1 * 5/2014 Shih ..... A61J 7/04 221/211
2014/0244033 A1 * 8/2014 Ucer ..... A61J 7/0481 700/237
2014/0277702 A1 * 9/2014 Shaw ..... G06F 19/3462 700/232
2014/0353328 A1 * 12/2014 Makhalfeh ..... A61J 7/0481 221/15
2017/0304153 A1 * 10/2017 Williamson ..... G06F 19/3462
2018/0147120 A1 * 5/2018 Poirier ..... A61J 7/0076

FOREIGN PATENT DOCUMENTS

EP 2752182 A1 7/2014
WO 2004073498 A2 9/2004
WO 2014205545 A1 12/2014

* cited by examiner

MODULAR MEDICATION DISPENSING SYSTEM

BACKGROUND OF THE INVENTION

With the general aging of population, patients are taking an increasing amount of different medications at different times of the day. Certain places like hospitals or nursing homes, manage the medication of a plurality of patients.

As of today, many issues remain concerning medication of patients. For example, medication must be prepared in advance by either a pharmacist, a nurse or a care giver. The medication must be dispensed to the corresponding patients without mixing the different types of pills or tablets which can sometimes occur due to human error and which can be dangerous for a patient.

Some medication dispensers were designed to assist patients and caregiver in the periodic administration of a plurality of medications. Some of these dispensers are stationary and include a base resting on a surface, such as a countertop or a table. The dispenser includes a plurality of containers mounted to the base, each container corresponding to a specific period of time at which the medications must be administered to the patient. To provide the proper medication at each specific period of time, each container must be individually filled by the care giver or the patient. In addition to increasing the risks of errors in filling the individual containers with the proper medications, the use of such systems is particularly challenging for patients having tremors or imprecise movements, for instance patients suffering from Parkinson's disease.

The use of stationary dispenser also tend to limit the mobility of patients, especially those who require regular medication regimens but who are still autonomous. Indeed, because the medication to be dispensed is comprised in a stationary dispenser, it becomes difficult for those patients to leave the premises where the dispenser is located with the medication to be administered during the period when they will be away. This situation often results in the medication being taken outside of the prescribed schedule or not being taken at all. Alternatively, the patient can be reluctant to leave the premises where the dispenser is located for a relatively extended period of time.

Therefore, there is a need for a medication dispensing system that will overcome at least one of the above-identified drawbacks.

BRIEF SUMMARY

According to a broad aspect of an embodiment of the present invention, there is provided a modular medication dispensing system. In this broad aspect, the system comprises a medication dispenser support and at least one portable medication dispenser, the at least one portable medication dispenser being removably receivable on the medication dispenser support. The at least one portable medication dispenser is configured to accommodate a medication to be dispensed and is operable to dispense doses of the medication. The system also comprises an actuator operatively coupled to the medication dispenser support, the actuator being configured to operate the at least one portable medication dispenser when it is removably received on the medication dispenser support, as well as an electronic controller. The electronic controller is operatively connected to the actuator and controls the operation of the actuator for operating the at least one portable medication dispenser removably received on the medication dispenser support to dispense the doses of the medication.

In one feature, the doses of the medication dispensed by the medication dispensing system are in the form of tablets, pills, capsules, caplets, caps, gel caps, pellets, lozenges, pastilles, candy, liquid substances, powder and the like.

In another feature, the medication dispenser support comprises a base for placing the support on a surface, the base including a base dispensing opening, and a circular magazine rotatably mounted on said base. The circular magazine comprises at least two adaptors, each of the at least two adaptors being configured to removably receive a single portable dispenser thereon and comprising an adaptor dispensing opening. When the adaptor dispensing opening of a first adaptor is in registry with the base dispensing opening, the first adaptor is in a dispensing position relative to the base. Preferably, when the first adaptor is in the dispensing position and a first portable dispenser is removably received in the first adaptor, the actuator is operatively coupled to the first portable dispenser to operate the same.

In still another feature, the modular dispensing system further comprises a rotating means operatively coupled to the base and to the circular magazine. In this feature, the rotating means is operable for urging the rotation of the circular magazine relative to the base to position the first adaptor in the dispensing position. Preferably, the rotating means is operatively connected to the electronic controller, the electronic controller to control the operation of the rotating means for urging rotation of the circular magazine relative to the base to position the first adaptor in the dispensing position. In this feature, the electronic controller controls the operation of the rotating means according to at least one parameter related to the administration of the medication.

In another feature, the actuator is fixedly mounted to the base and engages the first portable dispenser in the dispensing position, the actuator being movable between a released position and an actuated position. When the actuator moves from the released position to the actuated position, it operates the portable dispenser to dispense a single dose of the medication.

In a further feature, the at least two adaptors are identical.

In another feature, the at least two adaptors are configured differently.

In yet another feature, the at least two adaptors are removably mounted to the circular magazine. Preferably, one of the at least two adaptor has a first end adjacent to the circular magazine when removably positioned on the circular magazine and a second end, and the dispensing opening of the adaptor is located at the first end.

In still another feature, the other of the at least two adaptors has a first end adjacent to the circular magazine when removably positioned on the circular magazine and a second end, the dispensing opening of the other of the at least two adaptors extending from the second end to the first of end via a conduit.

In a further feature, the circular magazine further comprises at least one storage compartment. In this feature, each of the at least one storage compartment is configured for removably storing a portable medication dispenser.

In one aspect, the modular medication system further comprises a filling assembly for filling the plurality of containers of the least one portable medication dispenser. Preferably, the filling assembly is operatively connected to the electronic controller.

According to another broad aspect of an embodiment, there is provided a portable medication dispenser comprising:

a housing having a first end and a second end, the second end of the housing comprising a dispensing opening;

a medication cartridge removably mounted in the housing, between the first end and the second end, the medication cartridge comprising a first end and a second end in registry with the dispensing opening of the housing, the medication cartridge further comprising the medication to be dispensed;

a bias assembly mounted to the first end of the housing and engaging the medication at the first end of the medication cartridge; and a button removably mounted to the second end of the housing, the button being reciprocable between a released position and a dispensing position to dispense doses of the medication through the dispensing opening of the housing, wherein when the button is moved from the released position to the dispensing position, a dose of the medication is dispensed from the second end of the cartridge through the dispensing opening, and when the button is returned from the dispensing position to the released position, the bias assembly biases the medication toward the second end of the medication cartridge for a subsequent dose of medication to be dispensed.

According to yet another broad aspect of an embodiment, there is provided a portable medication dispenser comprising:

a housing having a first end and a second end, the first end of the housing comprising a dispensing opening;

a medication cartridge removably mounted in the housing, between the first end and the second end, the medication cartridge comprising a first end in registry with the dispensing opening of the housing and a second end, the medication cartridge further comprising the medication to be dispensed;

a dose dispensing mechanism mounted in the dispensing opening of the housing, the dose dispensing mechanism being configured to dispense single doses of the medication; and a button removably mounted to the second end of the housing and operatively connected to the dose dispensing mechanism, the button being reciprocable between a released position and a dispensing position to dispense doses of the medication through the dispensing opening of the housing, wherein when the button is moved from the released position to the dispensing position, the button operates the dose dispensing mechanism to dispense a dose of the medication from the first end of the cartridge through the dispensing opening, and when the button is returned from the dispensing position to the released position, the bias assembly biases the medication toward the first end of the medication cartridge for a subsequent dose of medication to be dispensed.

In one feature, the portable medication dispenser further comprises a bias assembly mounted to the second end of the housing and engaging the medication at the second end of the medication cartridge.

In yet another broad aspect of an embodiment, there is provided a portable medication dispenser comprising:

a housing having a first end and a second end, and a plurality of compartments distributed between the first end and the second end, each of the plurality of compartments being configured to receive a plurality of medications and corresponding to a specific period of time for which the plurality of medications is to be administered to a user;

a plurality of doors, the doors being mounted to the housing and being operable between a closed position for individually closing each of the plurality of compartments and an open position for accessing the plurality of medications at the specific period of time;

a lock mechanism mounted to the housing and coupled to the plurality of doors, the lock mechanism being operable between a locked position to maintain plurality of doors in the closed position and an unlocked position to allow each of the plurality of doors to be opened individually; and a button mounted to the second end of the housing and operatively coupled to the lock mechanism, the button being reciprocable between a released position and a dispensing position, wherein when the button is moved from the released position to the dispensing position, the button forces the lock mechanism into the unlocked position while when the button is moved from the dispensing position to the released position the lock mechanism is forced into the locked position.

In one aspect, the electronic controller is mounted to the medication dispensing support.

In another aspect, the electronic controller is mounted to the at least one portable medication dispenser.

In yet another aspect, the electronic controller comprises a first component mounted to the medication dispensing support and a second component mounted to the at least one portable medication dispenser, the first and second components of the electronic controller being electronically connected to control the dispensing of the medication.

Additional and/or alternative features, aspects, and advantages of embodiments of the present will become apparent from the following description, the accompanying drawings, and the appended claims.

BRIEF DESCRIPTION OF THE DRAWINGS

For a better understanding of the present, as well as other aspects, and further features thereof, reference is made to the following description which is to be used in conjunction with the accompanying drawings, where.

DETAILED DESCRIPTION

Figure 1:
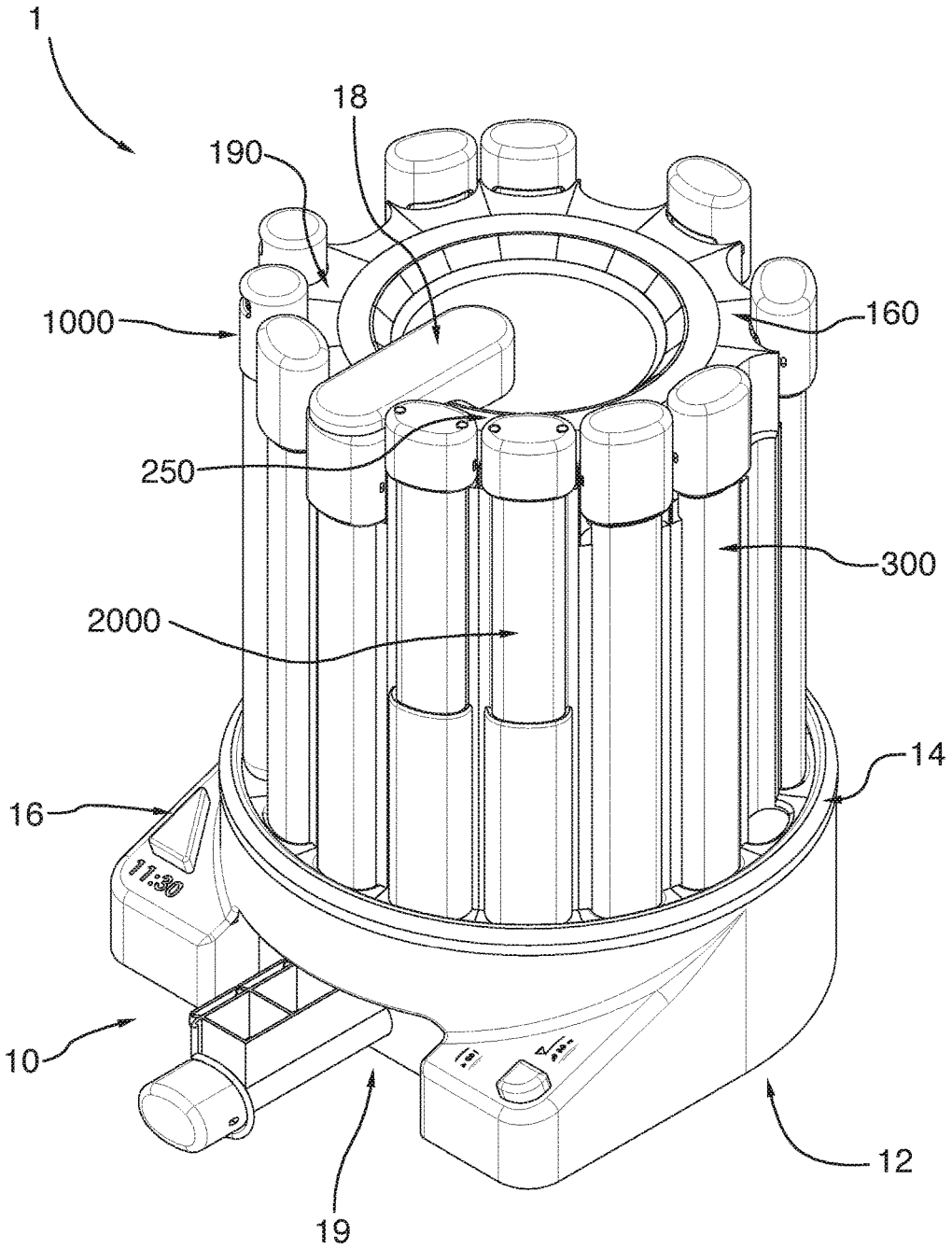
FIG. 1 is a perspective view of a modular system according to one embodiment.
Figure 2:
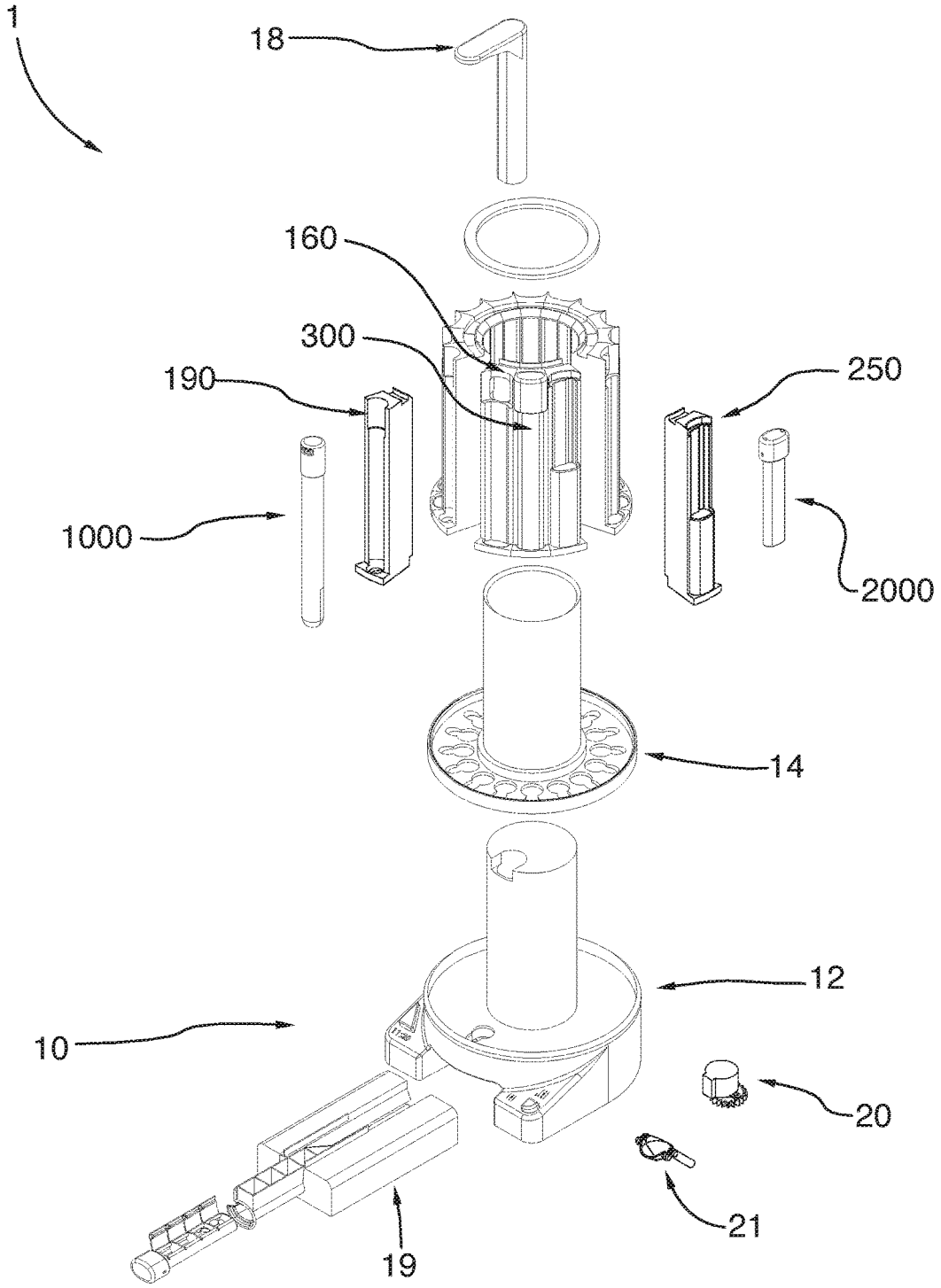
FIG. 2 is an exploded perspective view of the modular system of FIG. 1.

Referring to the isometric view of FIGS. 1 and 2, there is shown, a modular medication dispensing system 1 for automatically dispensing medications to patients, in accordance with one embodiment. The modular system 1 automatically manages and dispenses medication, pills, tablets or the like and allows for a caregiver, a pharmacist or a doctor to wirelessly and constantly monitor the pill distribution. The modular system 1 can be used in a patient's home, in care homes for elder people, in pharmacies or in hospitals and the like and comprises a medication dispenser support or carousel 10 on which are removably mounted a plurality of portable dispensers 300, 1000, 2000. The modular system 1 further comprises an electronic system or controller 16 for communicating with a doctor's or a pharmacist's secured website, a user's smart phone or the plurality of portable dispensers 300, 1000, 2000 removed therefrom and for automatically operating the carousel 10 for dispensing pills from the plurality of portable dispensers 300 and 1000 as dispensing periods are reached. The term "portable dispenser" as intended herein should be broadly understood as encompassing devices for dispensing products such as tablets, pills, capsules, caplets, caps, gel caps, pellets, lozenges, pastilles, candy, liquid substances, powder and the like.

The carousel 10 comprises a base 12 for being installed on a plane surface like a table, a counter or the like and for rotatably receiving a carousel support 14. The carousel support 14 is mounted on the base 12, and comprises a plurality of adaptors 160, 190, 250 (best shown in FIGS. 20 to 28) for receiving different types of portable dispensers 300, 1000 and 2000, as it will be explained in greater detail below. The carousel 10 further comprises an actuating device or actuator 18 for individually actuating the portable dispensers 300 and 1000 present on the carousel 10 to deliver pills or tablets to a patient or a user. The carousel 10 further comprises rotating means 20 for rotating the carousel support 14 and therefore the portable dispensers mounted thereon relative to the base 12. The carousel 10 further comprises a filling assembly 19 for receiving portable dispenser 2000 to be filled and a dispensing device 21 in which pills are dispensed, and an electronic system or controller 16 for automating the dispensing of pills, as it will be explained further below.

Figure 3:
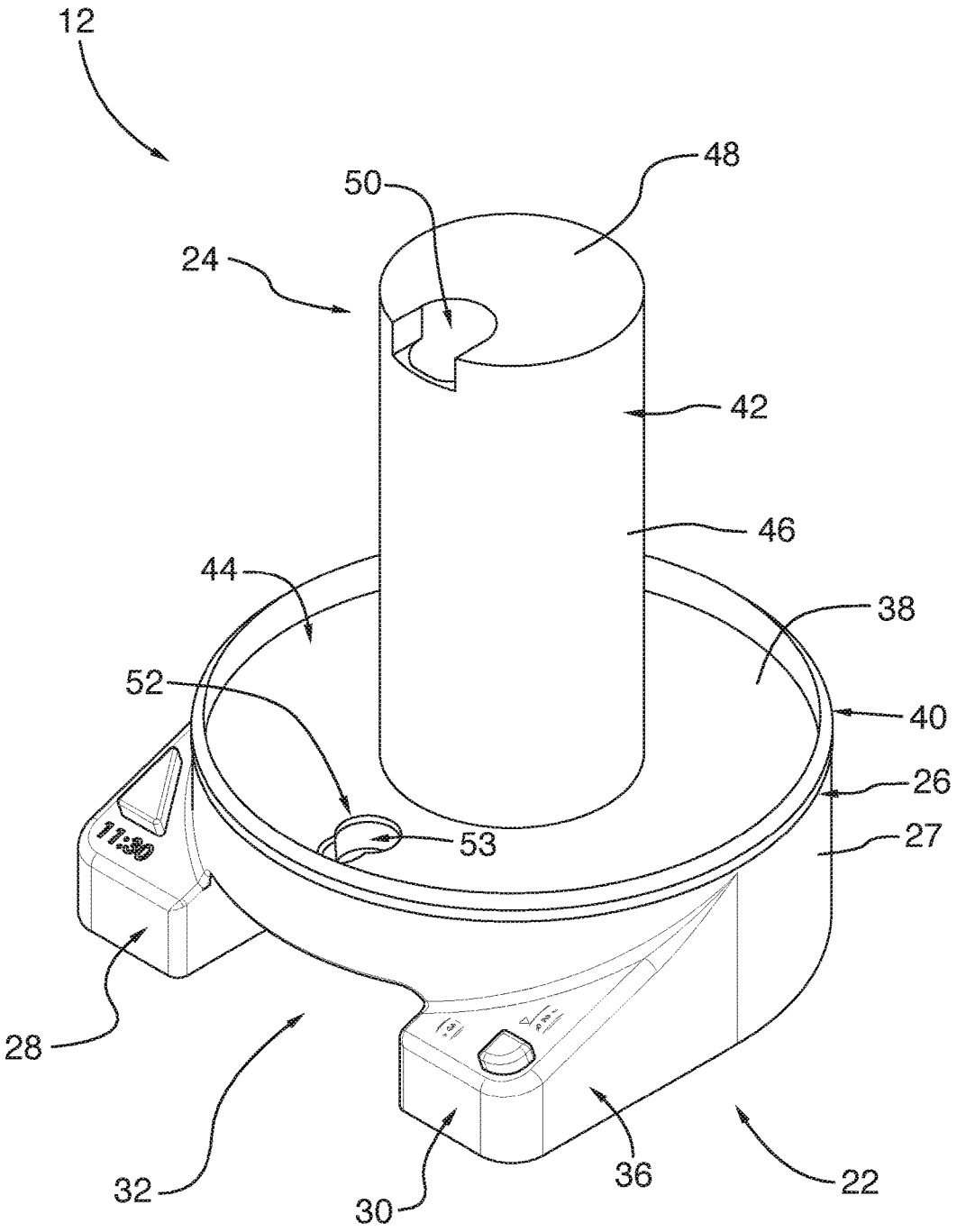
FIG. 3 is a perspective view of a carousel base shown in FIG. 2.
Figure 4:
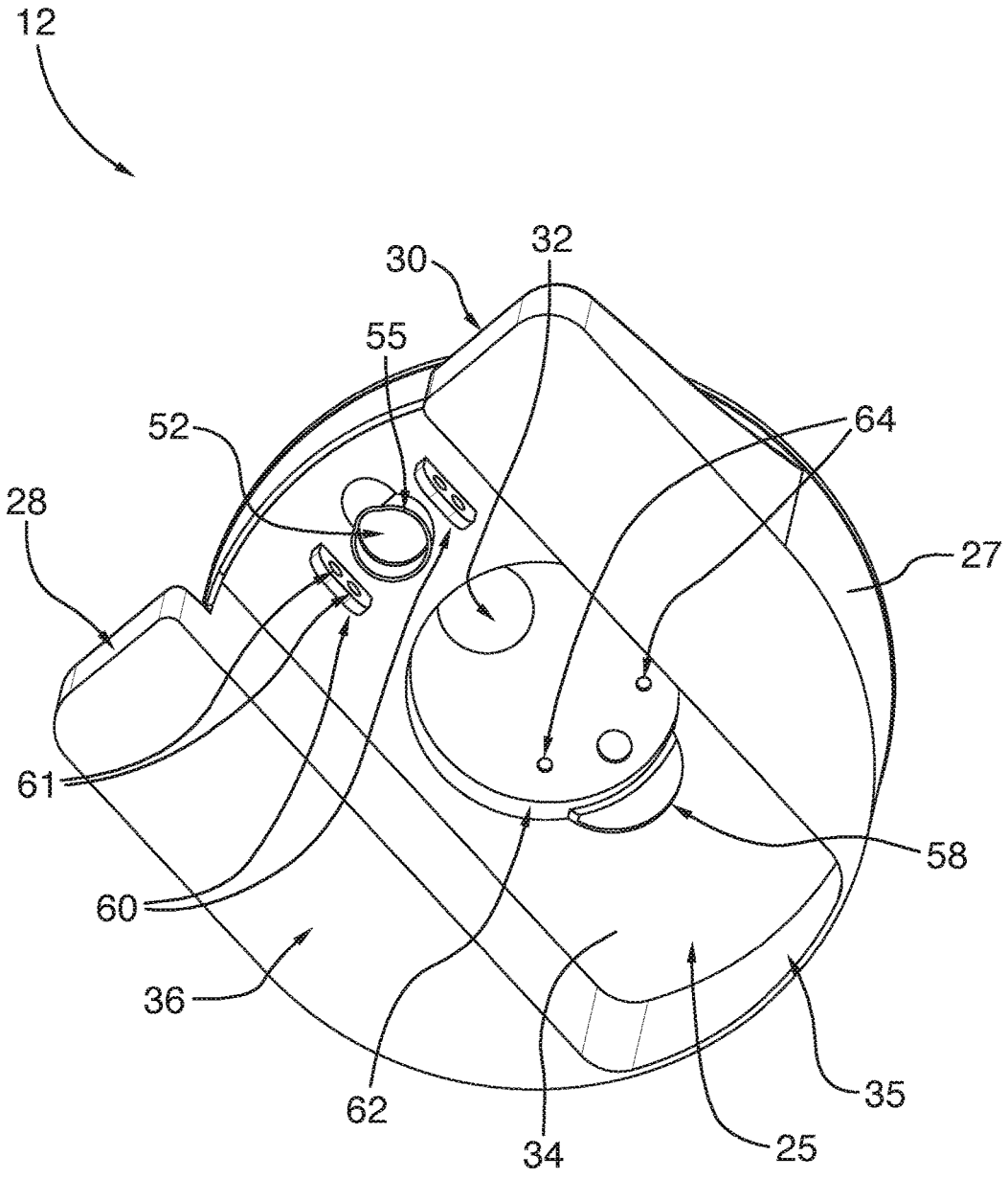
FIG. 4 is a bottom perspective view of the carousel base shown in FIG. 3 with the rotating means and the dispensing device removed.
Figure 5:
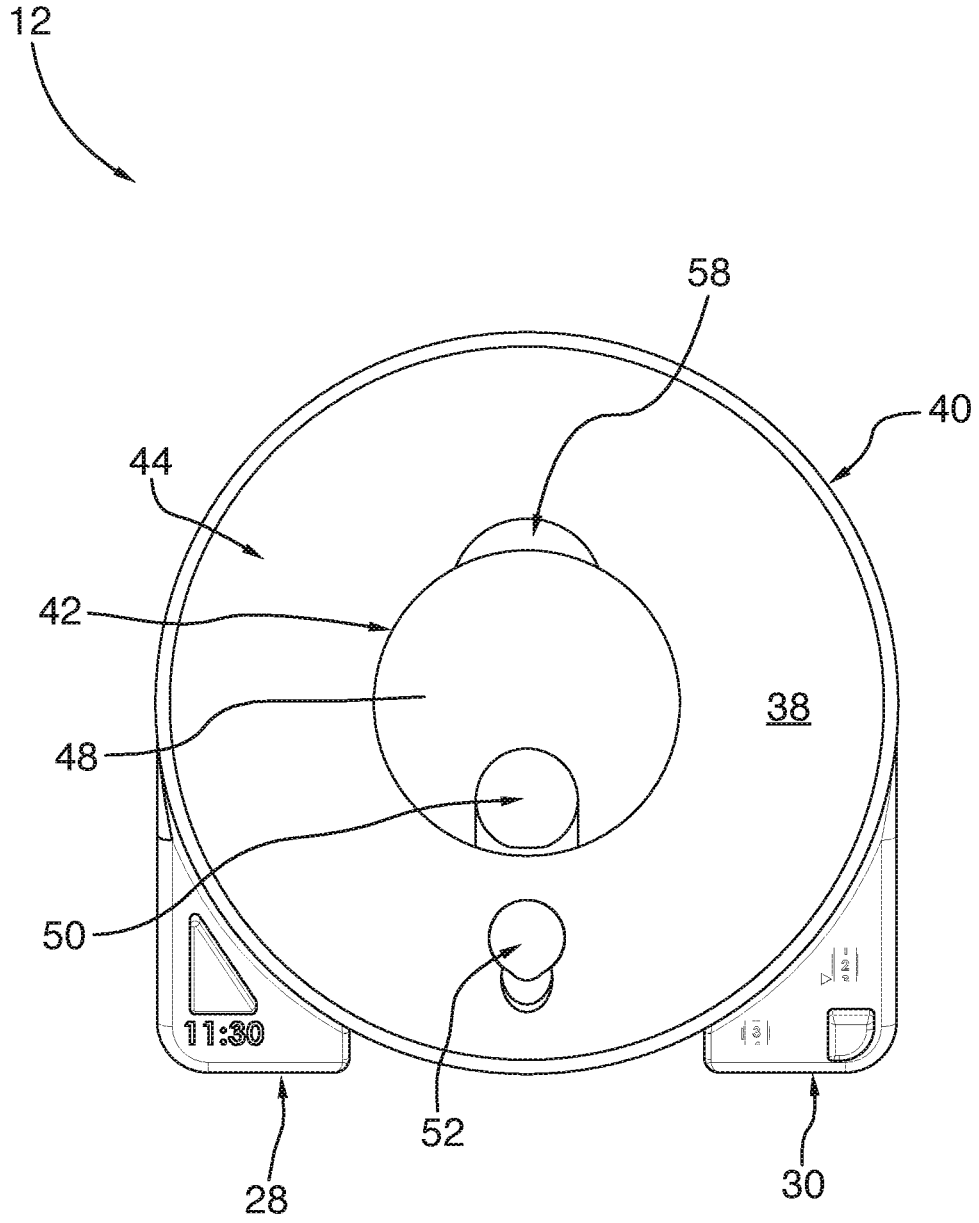
FIG. 5 is a top view of the carousel base shown in FIG. 3.

With reference to FIGS. 3 to 5, the base 12 has a bottom end 22 and a top end 24. Moving from the bottom end 22 toward the upper end 24, the base 12 includes a generally U-shaped base portion 36 (best shown in FIG. 4), a lower cylindrical body 26 extending from the U-shaped base portion 36 and an upper cylindrical body 42, extending concentrically and upwardly from the lower cylindrical body 26.

The U-shaped base portion 36 includes a right leg 30, a left leg 28 and a back wall 35 connecting the left leg 28 to the right leg 30, at the back of the base 12. As it is best shown in FIGS. 3 and 4, the U-shaped base portion 36 provides a space or cavity 32 between the lower cylindrical body 26 and the horizontal surface on which the carousel 10 is installed for receiving a filling assembly 19 for filling either the portable dispenser 2000 or the receptacle 13, in order to collect the dispensed pills. The lower cylindrical body 26 of the base 12 comprises a cylindrical wall 27 and an upper surface 38, delimited by a ledge 40 which has the same diameter as the cylindrical wall 27 and extends upwardly therefrom (shown in FIGS. 3 and 5). The space between the ledge 40 and the upper cylindrical body 42 forms an annular groove 44 which comprises a funnel-shaped release conduit 52 for accommodating the different types of portable dispensers 300, 1000 as it will be further explained. The conduit 52 comprises a top opening 53 in the upper surface 38 and a bottom opening 55 in the internal lower surface 34 located between the U-shaped base portion 36 and the back wall 35.

The upper cylindrical body 42, concentric with the lower cylindrical body 26, protrudes upward from the upper surface 38 of the cylindrical body 26 and defines the annular groove 44, formed between the ledge 40 and the upper cylindrical body 42. The upper cylindrical body 42 comprises an external cylindrical surface 46 and a generally circular top surface 48. The top surface 48 of the upper cylindrical body 42 comprises a conduit 50, eccentric from the center of the upper cylindrical body 42 for mounting the actuator 18 to the carousel 10. Furthermore, the annular groove 44 and the concentric upper cylindrical body 42 comprise an opening 58 (best shown in FIG. 5) for receiving the rotating means 20, when the carousel support 14 is mounted on the base 12, thus allowing the rotation of the support 14 relative to the base 12, as it will be explained further below.

As seen in FIG. 4, the internal lower surface 34 of the lower cylindrical body 26 comprises pairs of protrusions 60, proximate to the release conduit 52. Each protrusion 60 comprises a plurality of holes 61 for mounting a dispensing device 21, as it will be further explained. Furthermore, the internal lower surface 34 of the lower cylindrical body 26 comprises a recess 62, concentric with the lower cylindrical body 42, comprising a plurality of holes 64 and 65 for mounting the rotating means 20.

Figure 6:
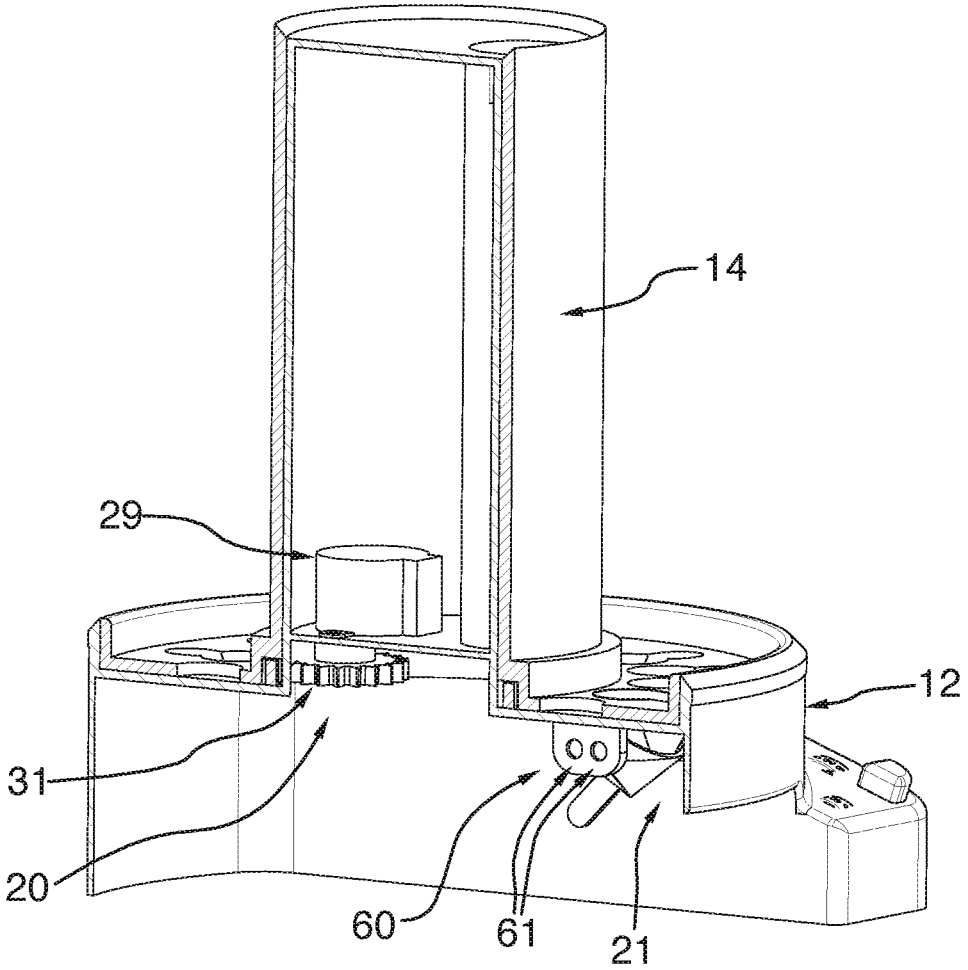
FIG. 6 is a perspective cross-sectional view of the carousel base showing the rotating means and the dispensing device.
Figure 7:
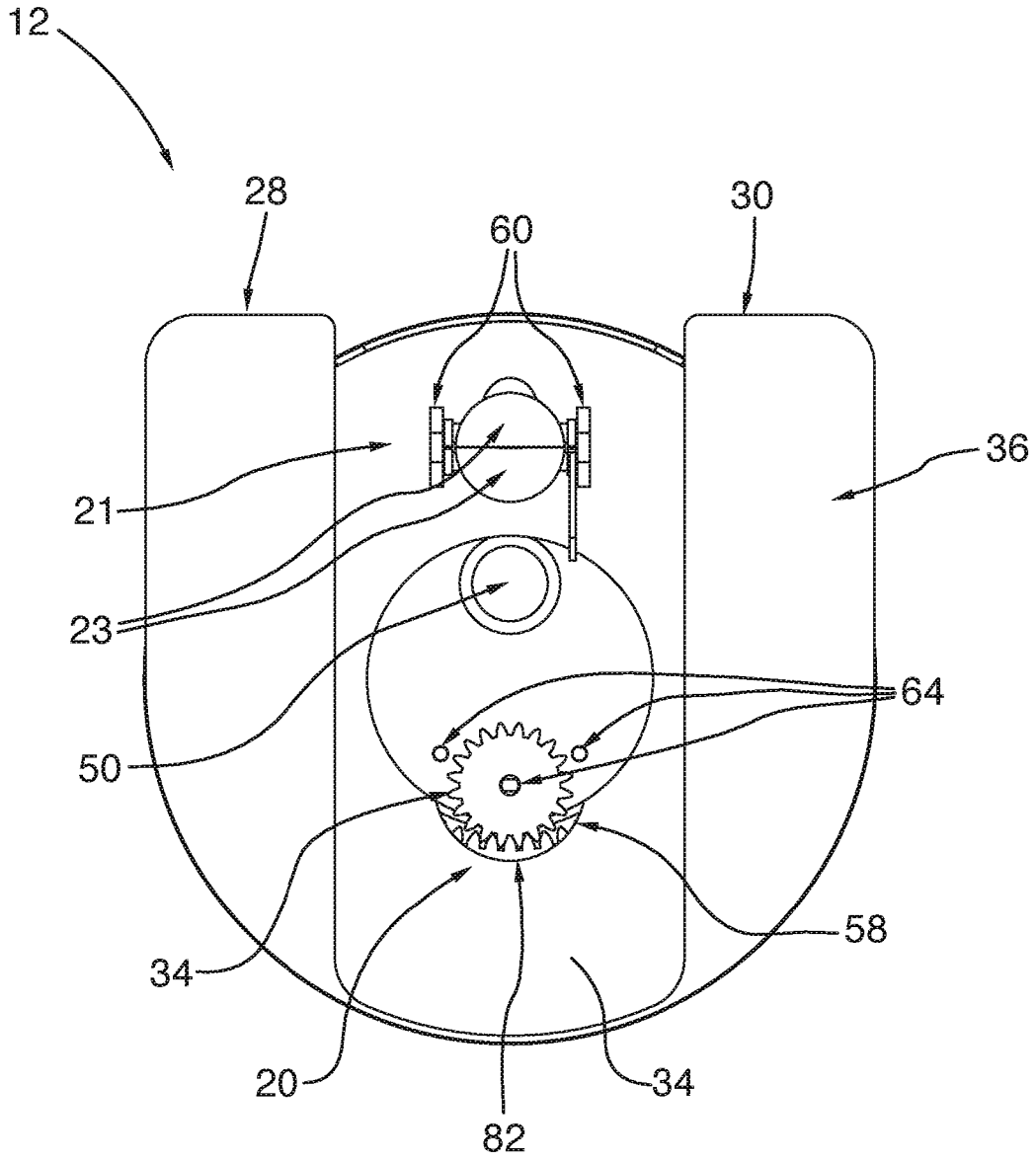
FIG. 7 is a bottom view of the carousel base shown in FIG. 6.

With reference to FIGS. 6 and 7, preferred embodiments of a rotating means 20 and a dispensing device 21 are illustrated. In this embodiment The rotating means 20 comprise an electric motor 29 and a gear 31 mounted on the carousel base 12 and which are controlled by the electronic controller 16.

The electric motor 29 is mounted on the internal lower surface 34 of the upper cylindrical body 42 of the base 12 thanks to the plurality of holes 64 and 65. The gear 31 is therefore mounted on the recess 62 of the base 12 and its main hole is aligned with the shaft of the electric motor 29 for rotating the gear 31. The plurality of teeth of the gear 31 engage with a cog wheel 82 of the carousel support 14 through the opening 58 of the base 12, thus rotating the carousel support 14 when the electronic motor 29 rotates the gear 31.

The dispensing device 21 is mounted on the internal lower surface 34 of the base 12 and comprises a pair of complementary receptacles 23, aligned with the release conduit 52 and mounted on the pairs of protrusions 60. The dispensing device 21 allows to receive the dispensed pills or tablets as they are delivered through the release conduit 52 of the base 12.

Figure 8:
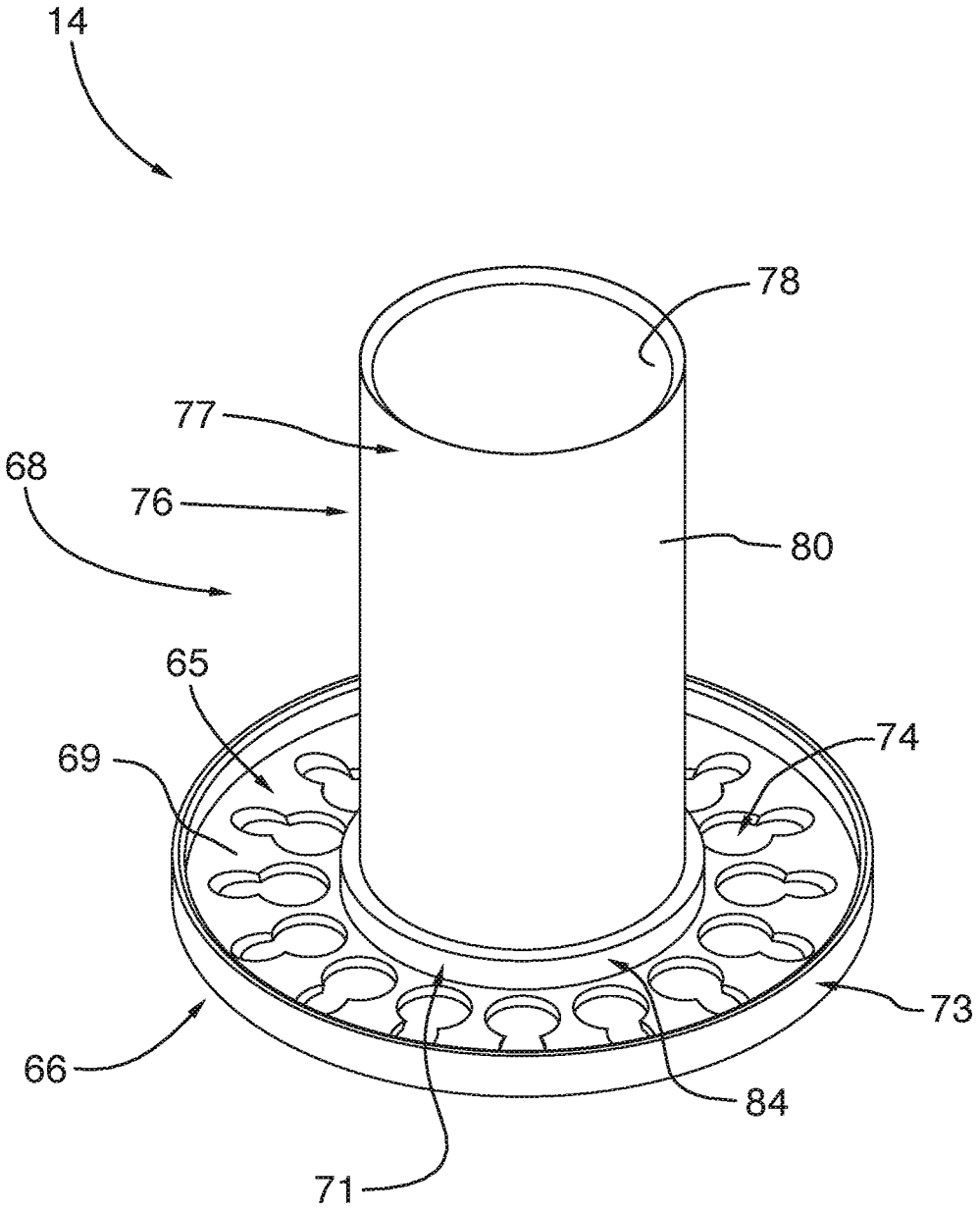
FIG. 8 is a perspective view of a carousel support shown in FIG. 2.
Figure 9:
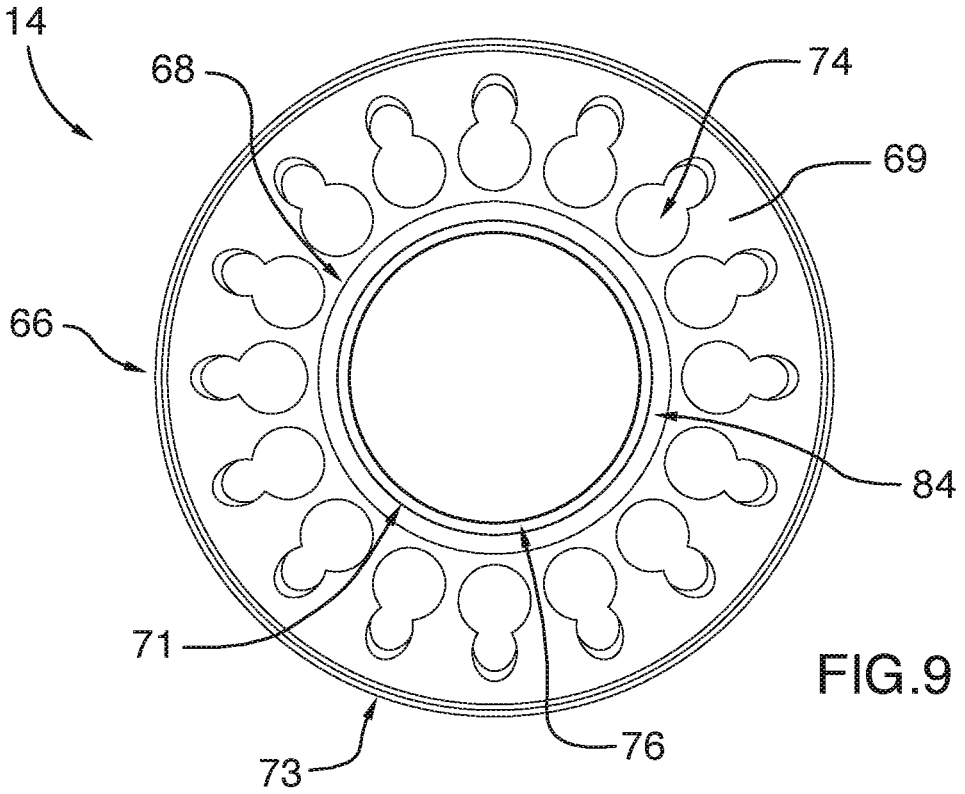
FIG. 9 is a top view of the carousel support shown in FIG. 7.
Figure 10:
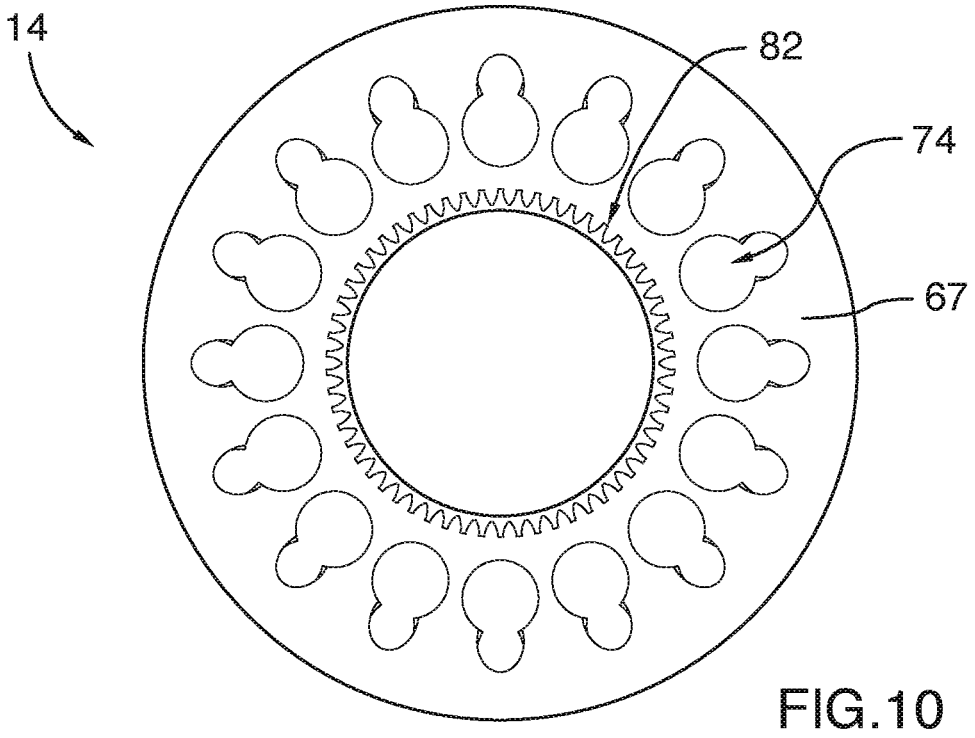
FIG. 10 is a bottom view of the carousel support shown in FIG. 7.

With reference to FIGS. 8 to 10, the carousel support 14 will now be described. The support 14 comprises a lower annular portion 66 and an upper cylindrical portion 68 extending concentrically and upwardly from the lower portion 66. The lower annular portion 66 comprises an annular wall 65 comprising a bottom face 67, a top face 69 an inner circular edge 71 and an outer circular edge 73.

Extending between the bottom and the top faces 67, 69 of the annular wall 65 are a plurality of holes 74 having a key hole shape and corresponding to the shape of release conduit 52 of the base 12. At the inner edge 71 thereof, the annular portion 66 is connected to the upper cylindrical portion 68. At the junction of portions 66 and 68 is a step 84 which will engage the plurality of adaptors 160, 190, 250, as it will become apparent below.

The upper portion 68 of the support 14 comprises a hollow cylindrical body 76 comprising a cylindrical wall 77 defining an internal surface 78 and an external surface 80. At the lower end thereof, the hollow cylindrical body 76 comprises a cog wheel 82 (shown in FIG. 10) which will be engaged with the gear 31 from the rotating means 20 of the base 12, as it will further be explained. Furthermore, as the support 14 is being mounted on the base 12, the internal surface 78 of the hollow cylindrical body 76 abuts the external cylindrical surface 46 of the upper cylindrical body 42 of the base 12, thus allowing the support 14 to rotate relative to the base 12. Once the support 14 is assembled on the base 12, the carousel 10 is adapted to receive different types of portable dispensers 300, 1000, 2000 via the use of adaptors 160, 190, 250.

Figure 11:
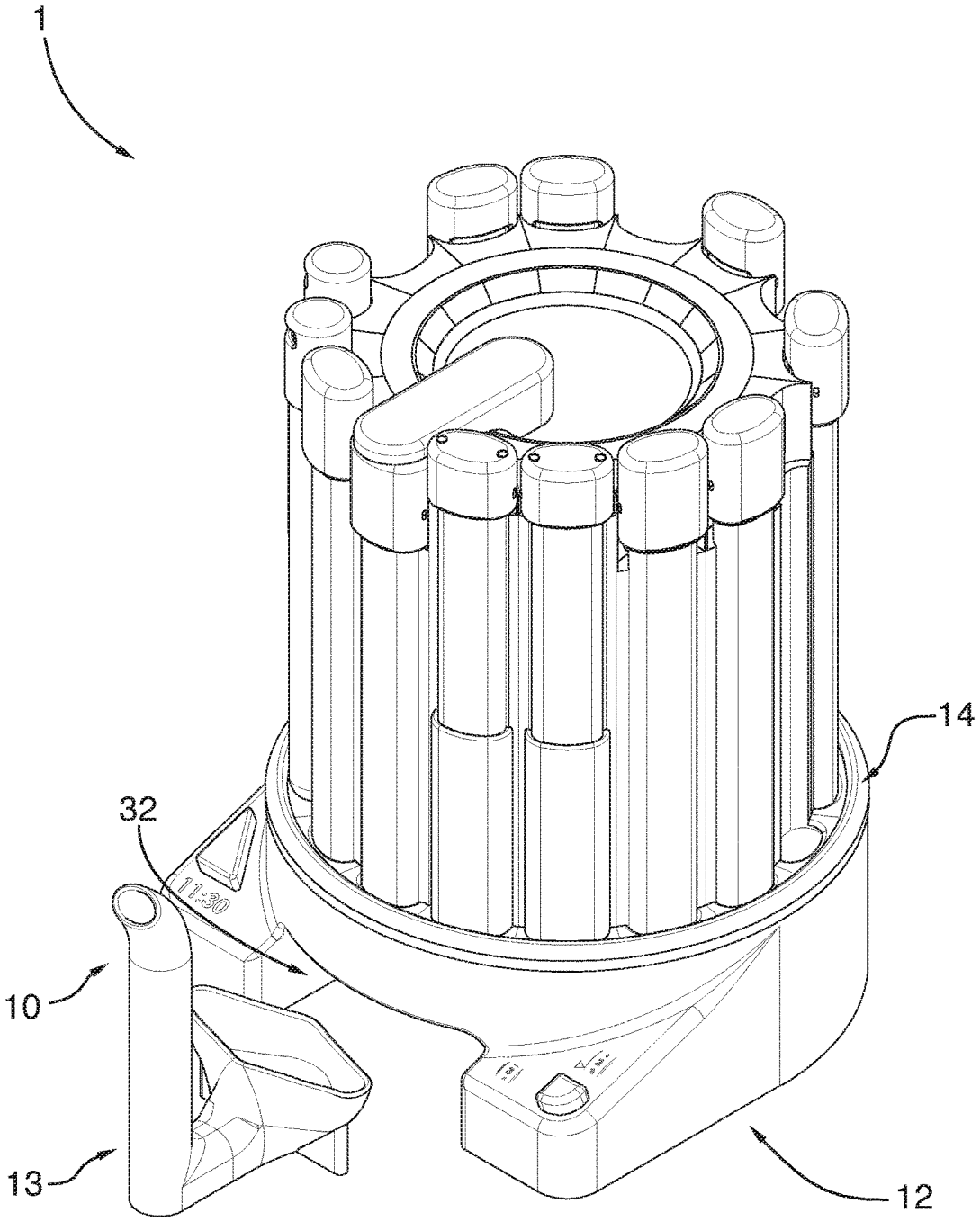
FIG. 11 is a perspective view of the modular system showing a receptacle for recovering medication, the receptacle being removed from the carousel.
Figure 12:
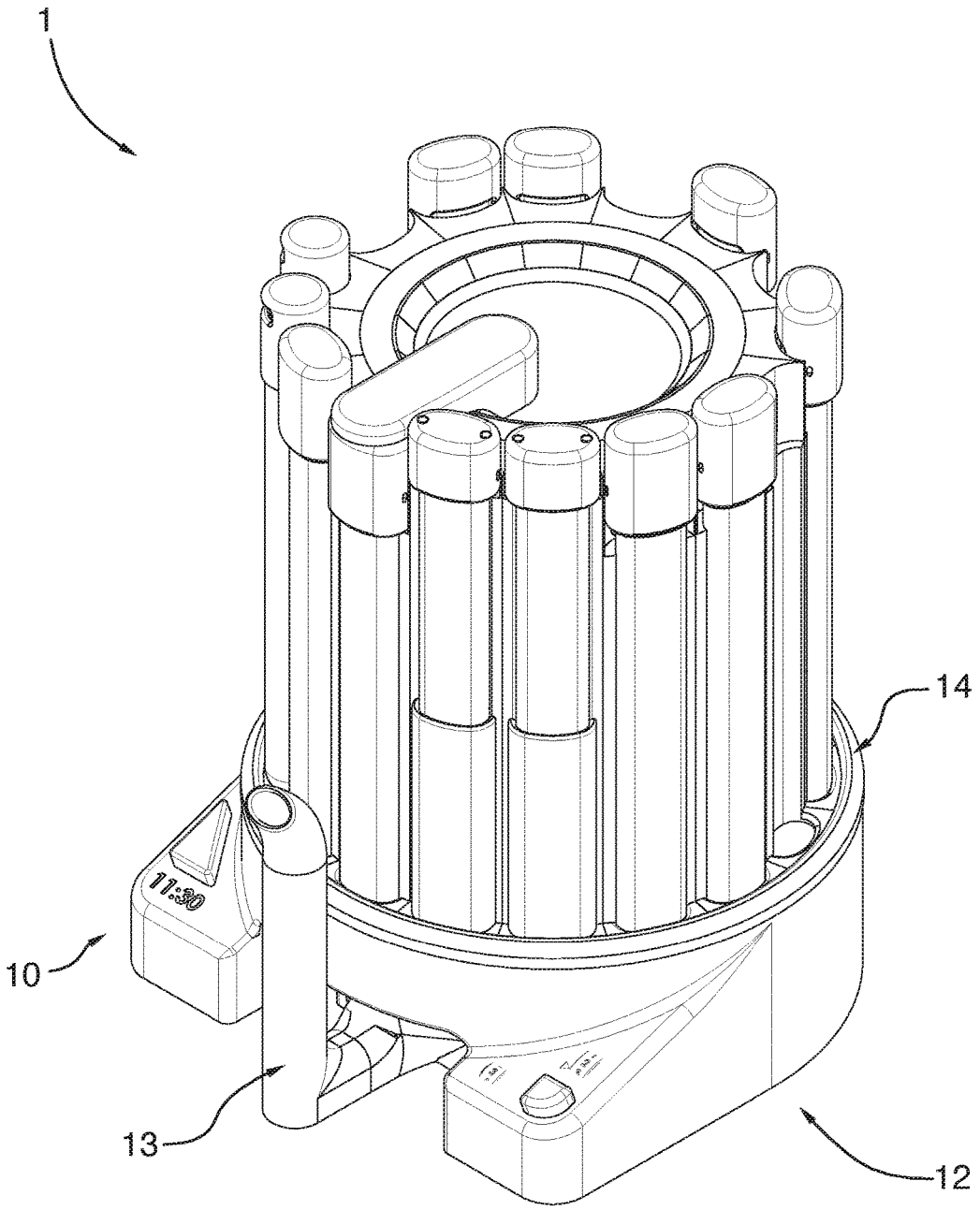
FIG. 12 is a perspective view of the modular system showing the receptacle positioned under the carousel for recovering pills.
Figure 13:
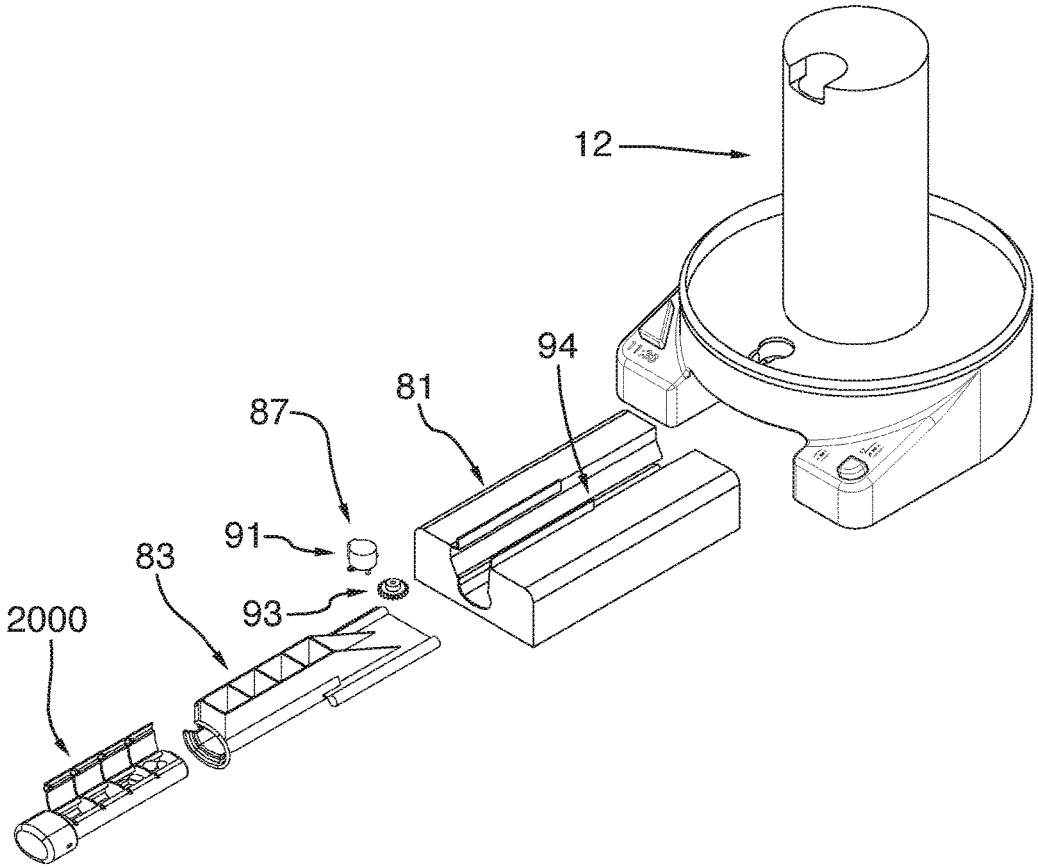
FIG. 13 is a perspective exploded view of a filling assembly showing a portable dispenser, a medication distributor, a moving means, a guide element and the carousel base.

In one embodiment, system 1 is provided with a cup or receptacle 13 to collect the pills, tablets or other types of medication as they are dispensed. In this embodiment the cup 13 is configured to be positioned in the cavity 32 under the release conduit 52 and the dispensing device 21, for receiving the pills, tablets or other types of medication to be ingested by a patient (see FIGS. 11 and 12).

Figure 14:
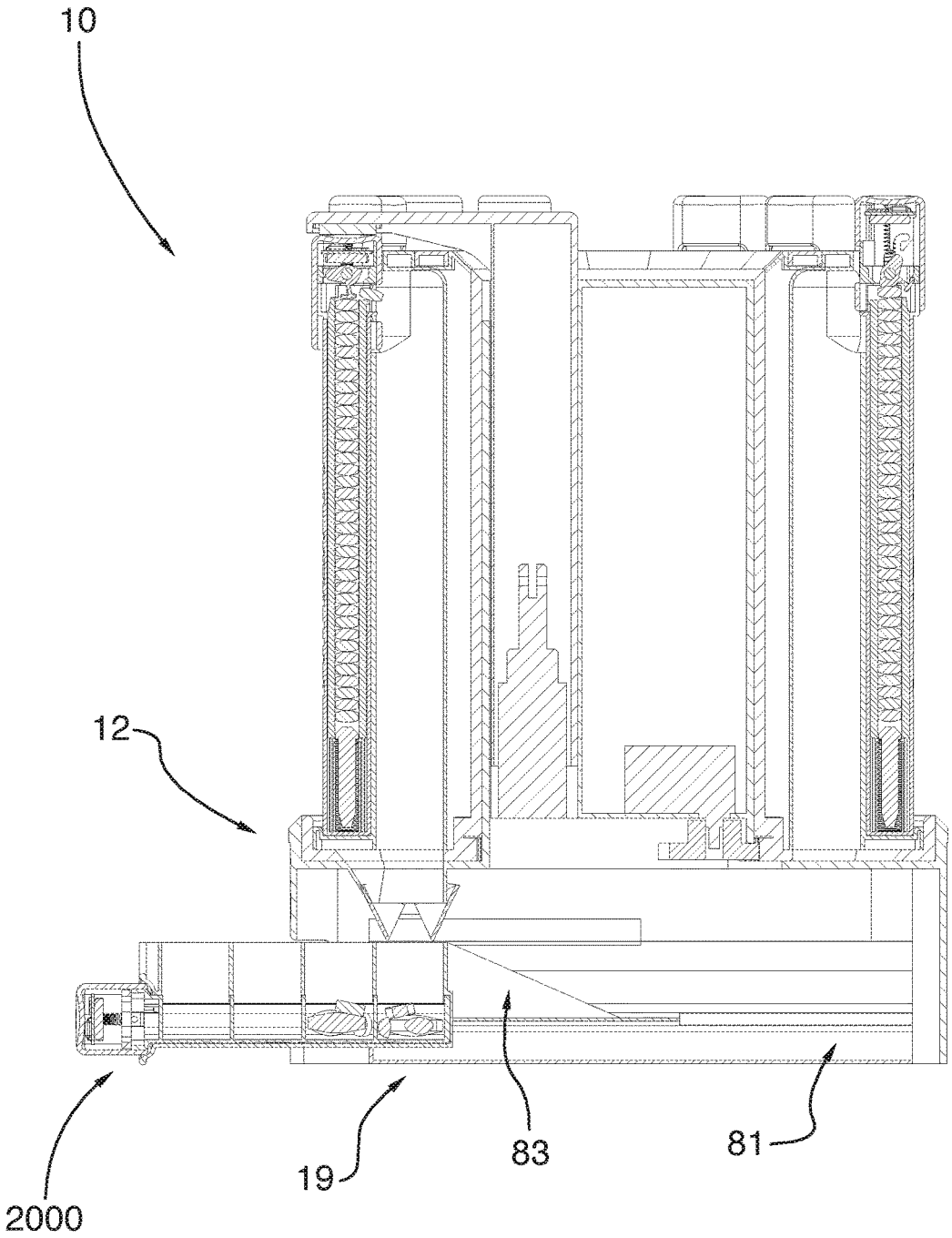
FIG. 14 is a right side cross-sectional view of the filling assembly of FIG. 13 assembled and positioned under the carousel base.
Figure 15:
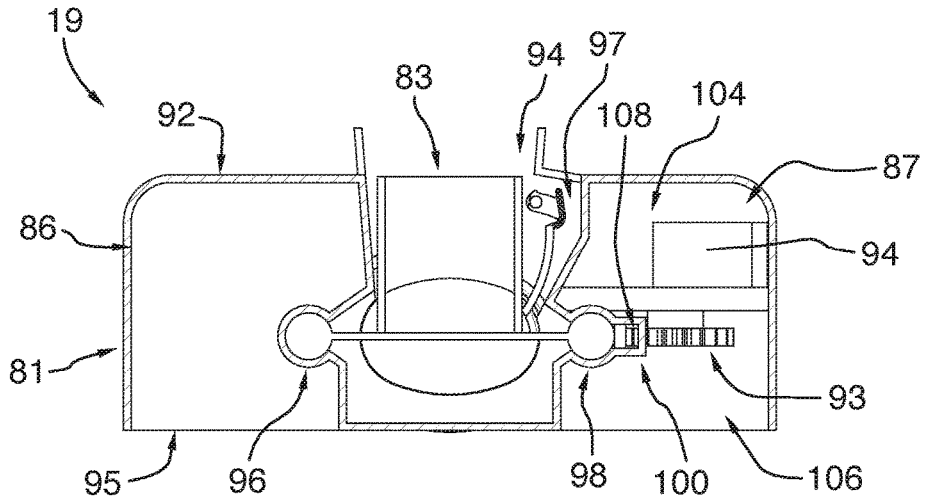
FIG. 15 is a back view of the filling assembly of FIG. 13.
Figure 16:
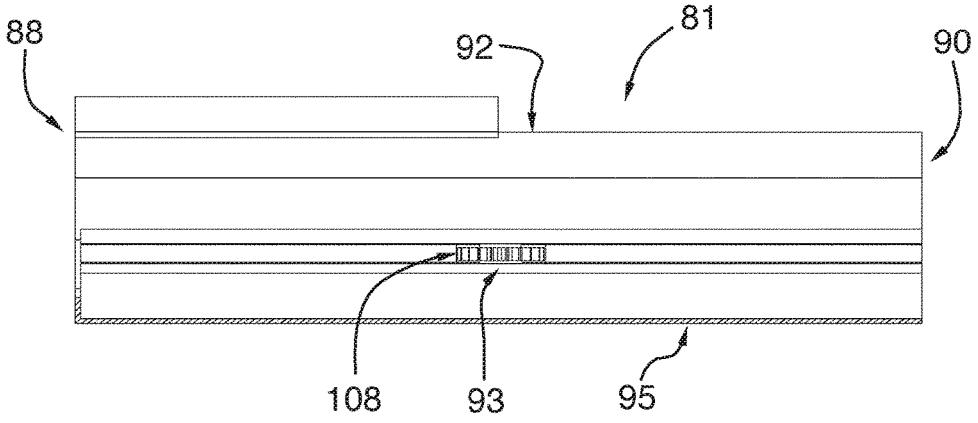
FIG. 16 is a right side cross-sectional view of the guide element of the filling assembly of FIG. 13, showing an opening and a gear of the moving means.
Figure 17:
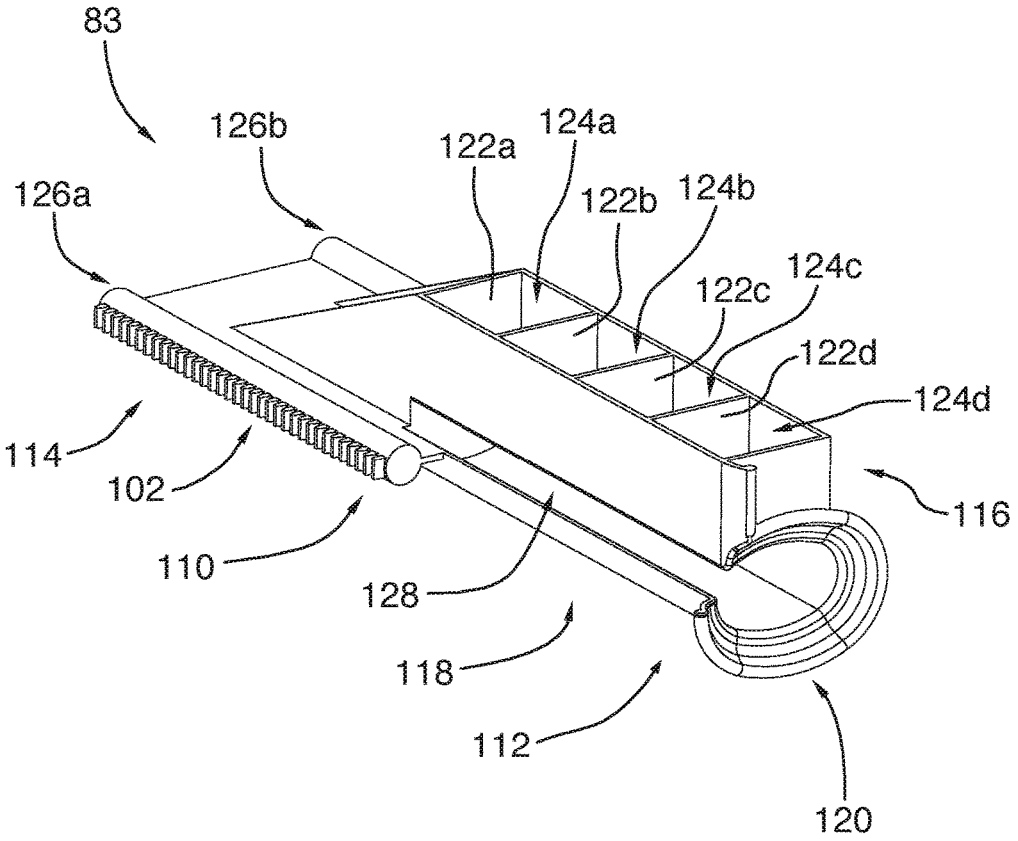
FIG. 17 is a left side perspective view of the medication distributor container shown in FIG. 13.

In an alternative embodiment, shown in FIG. 14, a filling assembly 19 is used instead of a cup 13. In this embodiment the filling assembly 19 is positioned under the base 12 through the space 32. The filling assembly 19 allows to fill the portable dispenser 2000 by dispensing pills, tablets or other types of medication in a plurality of compartments as the portable dispenser 2000 is moved horizontally.

More particularly, with reference to FIGS. 13 to 17, the filling assembly 19 comprises a guide element 81 for guiding a tablet distributor 83 configured to slidably receive a portable dispenser 2000. The filling assembly 19 further comprises a moving means 87 comprised of an electric motor 91 and a gear 93 for horizontally moving the tablet distributor 83 and the dispenser 2000 received therein relative to the guide element 81, thus filling each compartment or container 2016*a*, 2016*b*, 2016*c* or 2016*d* of the portable dispenser 2000.

To do so, the guide element 81 is disposed under the carousel base 12 through the opening 32 and comprises a generally hollow rectangular body 86 having a first end 88 a second end 90, a top portion 92 and a lower portion 95. The body 86 comprises a main groove 94 extending from the top portion 92 to an intermediate portion just above the lower portion 95 and adapted to receive the tablet distributor 83. The groove 94 comprises a recess 97 for receiving the plurality of doors of the portable dispenser 2000 when the doors are in an open state. The body 86 has a width equal to the width between the left and right sides 28, 30 of the U-shaped base portion 36 of the carousel base 12 for avoiding relative displacement of the guide element 81 relative to the carousel base 12 during the filling process. The groove 94 is longitudinally positioned in the middle of the body 86 and comprises a first partially circular groove 96 for inserting a complementary protrusion of the tablet distributor 83 and a second partially circular protrusion 98 further comprising an extending groove 100 for receiving a mechanical rack 102 of the tablet distributor 83 as it will further be explained. Furthermore, the guide element 81 comprises an upper chamber 104, located on one side of the groove 94, for mounting an electric motor 91 and a lower chamber 106, located under the upper chamber 104 for mounting the gear 93 onto the shaft of the motor 91. The extending groove 100 of the second partially circular groove 98 comprises an opening 108 which engages the mechanical rack 102 with the gear 93 for horizontally moving the tablet distributor 83.

The tablet distributor 83 comprises a generally hollow body 110 which matches the external shape of the portable dispenser 2000. The hollow body 110 comprises a first end 112, a second end 114, an upper portion 116 and a lower portion 118. The first end 112 of the body 110 comprises a funnelled opening 120 for helping inserting the portable dispenser 2000 therein. The upper portion 116 of the body 110 comprises a plurality of vertical walls 122*a*, 122*b*, 122*c* and 122*d*, extending upwardly vertically above the body 110 and delimiting a plurality of compartments 124*a*, 124*b*, 124*c*, 124*d* being aligned with the plurality of compartments of the portable dispenser 2000 as the portable dispenser 2000 is inserted therein. The second end 114 of the tablet distributor 83 further comprises a pair of partially circular protrusions 126*a*, 126*b* extending horizontally from the main body 110 and for being inserted in the pair of partially circular grooves 96, 98 of the guide element 81. The protrusion 126*a* further comprises a mechanical rack 102 which will engage with the gear 93 for moving the tablet distributor 83 horizontally as the different compartments or container 2016*a*, 2016*b*, 2016*c* or 2016*d* of the portable dispenser 2000 are being filled. The body 110 further comprises a longitudinal opening 128 extending from the first end 112 for receiving the plurality of doors 2018*a*, 2018*b*, 2018*c* and 2018*d* of the portable dispenser 2000 when the doors 2018*a*, 2018*b*, 2018*c* and 2018*d* are in an open state.

The filling assembly 19 is assembled by first providing the guide element 81 equipped with the movable means 87. The tablet distributor 83 is subsequently inserted in the guide element 81 by inserting the second end 114 of the tablet distributor 83 in the guide element 81 and by inserting the protrusion 126*a* comprising the mechanical rack 102 in the groove 98 comprising an opening 108. The filling assembly 19 is fully assembled once the tablet distributor 83 is inserted in the guide element 81 and the gear 93 engages the mechanical rack 102 of the tablet distributor 83.

Figures 18, 19:
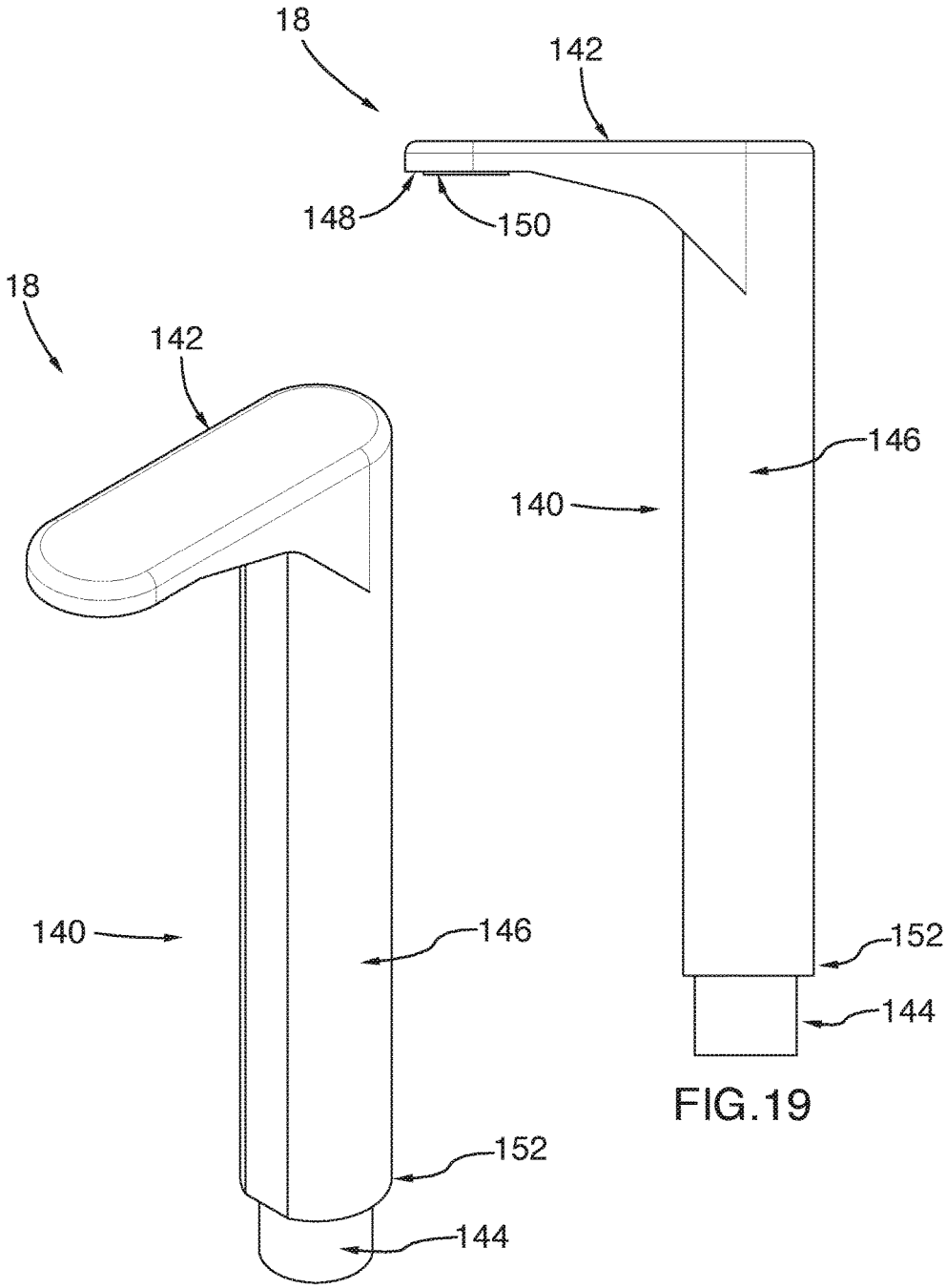
FIG. 18 is a perspective view of an actuating device of FIG. 2.
FIG. 19 is a right side view of the actuating device of FIG. 18.
Figure 20:
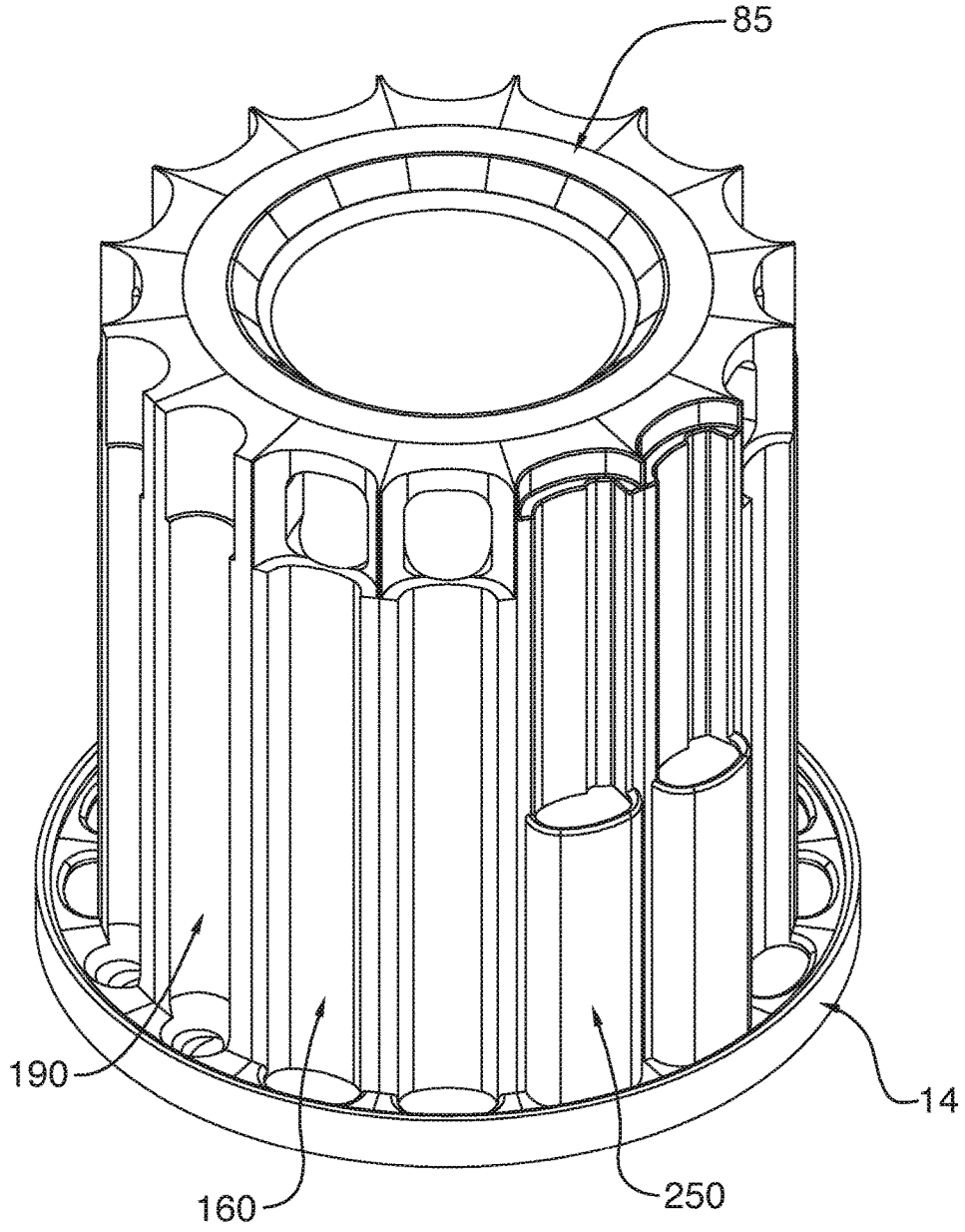
FIG. 20 is perspective view of the different adaptors of FIG. 2, mounted on the carousel support with a coupling ring.

In one embodiment, the portable dispensers 300 and 1000 are configured to be actuated using a compression movement. In this embodiment, and with reference to FIGS. 18 and 19, the actuating device 18 of the carousel 10 comprises an inverted L-shaped device 140 comprising an arm 142 and an actuating shaft 144. The L-shaped device 140 comprises a hollow cylindrical body 146 which is inserted in the eccentric conduit 50 of the upper cylindrical body 42 of the base 12, and a horizontally extending arm 142 comprising a communication device 148 for synchronizing the plurality of portable dispensers 300, 1000, 2000 with the electronic system 16 of the carousel 10. The communication device 148 could, for example, be a Bluetooth antenna or the like. The horizontally extending arm 142 comprises a pusher pad 150 for abutting the upper end of the different portable dispensers 300, 1000 as they are actuated. The actuating shaft 144 is partially inserted through the lower end 152 of the hollow cylindrical body 146 and is fixedly attached thereto thanks to attaching means such as screws or fasteners. The actuating shaft 144 exerts a vertical upward and downward force during dispensing periods therefor moving the arm body 146 and therefore the arm 144 upward and downward thus actuating the different dispensers 300, 1000. This vertical movement of the actuating shaft can be produced by using a solenoid or any other suitable means. The actuating shaft 144 will be controlled by the electronic system 16 as it will be further explained.

Turning now to FIGS. 20 to 28, the adaptors 160, 190, 250 will now be described.

Figure 21:
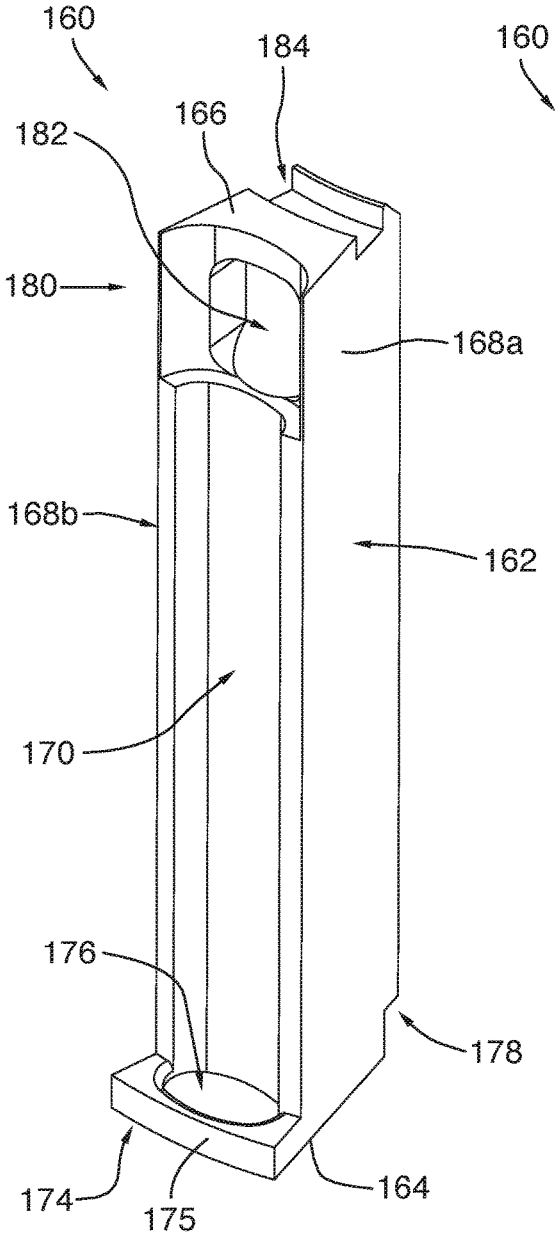
FIG. 21 is a perspective view of a first type of adaptor.
Figure 22:
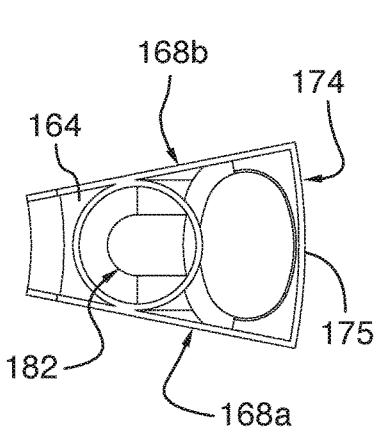
FIG. 22 is a bottom view of the adaptor of FIG. 21.
Figure 23:
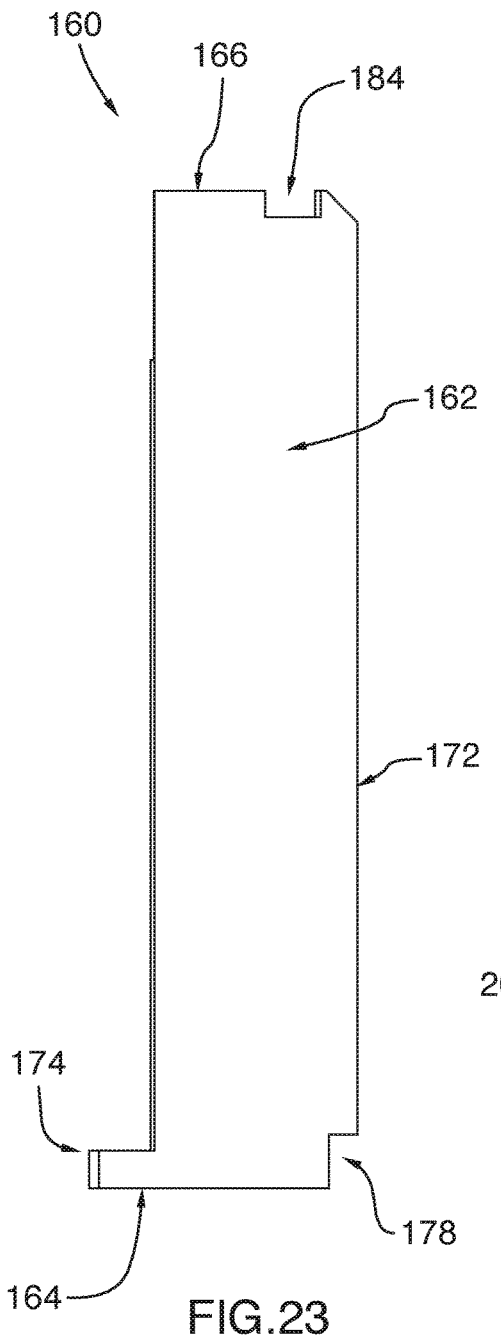
FIG. 23 is a right side view of the adaptor of FIG. 21.

FIGS. 21 to 23 illustrate an adaptor 160, which is configured to mount portable dispenser 300 to the carousel 10. In this embodiment, adaptor 160 comprises a main body 162 including a bottom wall 164, a top wall 166, a pair of spaced apart side walls 168*a*, 168*b*, a front wall 170 and a back wall 172. The bottom wall 164 comprises a horizontal outwardly extending protrusion 174 and an elliptical recess 176 formed therein, for receiving and maintaining the lower end of a portable dispenser 300. The bottom wall 164 further abuts the top face 69 of the support 14 as it is mounted thereon and provides an interface between the dispenser 300 and the support 14. Protrusion 174 of the bottom wall 164 comprises an outward surface 175 which abuts the ledge 73 of the support 14 when the adaptor 160 is mounted on the support 14. The back wall 172 of the adaptor 160 is curved to match the curvature radius of the support 14 and comprises a recess 178 abutting the step 84 of the hollow cylindrical body 76 as the adaptor 160 is received on the support 14. The side walls 168*a*, 168*b* gently converge from front to back and the front wall 170 is configured to match the external shape of dispenser 300.

The front wall 170, at the upper end 180 thereof, comprises a main dispensing conduit 182 which extends through the main body 162 and through the bottom wall 164.

The dispensing conduit 182 will guide pills or tablets as they are dispensed from the portable dispenser 300 through the main dispensing conduit 182 of the adaptor 160 and through one of the plurality of holes 74 of the support 14, when one of the plurality of holes 74 is aligned or in registry with the release conduit 52 of the base 12.

The top wall 166 of the adaptor 160 further comprises a groove 184 which will receive a coupling ring 85 for coupling the plurality of adaptors 160, 190, 250 as they are mounted on the support 14, to avoid any relative movement of the adaptors 160, 190, 250 relative to the support 14.

Figure 24:
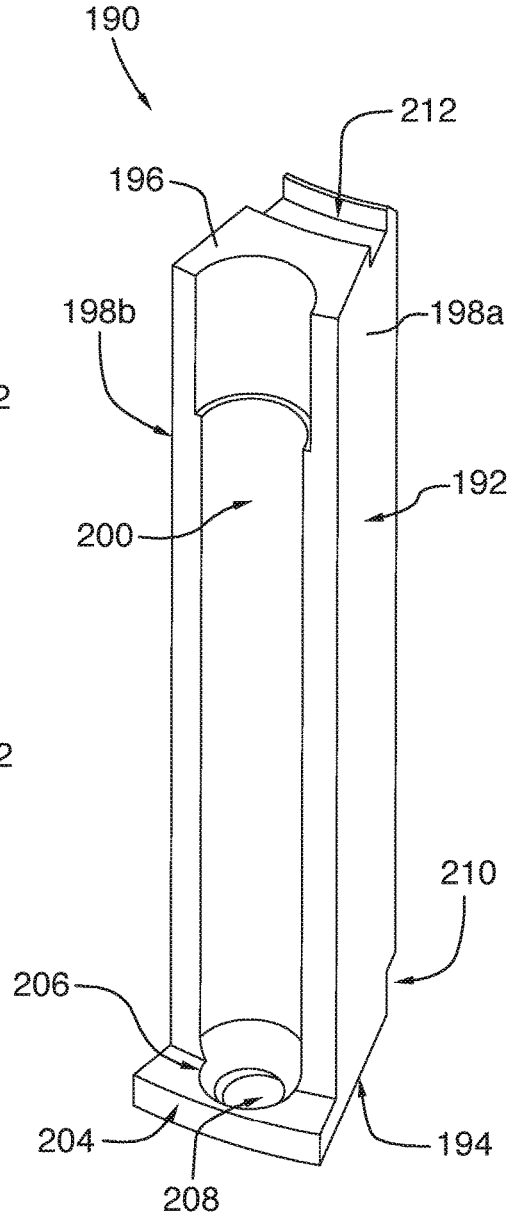
FIG. 24 is a perspective view of a second type of adaptor.
Figure 25:
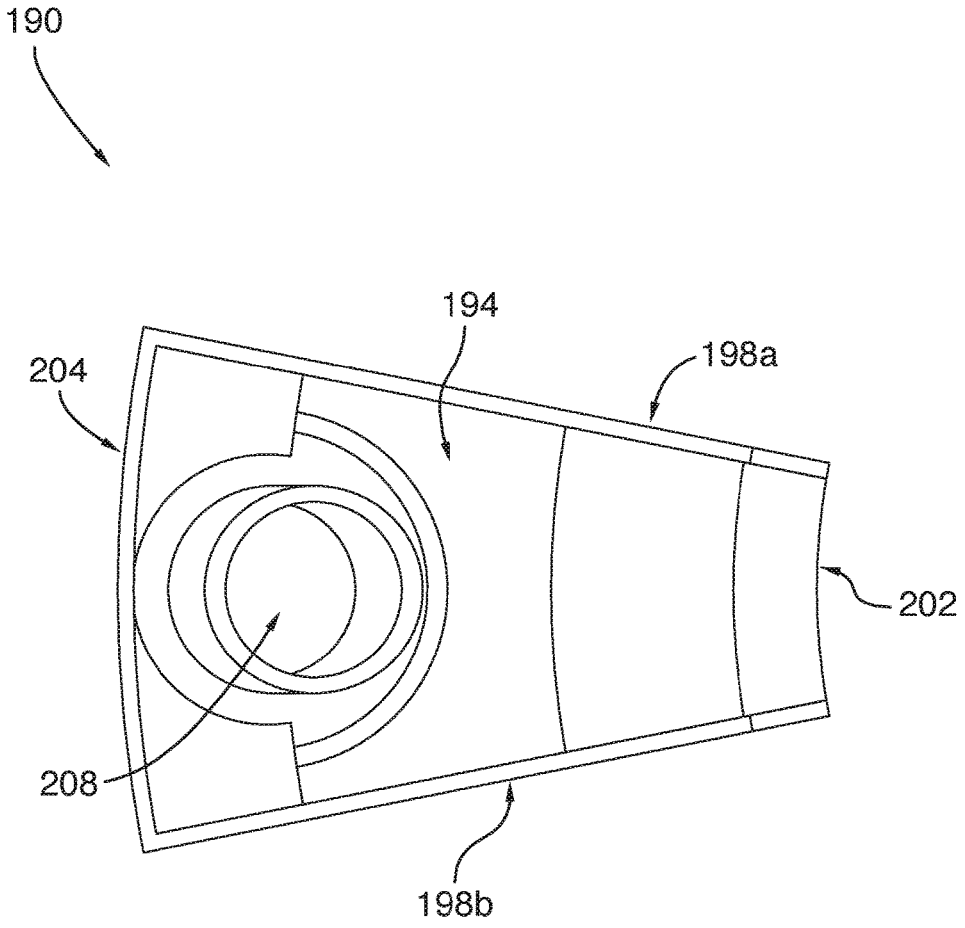
FIG. 25 is a bottom view of the adaptor of FIG. 24.
Figure 26:
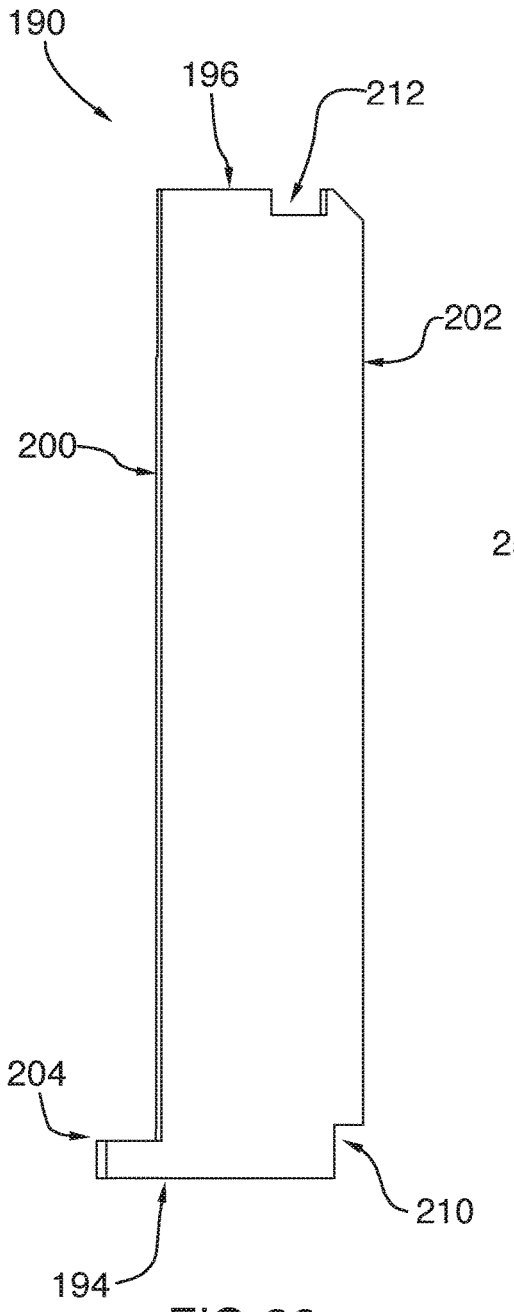
FIG. 26 is a right side view of the adaptor of FIG. 24.

FIGS. 24 to 26 illustrate a another embodiment of an adaptor 190 for use with a second type of portable dispenser 1000. Adaptor 190 comprises a main body 192 including a bottom wall 194, a top wall 196, a pair of spaced apart side walls 198*a*, 198*b*, a front wall 200 and a back wall 202. The bottom wall 194 comprises a horizontal outward extending protrusion 204 and an circular recess 206, formed therein, for receiving and maintaining the lower end of a portable dispenser 1000. The bottom wall 194 further abuts the top face 69 of the support 14 as it is mounted thereon, therefore providing an interface between the dispenser 1000 and the support 14. The protrusion 204 comprises an outward surface which abuts the ledge 73 of the support 14. The protrusion 204 further comprises a main dispensing opening 208 which is aligned or in registry with one of the plurality of holes 74 of the support 14, for allowing medications to be dispensed when the opening 208 is aligned with the release conduit 52 of the base 12. The back wall 202 is curved to match the curvature radius of the support 14 and comprises a recess 210 abutting the step 84 of the hollow cylindrical body 76 as the adaptor 190 is received on the support 14. The side walls 168*a*, 168*b* gently converge from front to back and the front wall 200 is configured to match the external shape of dispenser 1000.

As with top wall 196 of adaptor 160, the top wall 196 of adaptor 190 further comprises a groove 212 which receives the coupling ring 85 for coupling the plurality of adaptors 160, 190, 250 as they are mounted on the support 14, to avoid any relative movement of the adaptors 160, 190, 250 relative to the support 14.

Figure 27:
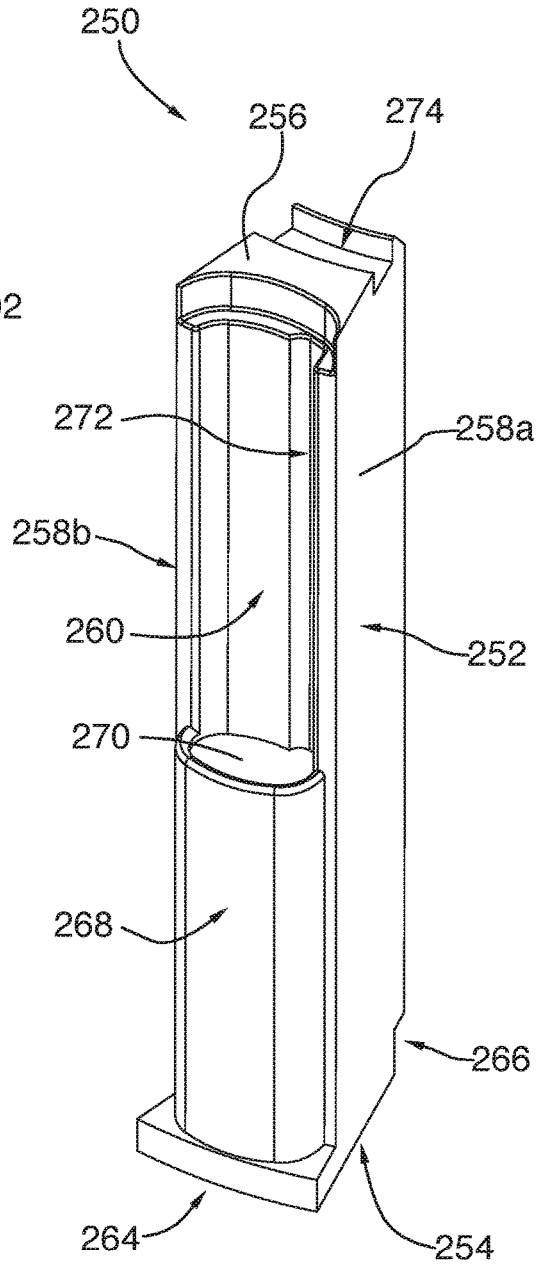
FIG. 27 is a perspective view of a third type of adaptor.
Figure 28:
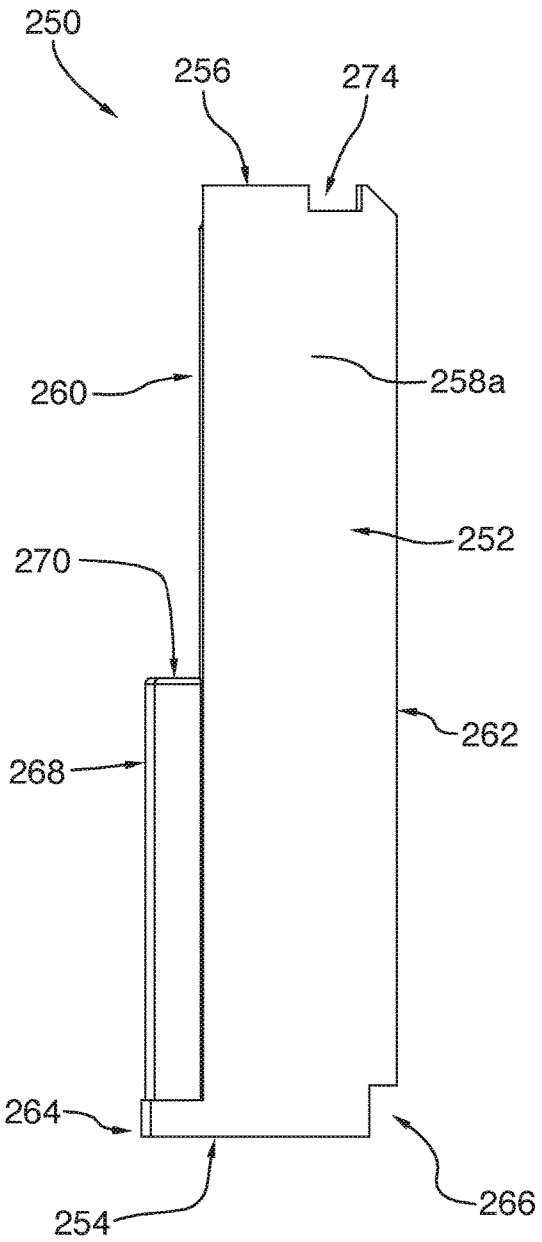
FIG. 28 is a right side view of the adaptor of FIG. 28.

FIGS. 27, 28 illustrate another embodiment of an adaptor 250. In this embodiment, the adaptor is configured to receive a third type of portable dispenser 2000. Adaptor 250 comprises a main body 252 including a bottom wall 254, a top wall 256, a pair of spaced apart side walls 258*a*, 258*b*, a front wall 260 and a back wall 262. The bottom wall 254 comprises a horizontal outward extending partially circular protrusion 264 includes an outward surface which abuts the ledge 73 of the support 14. The bottom wall 254 further abuts the upper face 69 of the support 14 as it is mounted thereon. The back wall 262 is curved to match the curvature radius of the support 14 and comprises a recess 266 abutting the step 84 of the hollow cylindrical body 76 as the adaptor 250 is received on the support 14. The front wall 260 of the adaptor 250 comprises at an intermediate position between the bottom wall 254 and the top wall 256, a protrusion 268 extending from the front wall 260 and comprising an elliptical upper surface 270 for receiving the lower end of portable dispenser 2000. The front wall further comprises a vertical groove 272 extending from the top wall 256 to the protrusion 268 for matching the shape of the portable dispenser 2000.

The top wall 256 includes a groove 274 configured to receive a coupling ring 85 for coupling the plurality of adaptors 160, 190, 250 as they are mounted on the support 14 and to avoid any relative movement of the adaptors 160, 190, 250 relative to the support 14.

Having described the general configuration of the carousel 10, different types of portable dispensers usable with the system will now be described in connection with FIGS. 29 to 56.

Figure 29:
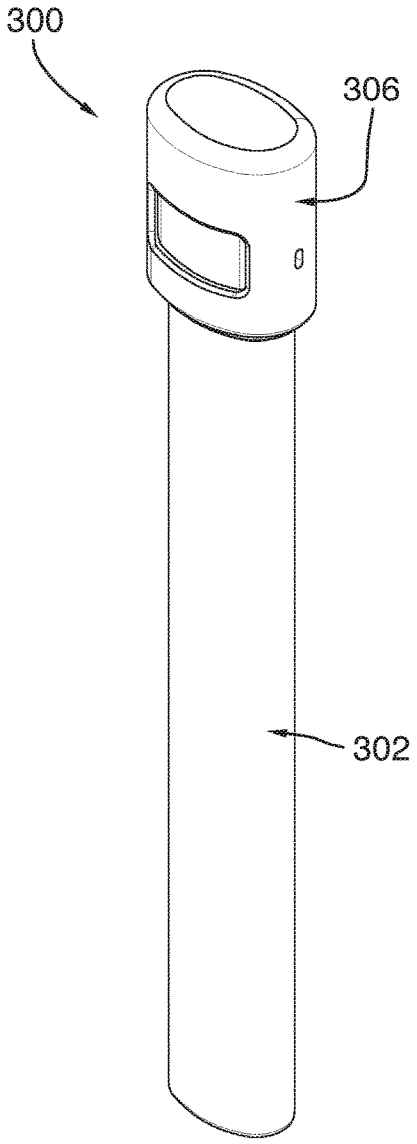
FIG. 29 is a perspective view of a first type of portable dispenser shown in FIG. 2.
Figure 30:
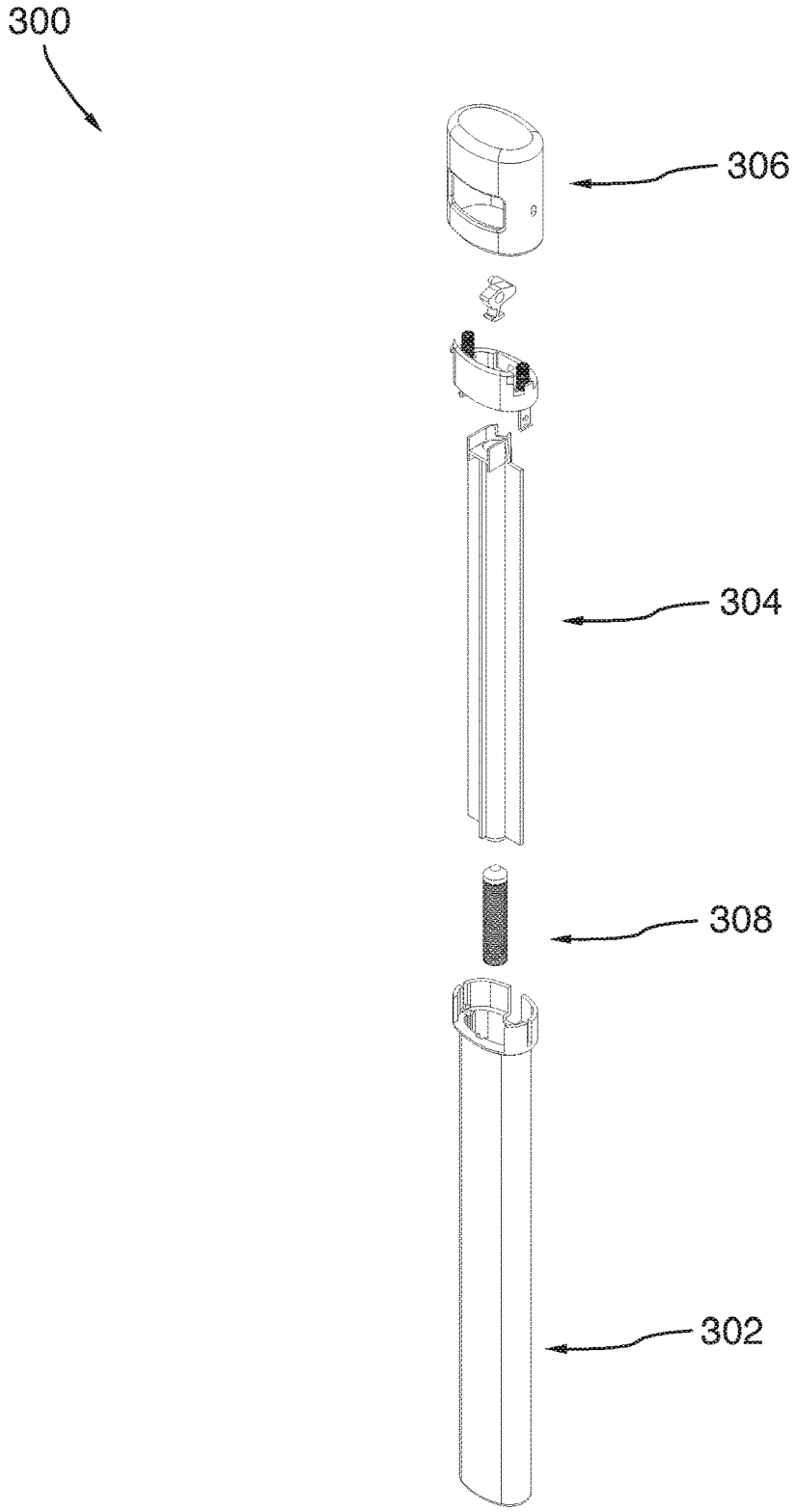
FIG. 30 is a perspective exploded view of the portable dispenser of FIG. 29.

Depicted in FIGS. 29 and 30, there is shown a first type of portable dispenser 300 in accordance with a first embodiment. The portable dispenser 300 is configured to allow occasional mobility from the user, thus enabling a user to take his medication even if he is away from home. The portable dispenser 300 is compact and has the general size of a pen and is easy to carry. Portable dispensers 300 can be used by patients to make medication rapid and easy to access. Therefore, medication can be discretely dispensed to a patient. Furthermore, the portable dispenser 300 is particularly user friendly for patients with Parkinson's disease as they are unable to perform basic movements like unscrewing a cap or opening a receptacle. Therefore, the portable dispenser 300 overcomes that problem by providing an means by which a patient clicks a button on the portable dispenser 300 to obtain a single dose of medication (e.g. a pill or a tablet)

In this embodiment, the dispenser 300 comprises an elongated housing 302 for receiving a tablet cartridge 304, and a button 306. Mounted in the housing 302 is a spring assembly 308 engaging the cartridge 304 and providing spring bias. The spring assembly 308 collaborates with the button 306 to dispense single doses of medication to the user, as it will become more apparent below.

With reference to FIGS. 31 to 34, the housing 302 has the shape of an elongated hollow body and comprises a lower end 310, an upper end 312 and a wall 314 extending between the lower and upper ends 310, 312. In this embodiment, the housing 302 has an elliptical cross-section (best shown in FIG. 33) for allowing the use of the portable dispenser 300 to receive cartridges (e.g. cartridges 304 and 438) adapted to stack medications having different sizes and shapes. For instance, Salino™ is the largest medication formulation used in the treatment of Parkinson's disease, and has a generally oval shape, while the Domperidone™, also used in the drug regimen for the treatment of Parkinson's disease is substantially smaller and has a round shape. Therefore, by using different receiving cartridges (e.g. cartridges 304 and 438) adapted to the shape and size of the medications (e.g. round, oblong, oval, square, rectangle, diamond, 2 sided, 5 sided, 6 sided, 7 sided, 8 sided and the like) in the housing 302, the portable dispenser 300 can be used to dispense various types of medications. Therefore, in a preferred embodiment, the main elongated housing 302 has a generally elliptical shape to accommodate different pills or tablets formats. As it will be appreciated, the cross-section of the housing 302 could differ without departing from the scope of the embodiment.

At the lower end 310 of the housing 302 is provided a wall 316 having a shape corresponding to the cross-section of the housing 302, the wall 316 having an outer face 318 defining a surface for placing the dispenser on a plane surface such as a table, a counter or a carousel (e.g. carousel 10). The wall 316 also has an inner face 320, on which is mounted the spring assembly 308.

Figure 31:
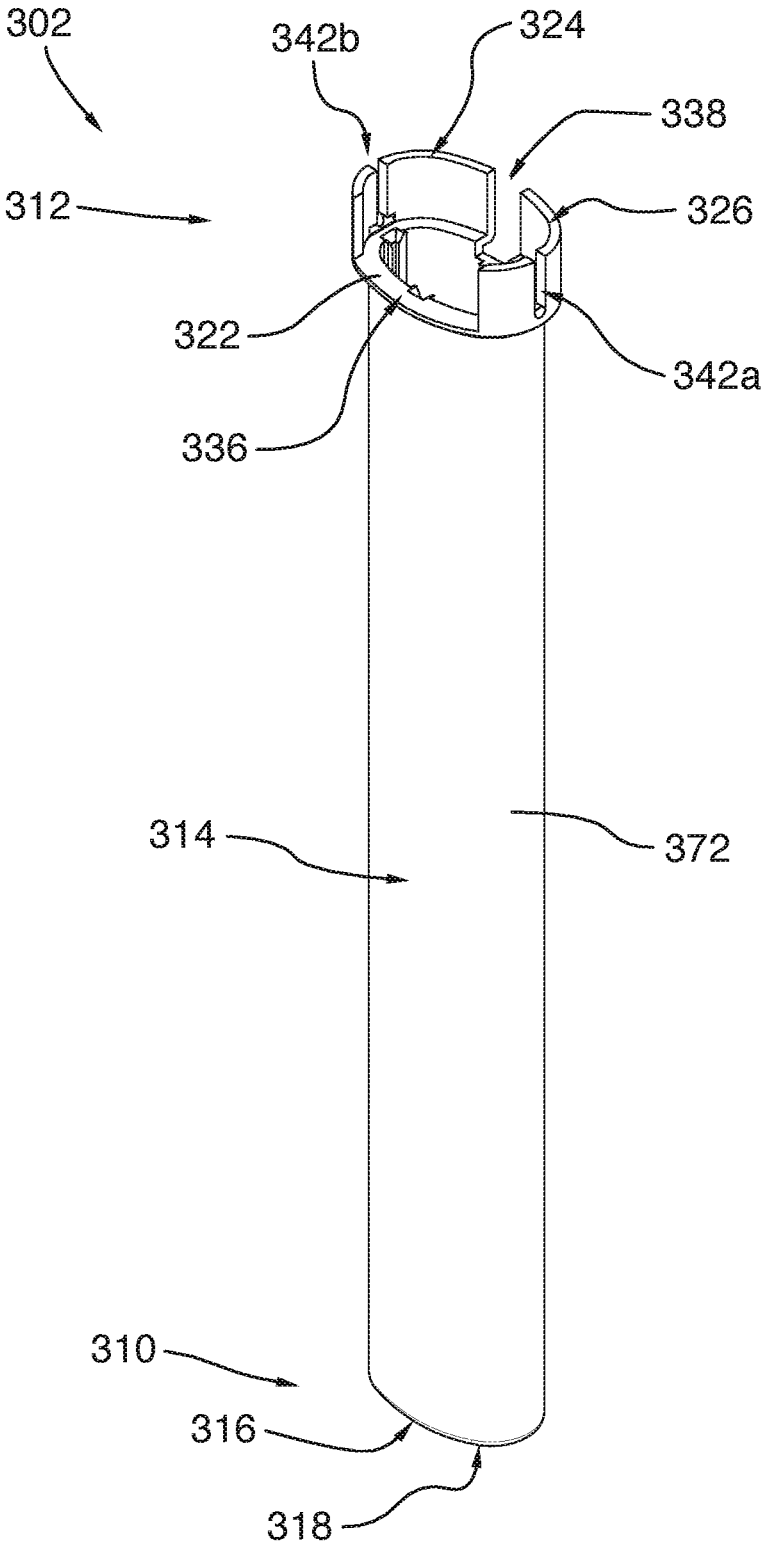
FIG. 31 is a perspective view of a housing of the portable dispenser of FIG. 30.
Figure 32:
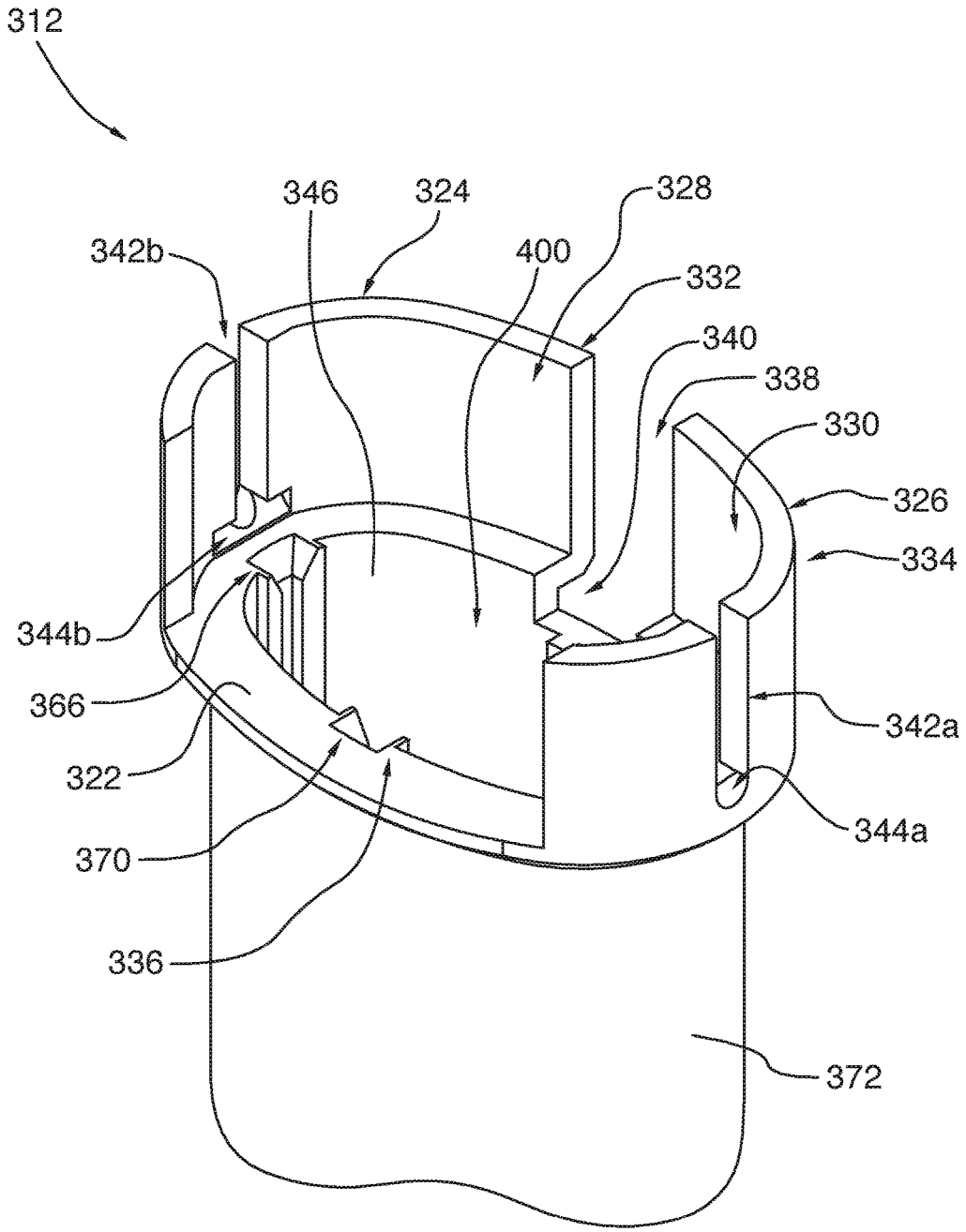
FIG. 32 is an enlarged perspective view of the upper end of the housing of FIG. 31.
Figure 33:
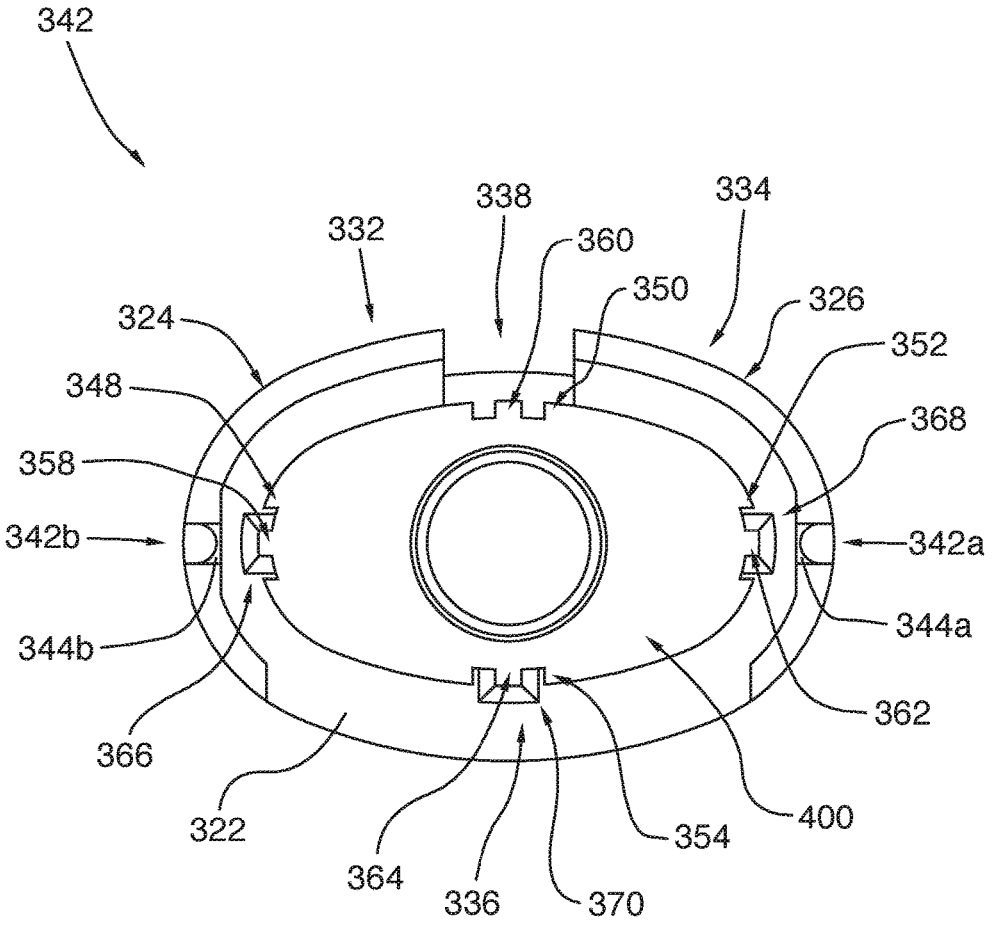
FIG. 33 is a top view of the housing of FIG. 31.
Figure 34:
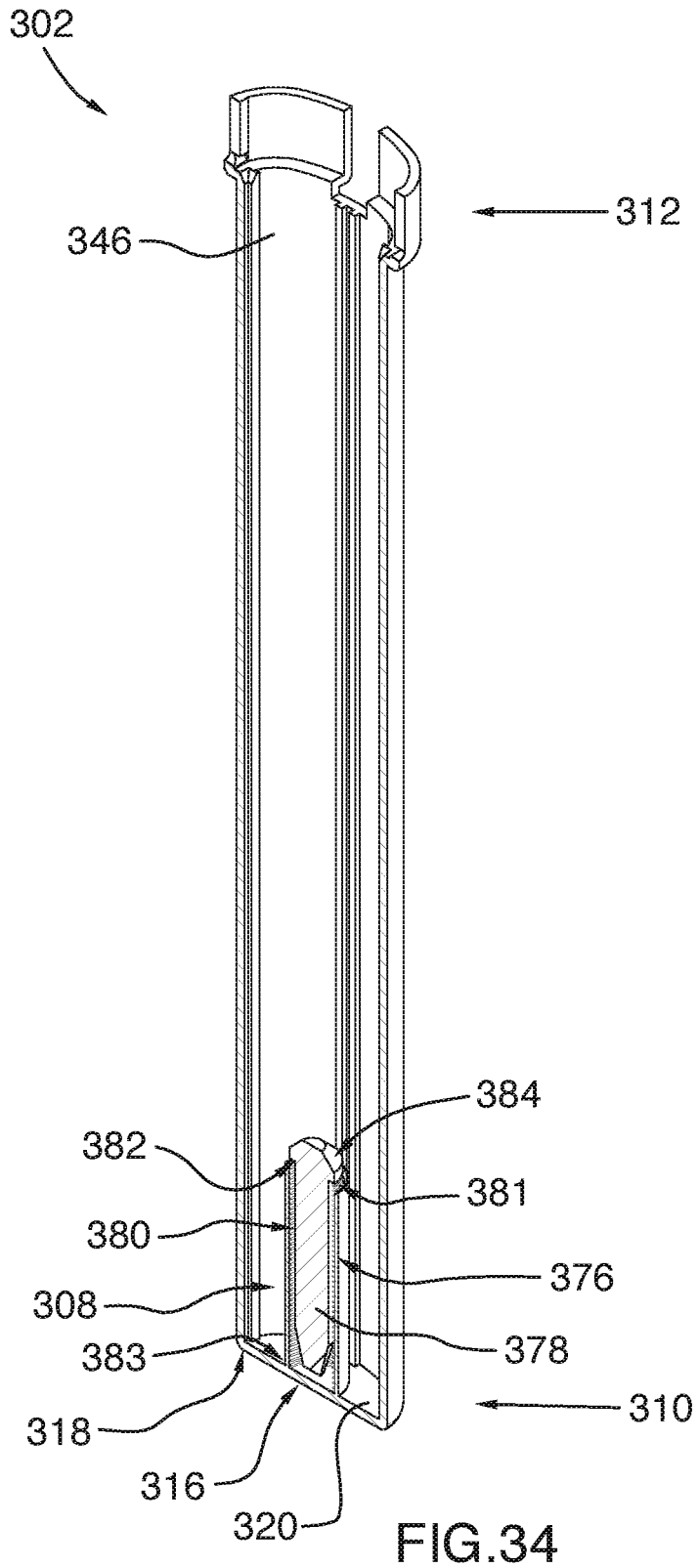
FIG. 34 is a perspective cross-sectional view of the housing of FIG. 31 showing a spring assembly.
Figure 35:
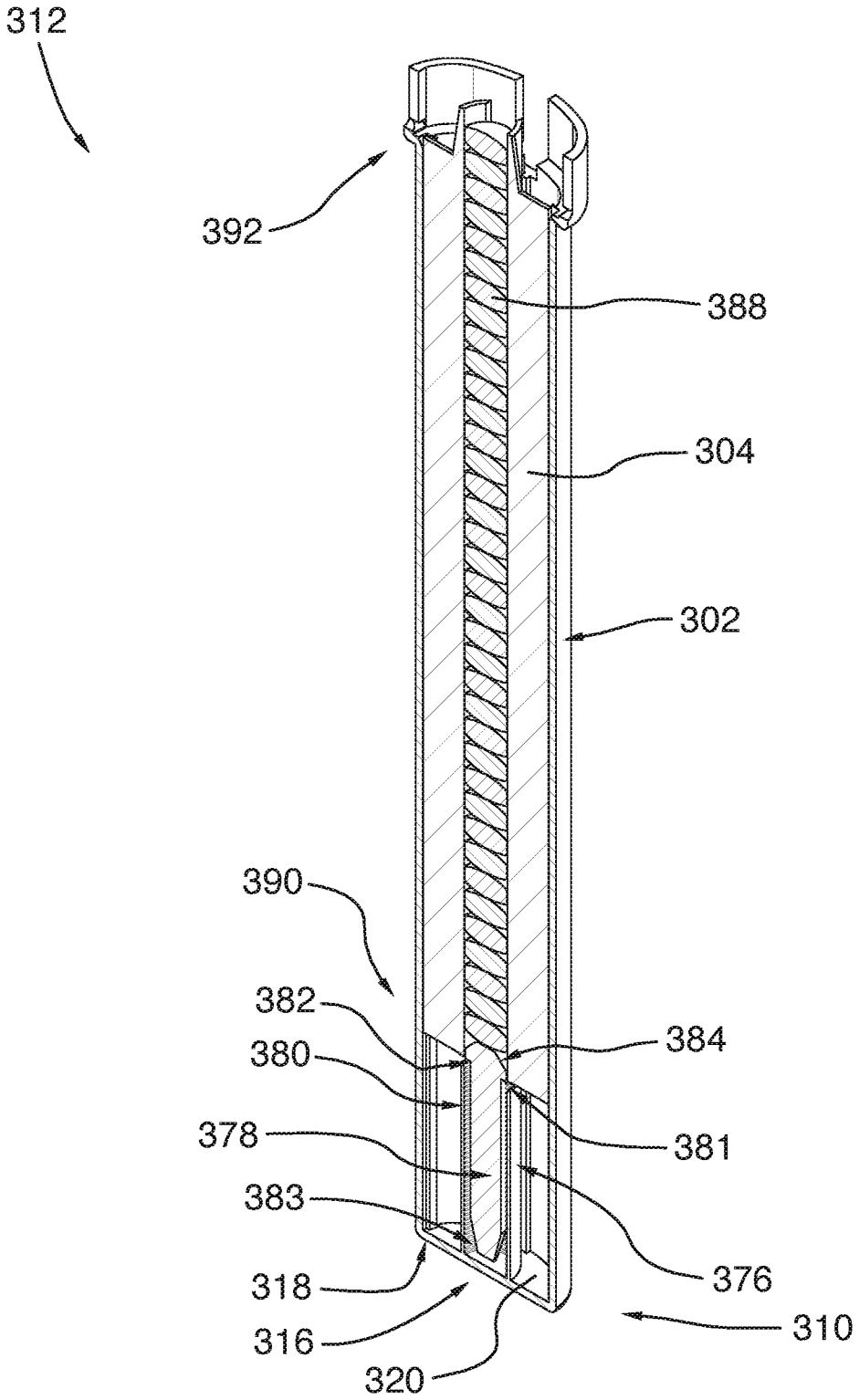
FIG. 35 is a perspective cross-sectional view of the housing of FIG. 31 showing a first type of cartridge inserted therein.
Figure 36:
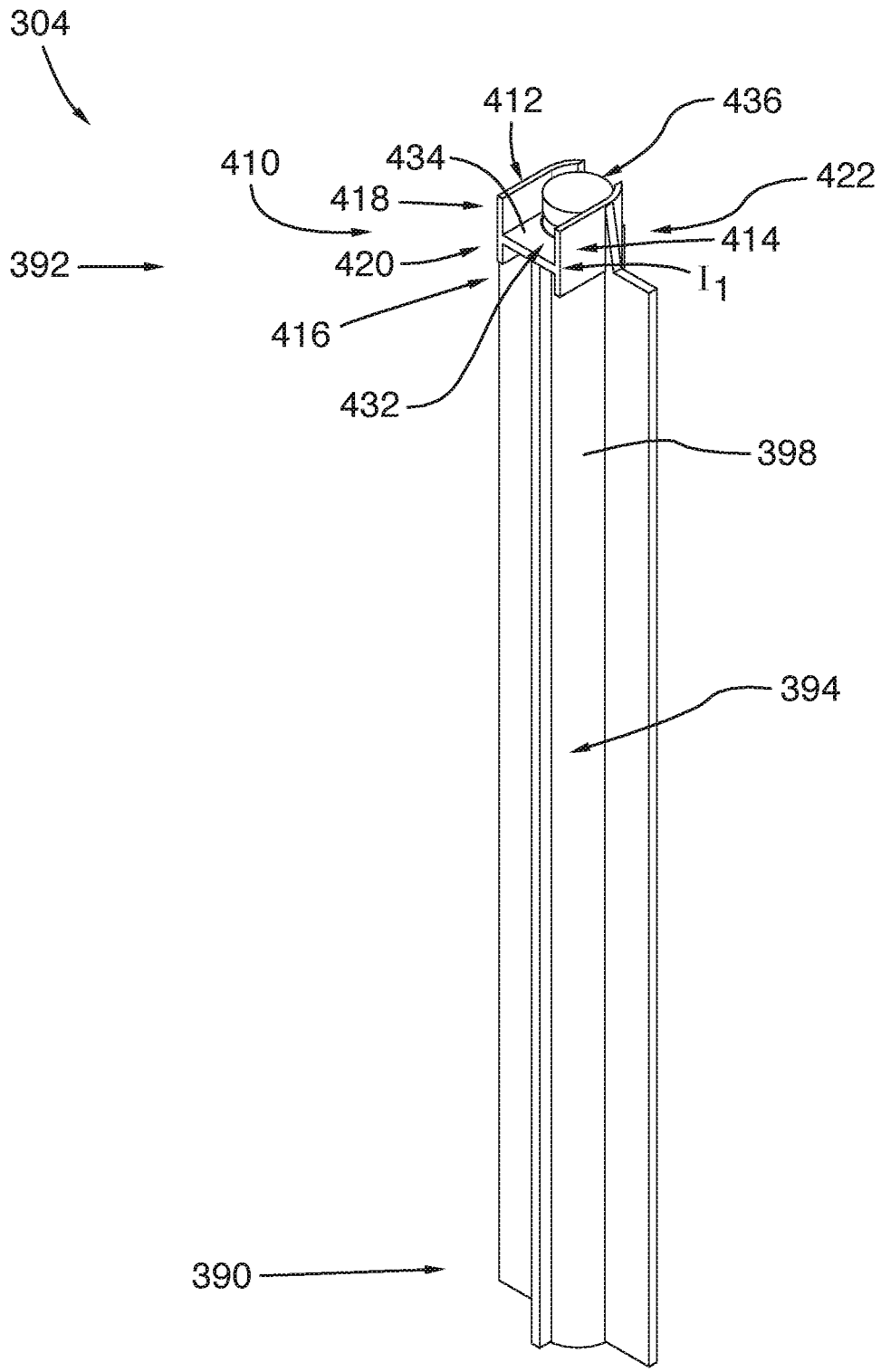
FIG. 36 is a perspective view of the first type of cartridge shown in FIG. 35.
Figure 37:
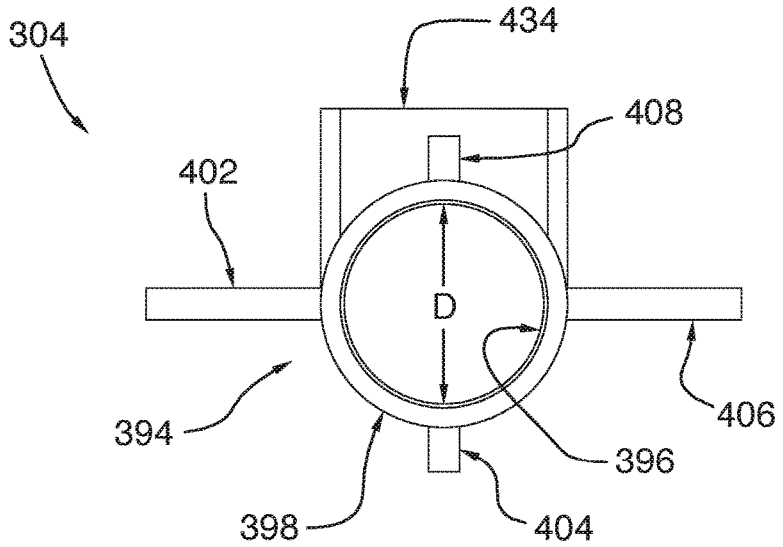
FIG. 37 is a bottom view of the cartridge of FIG. 36.

As depicted in FIGS. 31 to 33, the upper end 312 of the housing 302 is an open end from which the tablets are ejected to be dispensed to the user. The upper end 312 of the housing 302 includes an abutment 322 extending radially from the housing 302 and surrounding a major portion thereof, and a pair of spaced-apart curved walls 324, 326 extending from the abutment 322, in the longitudinal direction of the housing (i.e. vertically when the housing 302 stands upright).

Each spaced apart curved wall 324, 326 comprises a front end 328, 330 and a back end 332, 334. Defined between the front ends 328, 330 of the curved walls 324, 326 is a main opening 336 for receiving a portion of the cartridge 304, as it will become apparent below. Opposed to the main opening 336, and defined by the back ends 332, 334 of the curved walls 324, 326 is a back opening 338. As best shown in FIG. 32, the back opening 338 defined by the curved walls 324, 326 is in vertical alignment with a recess 340 defined in the abutment 322 and the top end 312 of the housing 302.

A pair of diametrically opposed longitudinal slots 342*a*, 342*b* is provided in the curved walls 324, 326. A pair of inclined recesses 344*a*, 344*b* extending perpendicular to the longitudinal slots 342*a*, 342*b* is also provided, proximate to the abutment 322 of the housing 302. As it will become apparent below, the slots 342*a* and 342*b* collaborate to guide the button 306 during its installation onto the upper end 312 of the housing 302, and to fixedly secure the button 306 to the housing 302 for the operation of the dispenser 300.

As shown in FIGS. 32 and 33, the internal surface 346 of the housing 302 comprises four pairs of flanges 348, 350, 352, 354 extending inwardly and longitudinally from the lower end 310 to the upper end 312 of the housing 302. Each pair of flanges 348, 350, 352, 354 defines a guiding groove 358, 360, 362 and 364, also extending longitudinally from the lower end 310 to the upper end 312 of the housing 302. In the illustrated embodiment, grooves 358 and 362 are in vertical alignment with guiding slots 342*a*, 342*b*, respectively, while grooves 360 and 364 are vertically aligned with the center of the main and back openings 336, 338, respectively. As it will become apparent below, the guiding grooves 358, 360, 362, 364 collaborate with portions of the cartridges (e.g. cartridges 304, 438) to facilitate their insertion and placement in the housing 302. As such, the upper ends 366, 368, 370 of the flanges 348, 352, 354 are tapered to define a funnel shape to facilitate insertion of the cartridge 304 into grooves 358, 362, 364. Furthermore, as shown in FIG. 33, the extremities of the flanges 348, 350, 352, 354 are gently angled to match the contour of certain cartridges. Although in the illustrated embodiment the guiding grooves 358, 360, 362, 364 are defined by pairs of flanges 348, 350, 352, 354, they could be made differently. For instance, grooves 358, 360, 362, 364 could be defined by recesses in the elliptical wall 346 of the housing 302. While in this illustrated embodiment four grooves are shown, the housing could include a different number of grooves, or no grooves.

In a preferred embodiment, the external surface 372 of the housing 302 comprises the name of the portable dispenser or a logo for reminding the patient what type of portable dispenser he is manipulating. The color of the housing can also be varied to help the patient or user in the identification of the medication.

Mounted inside the housing 302, on the inner surface 320 of the bottom wall 316 is the spring assembly 308. The spring assembly 308 comprises a hollow cylinder 376, centered in the hollow cylindrical body of the housing 302, in which are axially disposed a spring button 378 and a compressed spring 380 for exerting an upward force or bias. The spring button 378 comprises a lower surface 382 onto which the upper coil 381 of the compressed spring 380 exerts an upward force, thus pushing the spring button 378 upward. The lower coil 383 of the compressed spring 380 is in contact with the inner surface 320 of the bottom wall 316 and is vertically aligned with the medication stacked in the cartridges 304 or 438 (see FIG. 35 or 41). The upper surface 384 of the spring button 378 is in contact with the lowest pill or tablet of the stack, and is therefore urged upwardly thanks to the lower spring 380 exerting an upward force. Therefore, as the portable dispenser 300 is dispensing pills, the spring button 378 will be displaced axially in the upward direction, thus positioning the subsequent pills to be expelled for being dispensed to the patient.

To stack the medication in the housing 302 of the dispenser 300, the cartridge 304 is provided. Referring to the cross-sectional view of FIG. 35, the cartridge 304 for pills or tablets 388 is configured to be inserted in the housing 302 of the portable dispenser 300.

The cartridge 304 comprises a lower end 390 and an upper end 392 (i.e. the dispensing end). In the embodiment illustrated in FIG. 36, the cartridge 304 comprises a cylindrical body 394 for housing a stack of pills or tablets having a circular shape, the cylindrical body 394 having an inner face 396 defining an internal diameter D, and an outer face 398. The internal diameter D of the cylindrical body 394 is adapted to the size of the circular pills or tablets to be received in the cartridge 304, such that they can be stacked and yet travel freely from the lower end 390 toward the upper end 392 of the cartridge 304.

Figure 38:
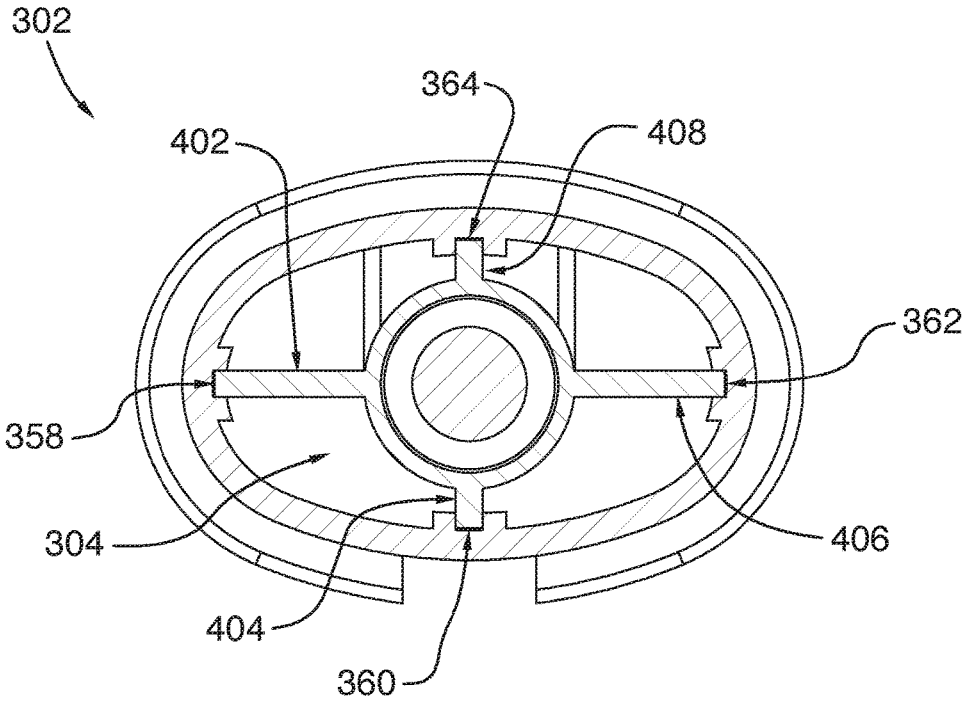
FIG. 38 is a bottom cross-sectional view of the cartridge inserted in the housing.
Figure 39:
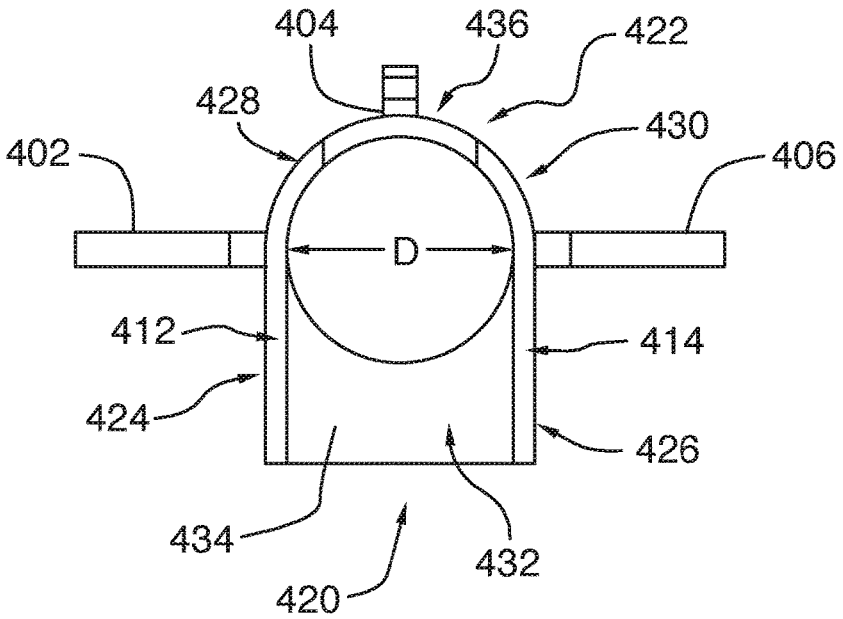
FIG. 39 is a top view of the cartridge of FIG. 36.
Figure 40:
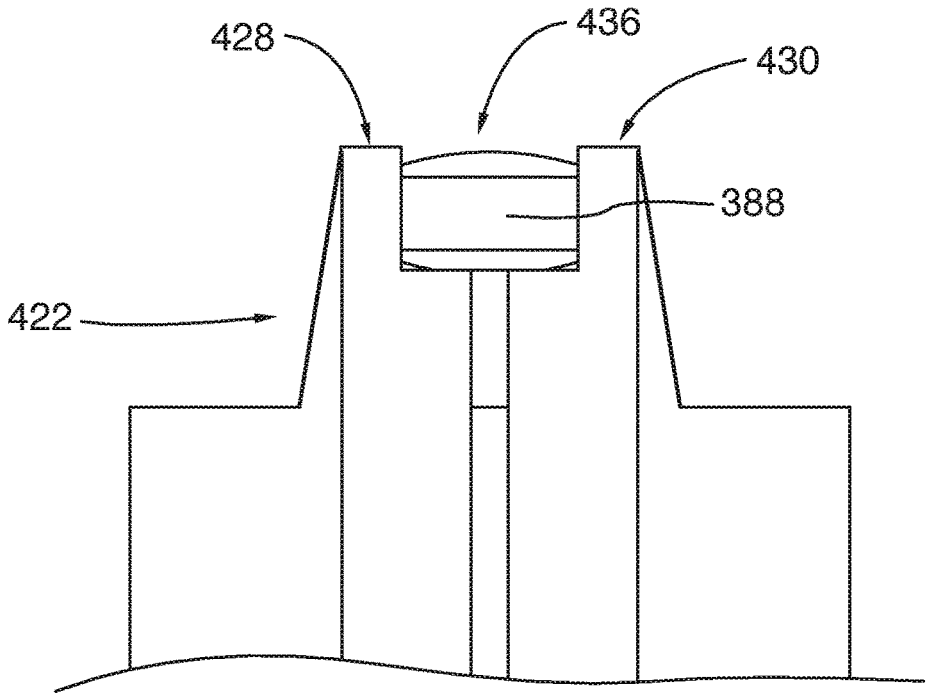
FIG. 40 is an enlarged back view of the upper end of the cartridge of FIG. 36.
Figure 41:
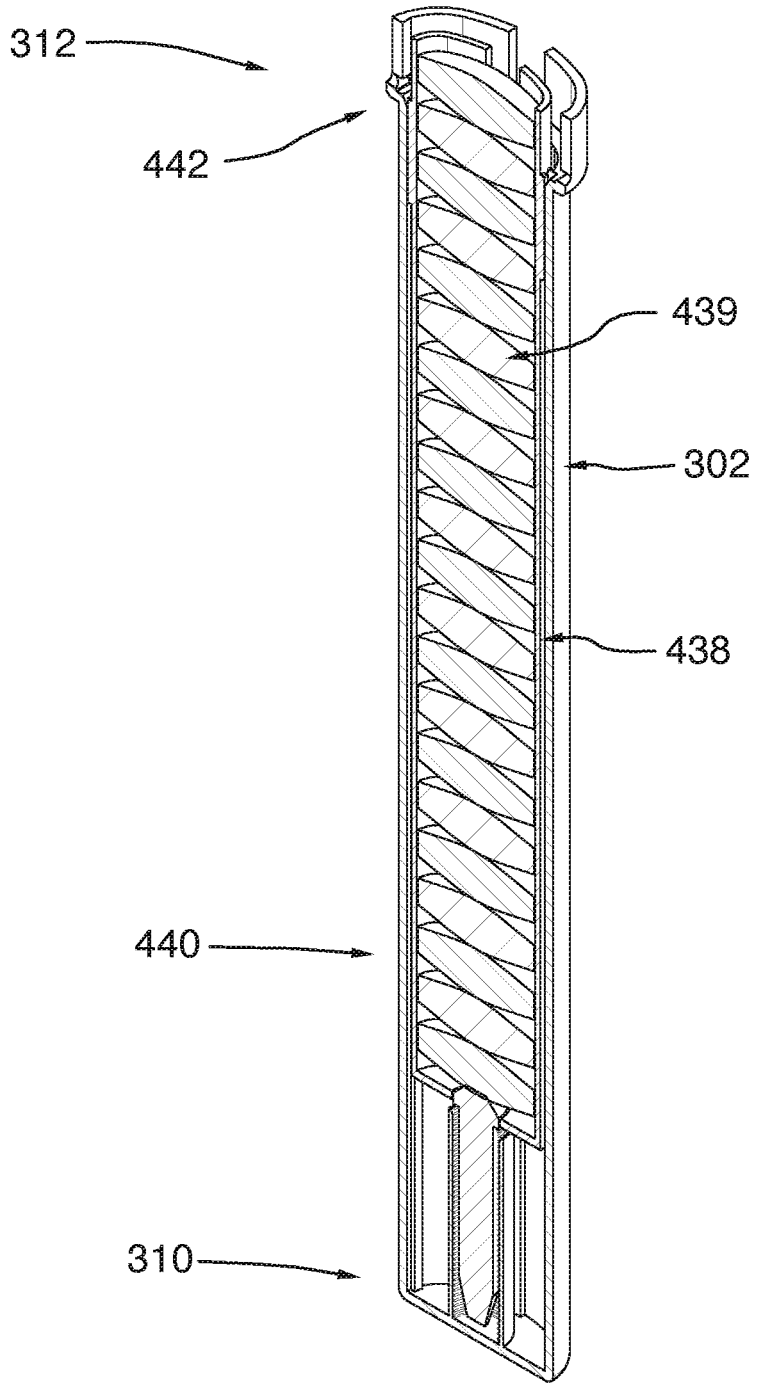
FIG. 41 is a perspective cross-sectional view of the housing of FIG. 31, showing a second type of cartridge inserted therein.
Figure 42:
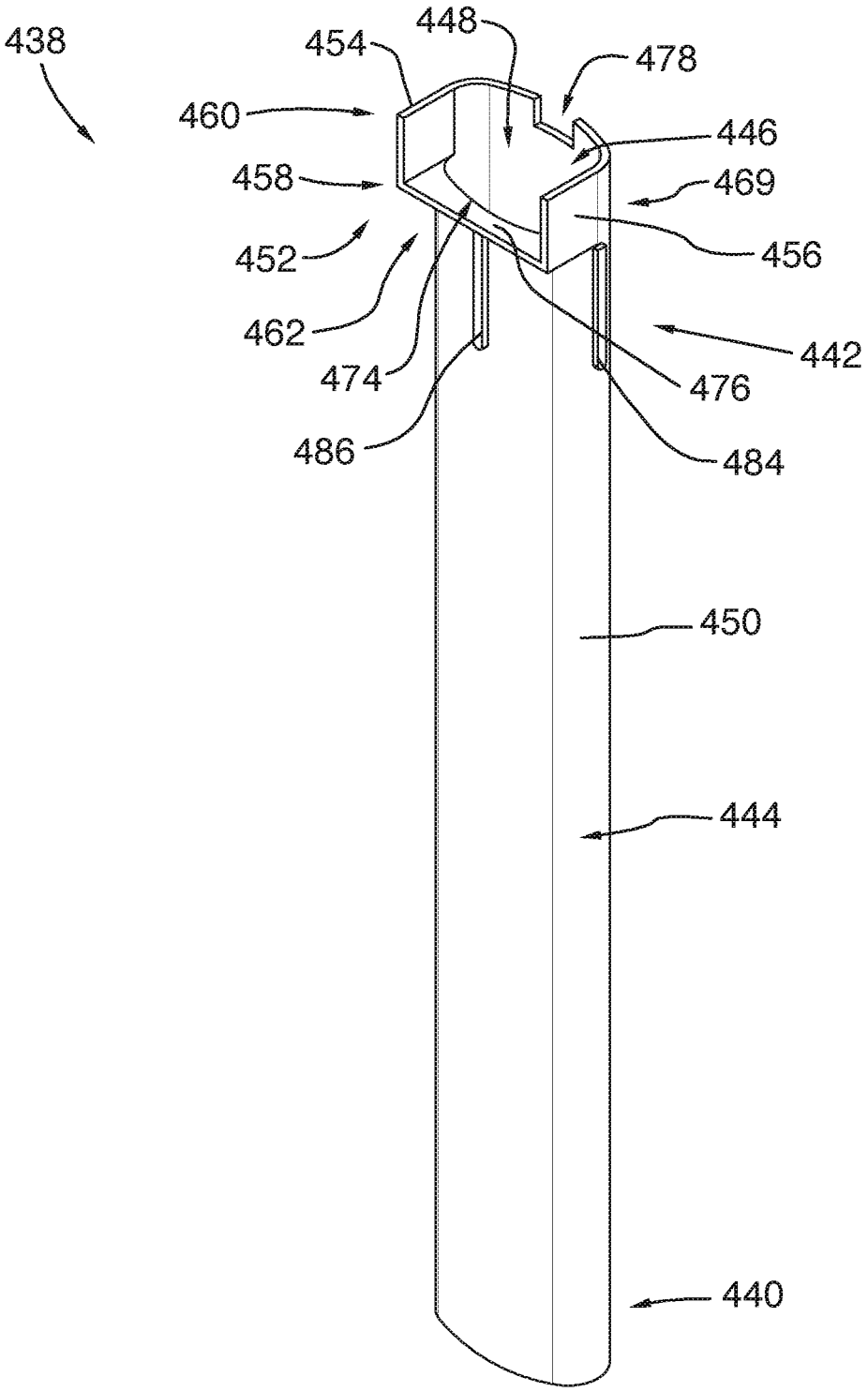
FIG. 42 is a perspective view of the second type of cartridge shown in FIG. 41.
Figure 43:
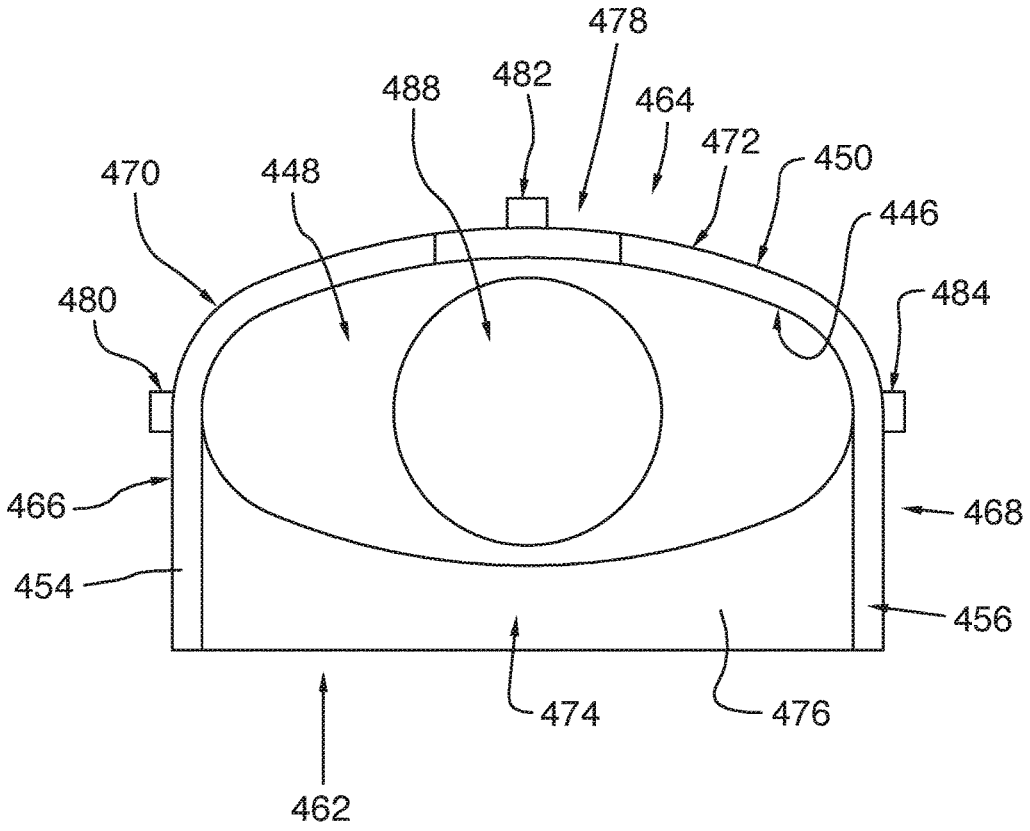
FIG. 43 is a top view of the cartridge of FIG. 42.
Figure 44:
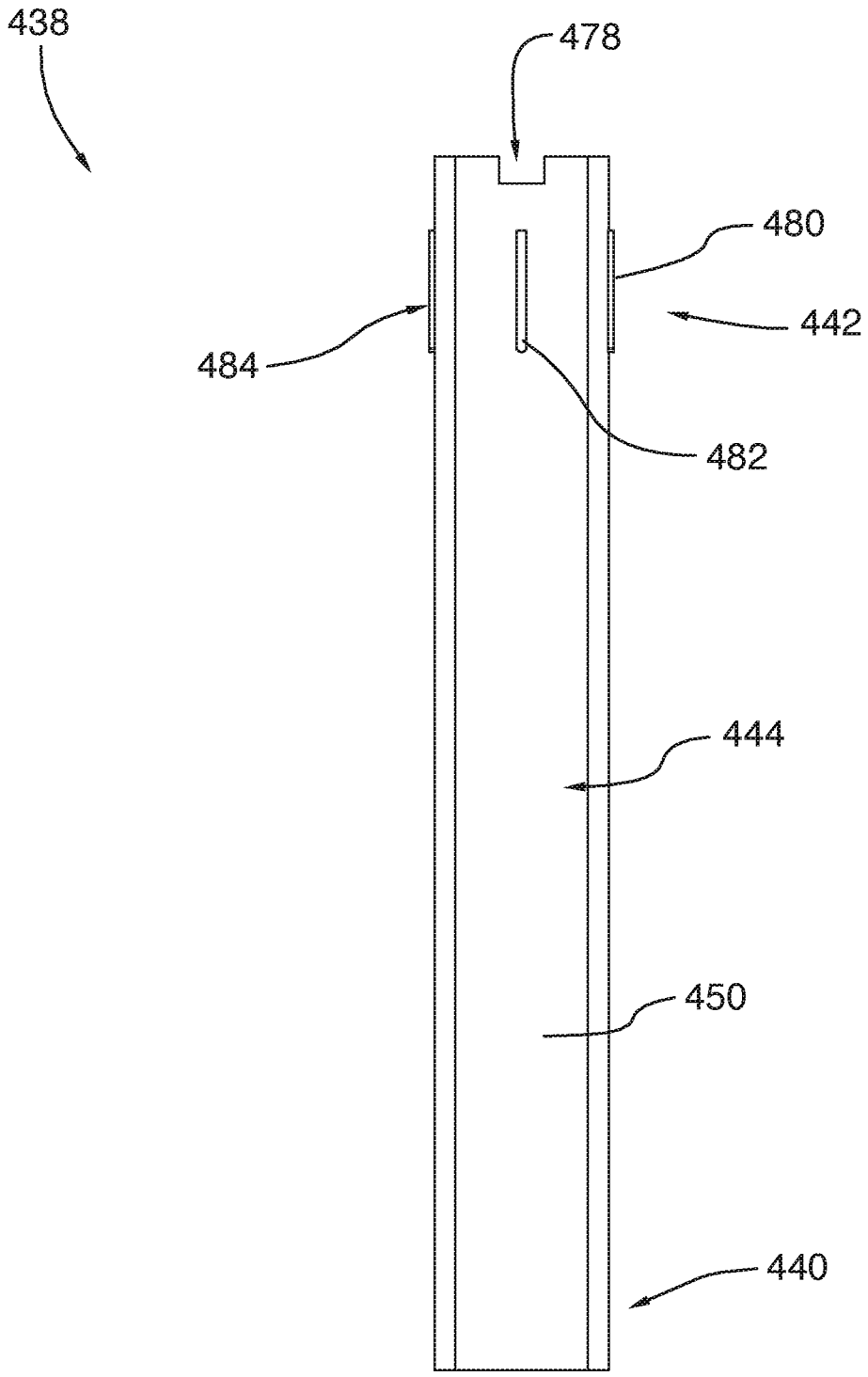
FIG. 44 is a back view of the cartridge of FIG. 42.

The cartridge 304 is designed to fit snuggly in the housing 302. As it will be apparent, the circular cross-section of the cylindrical body 394 is smaller than the interior cavity 400 of the housing 302. Therefore, to provide adequate support for the cartridge 304 in the housing 302, a plurality of elongated flanges 402, 404, 406 and 408 extend radially on the outer face 398 of the cylindrical body 394, from the lower end 390 to the upper end 392, best shown in FIGS. 36, 37. The flanges 402, 404, 406 and 408 are sized and shaped to be received in corresponding guiding grooves 358, 360, 362, 364 of the housing 302 in order to maintain cartridge 304 in the main elongated body without any relative rotation, as shown in FIG. 38. In the illustrated embodiment, the flanges 402. 404, 406, 408 therefore define a cruciform shape, which correspond to a cruciform shape defined by the grooves 358, 360, 362, 364.

At the upper end 392 of the cylindrical body 394 is mounted a dispensing portion 410 of the cartridge 304. The dispensing portion 410 comprises a pair of spaced-apart, generally parallel side walls 412, 414 extending vertically from the cylindrical body 394 of the cartridge. Each side wall 412, 414 comprises a lower end 416, an upper end 418, a front end 420 and a back end 422. Moving from the front end 420 to the back end 422, each side wall 412, 414 comprises a generally straight portion 424, 426 for directing the tablet to be dispensed, and a gently curved portion 428, 430. As such, the straight portions 424, 426 of the dispensing portion 410 defines an opening 432 therebetween, sized and shaped to be received in the main opening 336 of the housing 302, and to abut abutment 322 when the cartridge 304 is properly positioned in the housing 302. Extending horizontally between the straight portions 424, 426 of the side walls 412, 414, at an intermediate location $I_1$ between the lower end 416 and the upper end 418 is a tablet support wall 434. As it will become apparent below, the distance between the intermediate location $I_1$ and the upper end 418 of the side walls 412, 414 provides a passage adapted to the thickness of the tablet or pill contained in the cartridge 304.

Extending rearwardly from the straight portions 424, 426 of the side walls 412, 414 are the curved portions 428, 430. The curved portions 428, 430 of the side walls 412, 414 are configured to maintain the pills or tablets in a proper position to be dispensed, and to provide an opening 436 therebetween. When the cartridge 304 is properly positioned in the housing 302, the opening 436 of the dispensing portion 410 is in registry with the opening 338 of the housing 302 to provide a passage for a rotating ejector 514 to hit a pill or medication to be ejected, which will be described later.

In accordance with another embodiment, a cartridge 438 having a different cross-section is provided. With reference to FIGS. 41 to 45, the cartridge 438 has a generally elliptical cross-section (when viewed from the top) and comprises a lower end 440, an upper end 442 and a generally elliptical body 444 extending therebetween. The elliptical body 444 has an inner face 446 defining an internal cavity 448, and an outer face 450. The internal cavity 448 of the elliptical body 444 is adapted to the size of elliptical pills, tablets 439 or medication to be received in the cartridge 438, such that they can be stacked and yet travel freely from the lower end 440 toward the upper end 442 of the cartridge 438.

Figure 45:
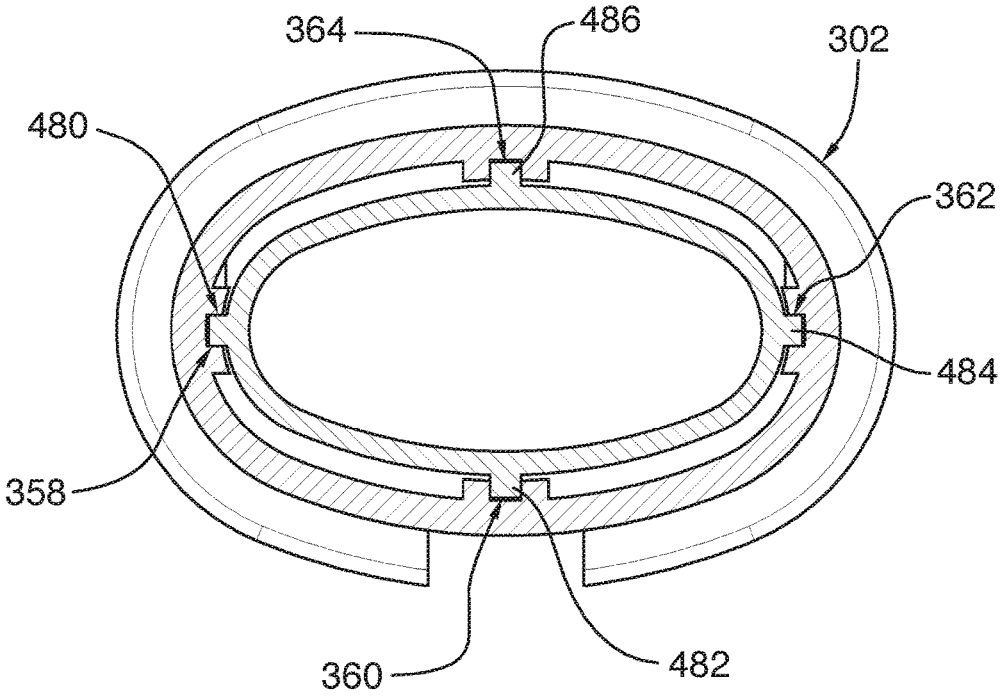
FIG. 45 is a bottom cross-sectional view of the second type of cartridge inserted in the housing.

The cartridge 438 is designed to fit snuggly in the housing 302. As it will be apparent, the cross-section of the elliptical body 444 is slightly smaller than the interior cavity 400 of the housing 302. Therefore, to provide adequate support for the cartridge 438 in the housing 302, a plurality of elongated flanges 480, 482, 484 and 486 (FIGS. 42, 43) extend radially on the outer face 450 of the elliptical body 444, from an intermediate position along the elliptical body 444 to the upper end 442. The flanges 480, 482, 484 and 486 are sized and shaped to be received in corresponding guiding grooves 358, 360, 362 and 364 of the housing 302, in order to maintain cartridge 438 in the body 302 without any relative rotation, as shown in FIG. 45. In the illustrated embodiment, the flanges 480, 482, 484 and 486 therefore define a cruciform shape, which correspond to the cruciform shape defined by the grooves 358, 360, 362 and 364.

At the upper end 442 of the elliptical body 444 is mounted a dispensing portion 452 of the cartridge 438. Like dispensing portion 410 of the cartridge 304, the dispensing portion 452 of the cartridge 438 comprises a pair of spaced-apart, generally parallel side walls 454, 456 extending vertically from the elliptical body 444 of the cartridge. Each side wall 454, 456 comprises a lower end 458, an upper end 460, a front end 462 and a back end 464. Moving from the front end 462 to the back end 464, each side wall 454, 456 comprises generally straight portions 466, 468 for directing the tablet to be dispensed, and curved portions 470, 472. As such, the straight portions 466, 468 of the dispensing portion 452 define an opening 474 therebetween, and are sized and shaped to be received in the opening of the housing 302 and to abut abutment 322 when the cartridge 438 is properly positioned in the housing. Extending horizontally between the straight portions 466, 468 of the side walls 454, 456, at the lower end 458, is a tablet support wall 476. As it will become apparent below, the distance between the lower end 458 and the upper end 460 of the side walls 454, 456 provides a passage adapted to the thickness of the medication, tablet or pill contained in the cartridge 438. Extending rearwardly from the straight portions of the side walls 454, 456 are the curved portions 470, 472. The curved portions 470, 472 of the side walls 454, 456 are configured to maintain the pills or tablets in proper position to be dispensed and to provide an opening 478 there between. When the cartridge 438 is properly positioned in the housing 302, the opening 478 of the dispensing portion 452 is in registry with the opening 338 of the housing 302 to provide a passage for the rotating ejector 514 to hit a pill to be ejected, which will be described later.

As the cartridge 438 is inserted in the main housing 302, the flanges 480, 482, 484 and 486 are inserted in the corresponding grooves 358, 360, 362 and 364, and the lower most tablet of the cartridge abuts the upper surface 384 of the spring button 378 thanks to a hole 488 located at the lower end 440 of the cartridge 438. Therefore, the spring button 378 will urge the stack of tablets towards the dispensing portion 452 of the cartridge 438 (i.e. upwardly).

As it will be appreciated by the person skilled in the art, the shape of the cartridge can be modified according to the type of medication to be dispensed. By using different combinations of bodies (e.g. cylindrical body 394 or elliptical body 444) and flanges configurations (e.g. flanges 402 or 480), cartridges designed to dispense medications of various size and shape can be used with a single type of housing 302. Therefore, it is an aspect of the present invention to permit changing cartridges while still keeping the same main housing 302.

Figure 46:
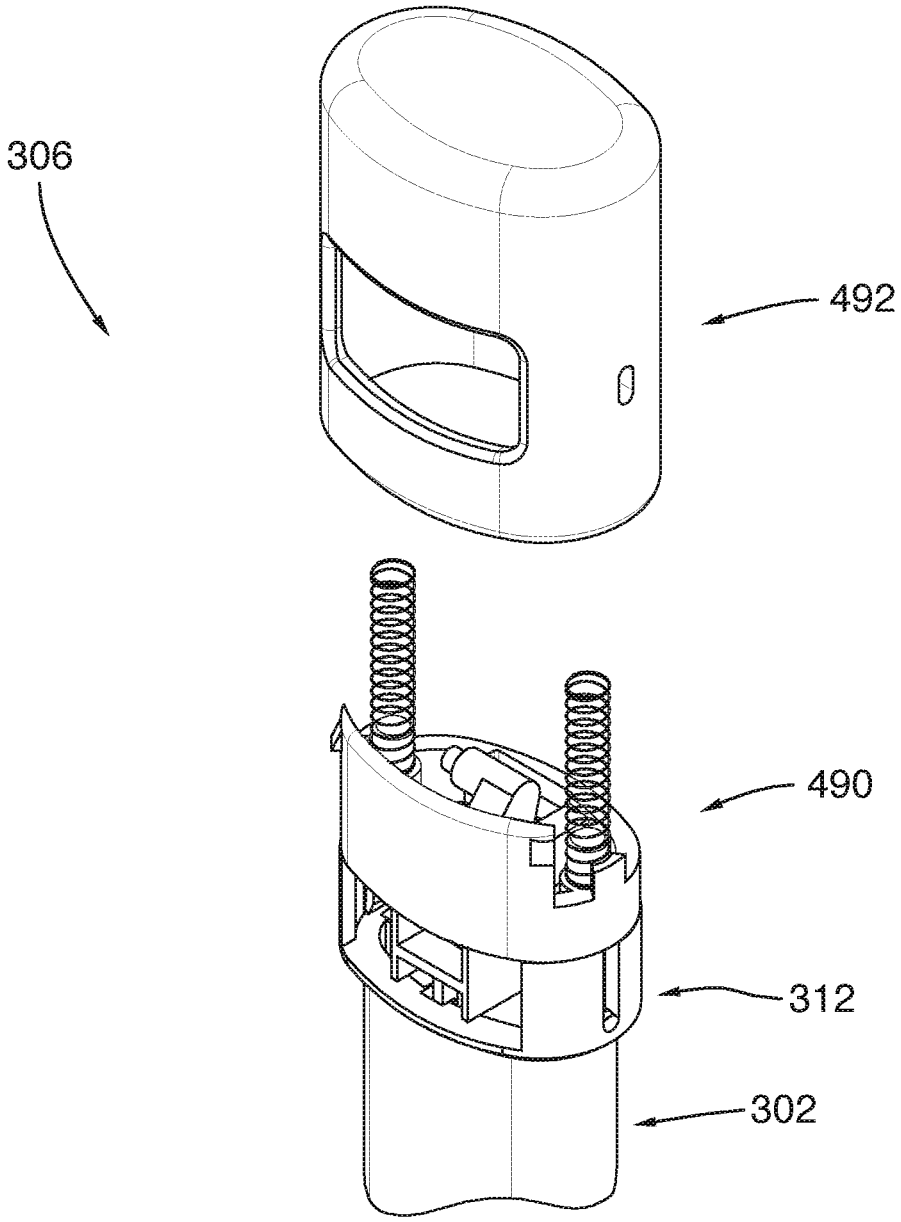
FIG. 46 is an enlarged perspective exploded view of a button of the portable dispenser shown in FIG. 30.

Turning now to FIG. 46, the dispenser 300 further comprises the button 306 in the shape of a cap for dispensing pills or tablets at each click made by the user. In the illustrated embodiment, the button 306 comprises a static portion 490 maintained on the upper end 312 of the housing 302 and a moving portion 492 movable between an actuated state and a released state, for dispensing the pills or tablets.

Figure 47:
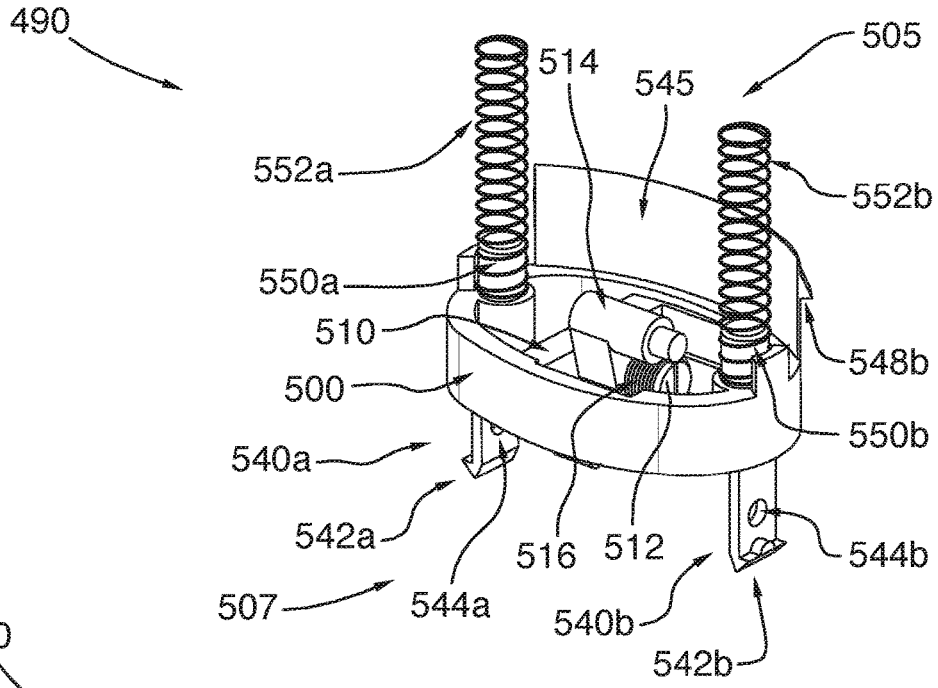
FIG. 47 is a perspective view of a static portion of the button shown in FIG. 46.
Figure 48:
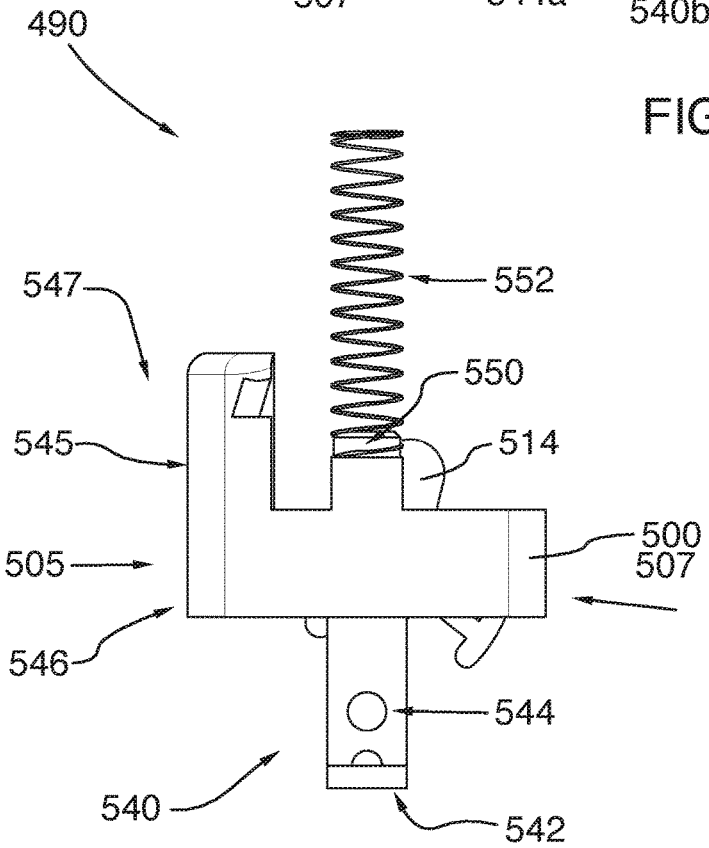
FIG. 48 is a right side view of the static portion of the button shown in FIG. 47.
Figure 49:
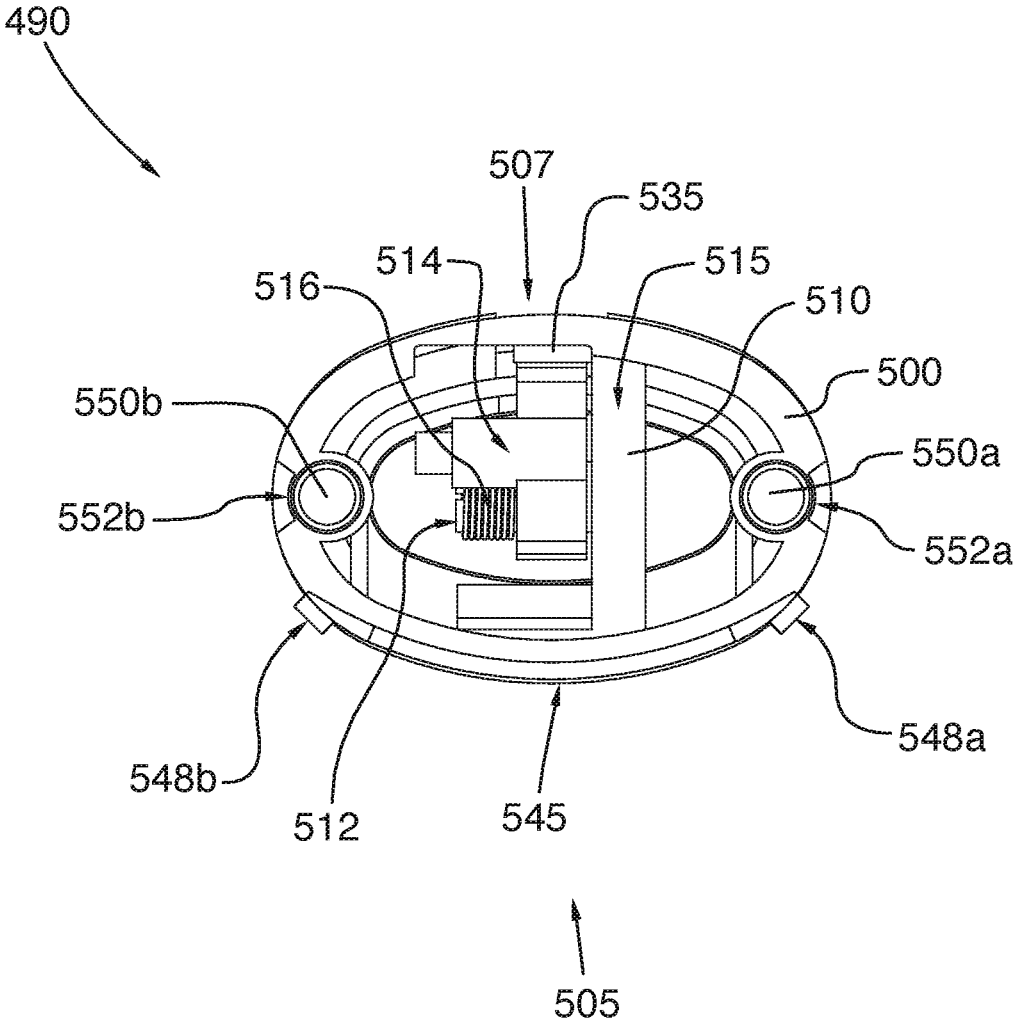
FIG. 49 is a top view of the static portion of the button shown in FIG. 47.

With reference to FIGS. 47 to 49, the static portion 490 of the button 306 comprises an elliptical frame member 500 having a circumference adapted to be mounted to the walls 454, 456 of the housing 302. To do so, two diametrically opposed longitudinal arms 540*a*, 540*b* extend downwardly from the elliptical frame member 500, each arm including at its extremity a hook 542*a*, 542*b* and a hole 544*a*, 544*b*, the holes 544*a*, 544*b* allowing to remove the button 306, as it will be explained further below. As the static portion 490 is inserted in the upper end 312 of the housing 302, the longitudinal arms 540*a*, 540*b* are deflected inwardly, towards the center of the housing 302. As the static portion 490 is further axially translated, the hooks 542*a*, 542*b* of the longitudinal arms 540*a*, 540*b* engage the corresponding inclined recesses 344*a*, 344*b* of the upper end 312 of the housing 302, thus allowing the arms 540*a*, 540*b* to return into their non-deflected state and tightly securing the static portion 490 of the button onto the upper end 312 of the housing 302, in a snap engagement. The engagement of the hooks 542*a*, 542*b* of the arms 540*a*, 540*b* into the corresponding recesses 344*a*, 344*b* of the housing 302 thus prevent the static portion 490 of the button 306 from any rotation or translation relative to the housing 302.

Extending upwardly from the elliptical frame member 500, in a region generally corresponding to the front side of the static portion 490 and vertically aligned with the opening 336 of the housing 302 when the button 306 is installed, is a curved wall 545. The curved wall has a first lower end 546, a second upper end 547, and inclined protrusions 548*a*, 548*b* in the form of hooks projecting outwardly at the upper end of the curved wall 545. As it will become apparent below, the protrusions 548*a*, 548*b* are configured to engage the movable portion 492 of the button 306 to restrain the axial movement thereof. Also extending upwardly from the elliptical frame member 500 are diametrically opposed circular protrusions 550*a*, 550*b*, onto which springs 552*a*, 552*b* are to be installed in order to interact with the axial translation of the movable portion 492 of the button 306.

Extending across the elliptical frame member 500, between the front 505 and the back 507, is a cross-member 510 for supporting the rotating ejector 514. The cross member 510 comprises a first portion 515 connecting the elliptical frame member 500 and a generally cylindrical pivot shaft 512, extending perpendicular to the first portion 515 of the cross-member 510 and providing a pivot for the rotating ejector 514, as it will become apparent below. In one embodiment, the elliptical frame member 500, the arms 540*a*, 540*b*, the curved wall 545, the protrusions 550*a*, 550*b* and the cross-member 510 define an integral structure.

The back 507 of the elliptical frame member 500 comprises a stopper 535 for abutting an upper end 532 of the rotating ejector 514 to limit the rotational movement of the ejector 514 when in the non-actuated mode.

Figure 50:
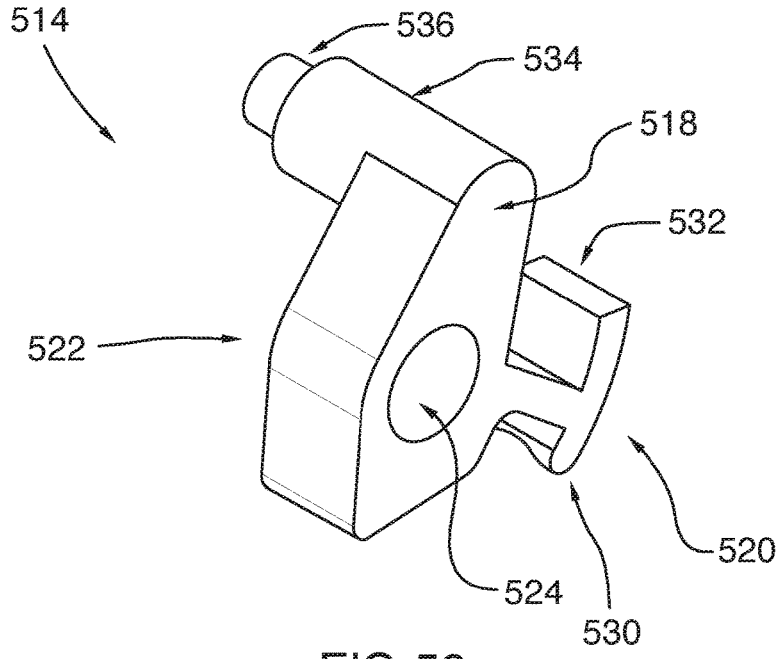
FIG. 50 is a perspective view of a rotating ejector of the static portion of the button shown in FIG. 47.
Figure 51:
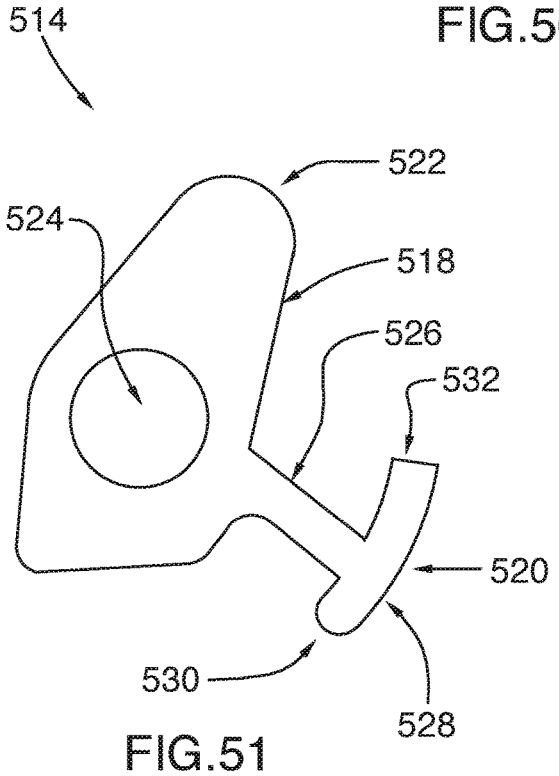
FIG. 51 is a right side view of the rotating ejector shown in FIG. 50.
Figure 52:
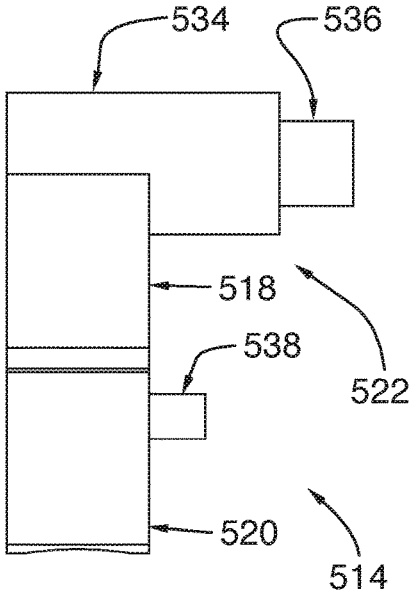
FIG. 52 is a back view of the rotating ejector shown in FIG. 50.

Turning now to FIGS. 50 to 52, the rotating ejector 514 comprises a main body 518, a lower portion 520 and an upper portion 522. The main body 518 also comprises a hole 524 defined in the upper portion 520 for mounting the ejector 514 to the pivot shaft 512.

The upper portion 522 of the rotating ejector 514 comprises a horizontally extending circular protrusion 534 from which extends a circular rod 536, which engages a curved groove 570 of an ejection cam 568 of the movable portion of the button 306. The ejector 514, when mounted on the pivot shaft 512, is coupled with a torsion spring 516 thanks to a circular protrusion 538 abutting one end of the torsion spring 516. The second end of the torsion spring 516 is inserted in the pivot shaft 512, in order to automatically set the ejector 514 to a non-actuated state when the button 306 is not actuated.

The lower portion 520 of the rotating ejector 514 has the general shape of an inverted hammer and comprises an arm 526 connected to the upper portion 522 by one end and a curved protrusion 528 at the other end. The curved protrusion 528 has a width slightly inferior to the width of the openings 436 or 478 of the cartridges 304 or 438, respectively, to allow the passage of the lower end 520 therethrough. The curved protrusion 528 comprises a lower end 530 to hit the upper most pill or tablet as the rotating ejector 514 is rotated, and an upper end 532 for abutting the stopper 535.

FIGS. 53 to 56 illustrate a preferred embodiment of the moving portion 492 of the button 306. The movable portion 492 of the button 306 is sized and shaped to receive therein the static portion 490 of the button 306 and to reciprocate freely over it. As such, the movable portion 492 of the button 306 has a shape generally corresponding to the external shape of the static portion 490 and is axially translated over the static portion 490 upon actuation of a user.

Figure 53:
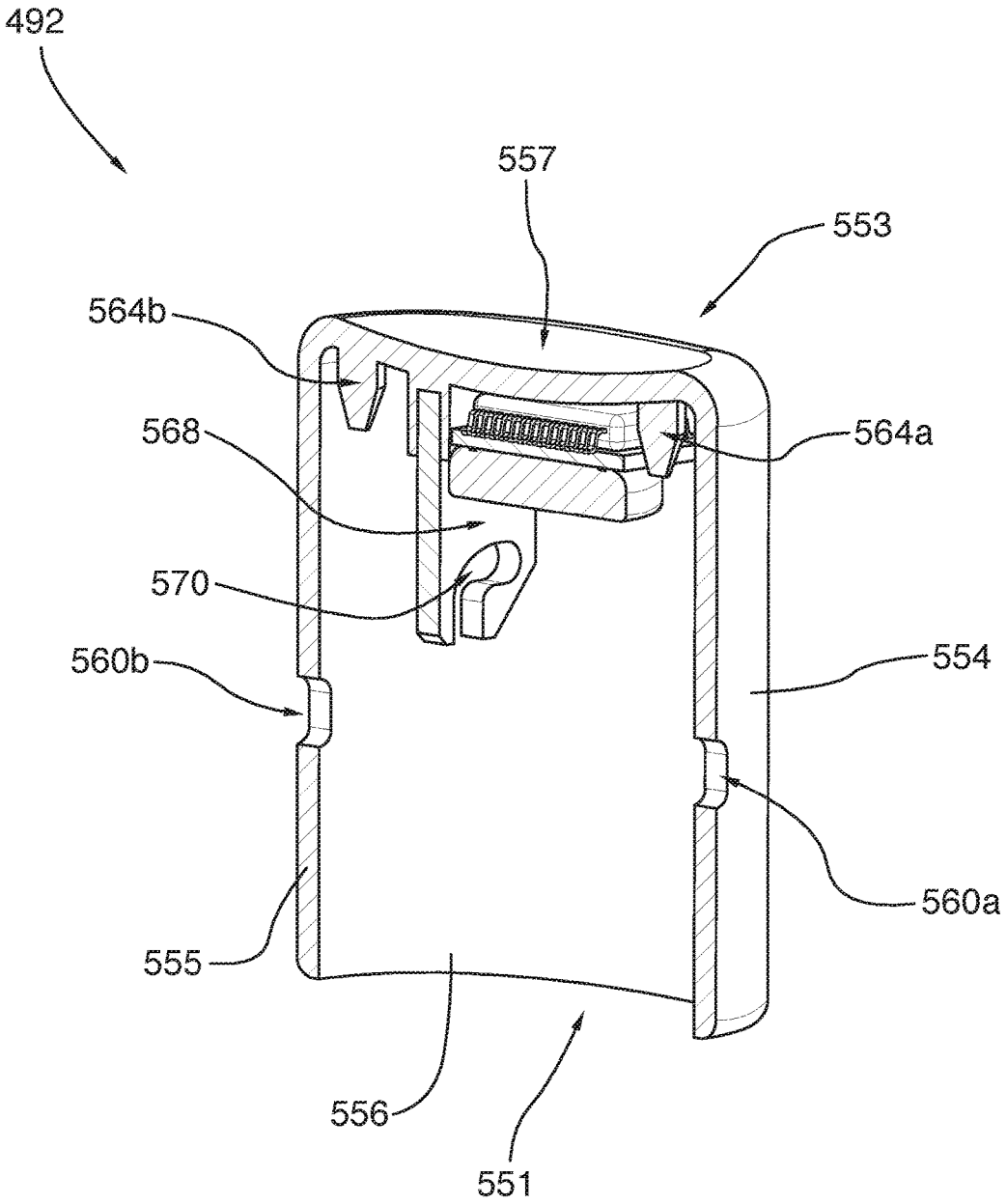
FIG. 53 is perspective cross-sectional view of a moving portion of the button as shown in FIG. 46.

With reference to FIG. 53 the movable portion 492 has an open lower end 551, an upper end 553 and a curved wall 555 extending between the lower end 551 and the upper end 553, the curved wall 555 having a generally elliptical cross-section. At the upper end 553 thereof, the movable portion 492 is closed by a generally elliptical top wall 557.

Together, the curved wall 555 and the top wall define an outer face 554 and an inner face 556 of the movable portion 492. The outer face 554 of top wall 557 is generally flat or slightly inwardly curved to best fit the shape of a finger or a thumb of a user as the dispensing device 300 is being actuated by pushing on the button 306.

Defined in the front portion of the wall 555 is a dispensing window 558, from which a pill or tablet can be expelled to be dispensed to a patient. The movable portion 492 also includes, at equal distance from the dispensing window 558, a pair of diametrically opposed elongated holes 560*a*, 560*b* for removing the button 306 as it will be explained in greater details.

The movable portion 492 of the button 306 comprises a pair of longitudinally extending slots 562*a*, 562*b*, proximate to the extremities of dispensing window 558. The slots 562*a*, 562*b* are configured to receive therein and engage the inclined protrusions 548*a*, 548*b* of the static portion 490. As the movable portion 492 is axially translated over the static portion 490, the inclined protrusions 548*a*, 548*b* are received in the slots 562*a*, 562*b* to act as stoppers when the movable portion is in an non actuated position, as it will be described later.

The movable portion 492 also includes a pair of diametrically opposed circular protrusions 564*a*, 564*b* extending downwardly from the top inner face 556 of wall 557. When the movable portion 492 of the button 306 is properly installed over the static portion 490, the circular protrusions 564*a*, 564*b* of the movable portion 492 are vertically aligned with the circular protrusions 550*a*, 550*b* of the static portion 490. The circular protrusions 564*a*, 564*b* engage the upper most coil of the springs 552*a*, 552*b* of the static portion 490 and collaborate with the circular protrusions 564*a*, 564*b* of the movable portion 492 for guiding their compression. More precisely, once the movable portion 492 is installed over the static portion 490, the upper part of the springs 552*a*, 552*b* is axially aligned with the circular protrusions 564*a*, 564*b* and the upper coils abuts the internal face 556 of the movable portion 492, therefore axially maintaining the springs 552*a*, 552*b* during compression and expansion as the dispensing device is actuated.

The movable portion 492 is also configured to interact with the rotating ejector 514 of the static portion 490 to expel pills or tablets contained in the cartridge (e.g. cartridges 304 or 438). More precisely, the inner face 556 of the elliptical top wall 557 includes a pair of flanges 566*a*, 566*b* located between the circular protrusion 564*a*, 564*b*, offset from the center of the top wall 557. Together, the flanges 566*a*, 566*b* define a recess for mounting an ejecting cam 568, which is designed to engage the rod 536 of the rotating ejector 514. To do so, the ejecting cam 568 is provided with a curved groove 570 which receives and guides the rod 536 and rotate the rotating ejector 514 upon actuation of the dispensing device, as it will further be explained below.

Figure 54:
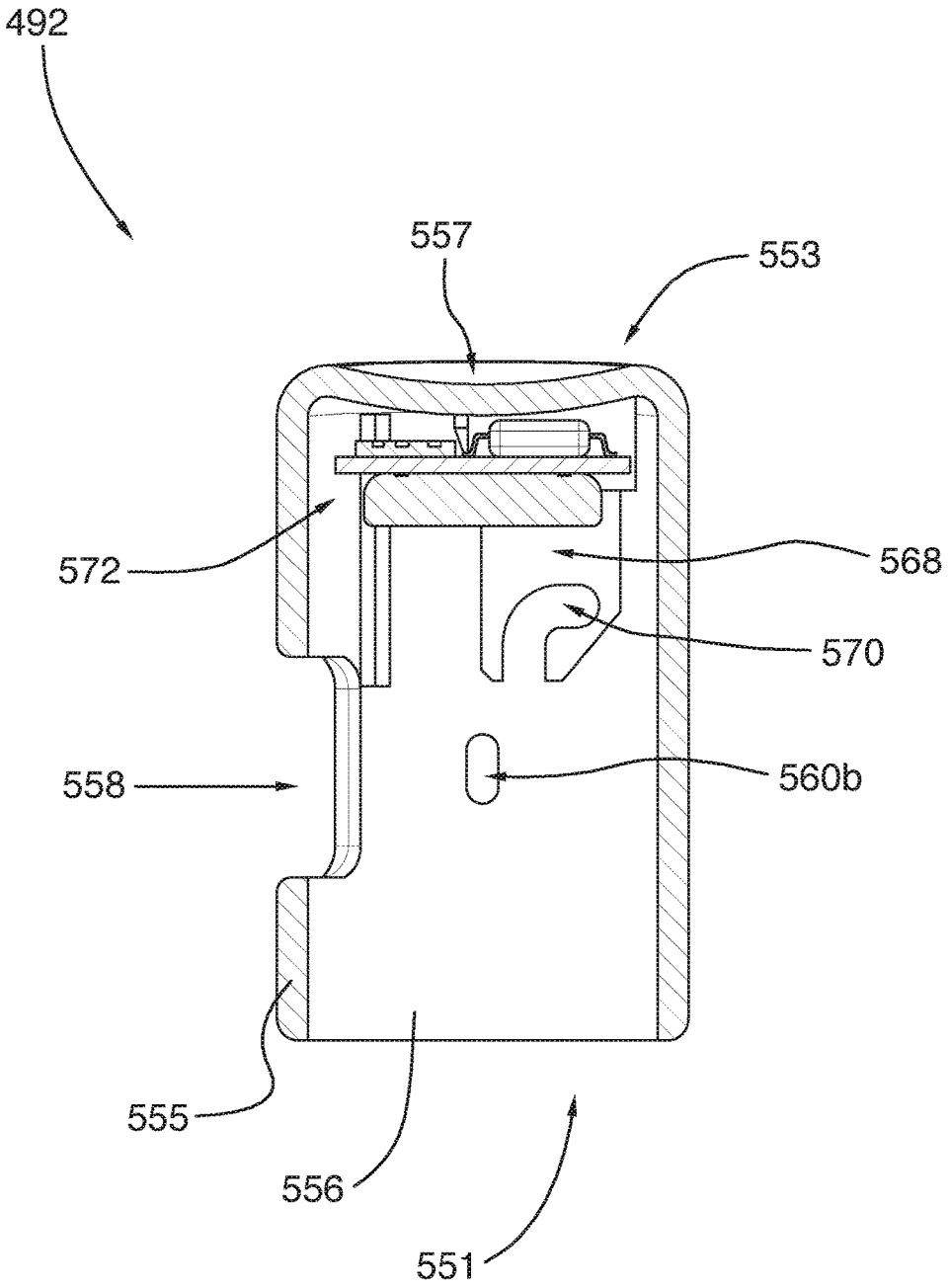
FIG. 54 is a right side cross-sectional view of the moving portion of the button shown in FIG. 53.
Figure 55:
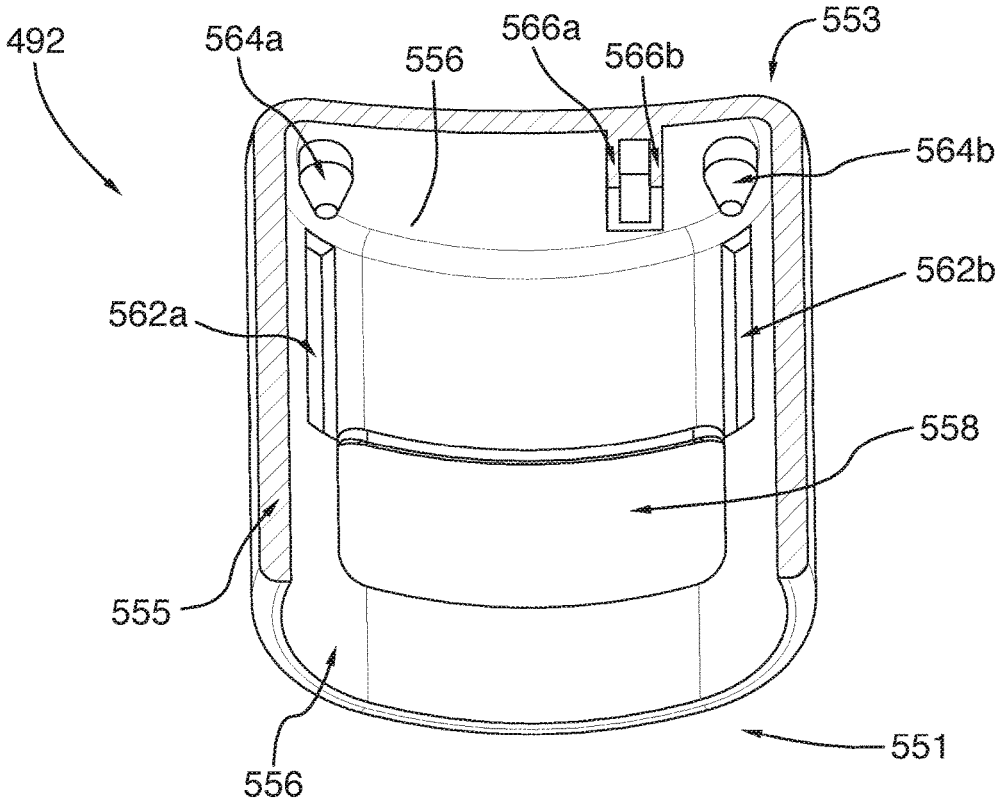
FIG. 55 is a bottom perspective cross-sectional back view of the moving portion of the button shown in FIG. 46.
Figure 56:
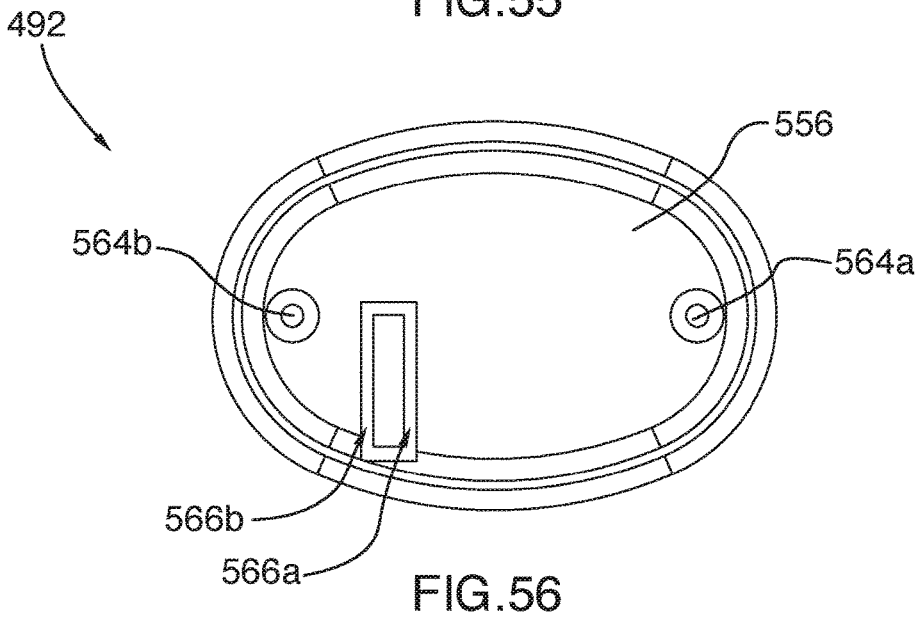
FIG. 56 is a bottom view of the moving portion of the button shown in FIG. 46.

The movable portion 492 of the button 306 is also configured to accommodate an electronic system 572 for assisting the patient or the caregiver in the administration of the medication. The electronic system 572 comprises processing means such as a chip, a timer, a memory, visual and/or audio indicators, an antenna, a battery, communication means, an alarm system, a circuit board and a locking system for preventing the user to dispense an excessive amount of pills. In a preferred embodiment as depicted in FIG. 54, the electronic system of the movable portion 492 is located adjacent to the inner face 556 of the elliptical top wall 557. However it should be contemplated that alternative layouts are possible. As it will be described below, the electronic system or controller 572 of the dispenser 300 can be in communication with the electronic system or controller 16 of the modular system 1, to help managing the administration of medication to the patient.

A method for assembling the portable dispenser 300 will now be described in accordance with a first embodiment of the portable dispenser 300. The portable dispenser 300 is assembled by first providing the main housing 302 equipped with the spring assembly 308. A cartridge, 304 or 438, already containing pills or tablets, is then inserted in the main housing 302 by aligning the corresponding flanges 402, 404, 406 and 408 of the cartridge 304 (or the flanges 480, 482, 484, 486 of cartridge 438) with the corresponding grooves 358, 360, 362, 364 of the housing 302. Subsequently, the static portion 490 of the button is placed onto the housing 302 thanks to the hooks 542*a*, 542*b* of the diametrically opposed longitudinal arms 540*a*, 540*b* being inserted in the corresponding inclined recesses 344*a*, 344*b* of the housing 302 in a snap engagement. Subsequently, the moving portion 492 of the button 306 is placed axially over the static portion 490 by aligning the circular protrusions 564*a*, 564*b* of the moving portion with the springs 552*a*, 552*b* of the static portion and by inserting the inclined protrusions 548*a*, 548*b* of the longitudinal extending wall 545 of the static portion in the corresponding recesses 562*a*, 562*b* of the moving portion.

Alternatively, the moving portion 492 could be first inserted axially over the static portion 490 by aligning the circular protrusions 564*a*, 564*b* of the moving portion 492 with the springs 552*a*, 552*b* of the static portion 490 and by inserting the inclined protrusions 548*a*, 548*b* of the longitudinal extending wall 545 of the static portion in the corresponding recesses 562*a*, 562*b* of the moving portion, and then being assembled with housing 302 comprising a cartridge, 304 or 438. Therefore, once the static portion 490 and the moving portion 492 of the button 306 are assembled, the button 306 is assembled onto the housing 302, thanks to the hooks 542*a*, 542*b* of the diametrically opposed longitudinal arms 540*a*, 540*b* being inserted in the corresponding inclined recesses 344*a*, 344*b* of the upper end 312 of the main elongated body 302, in a snap engagement.

Figure 57:
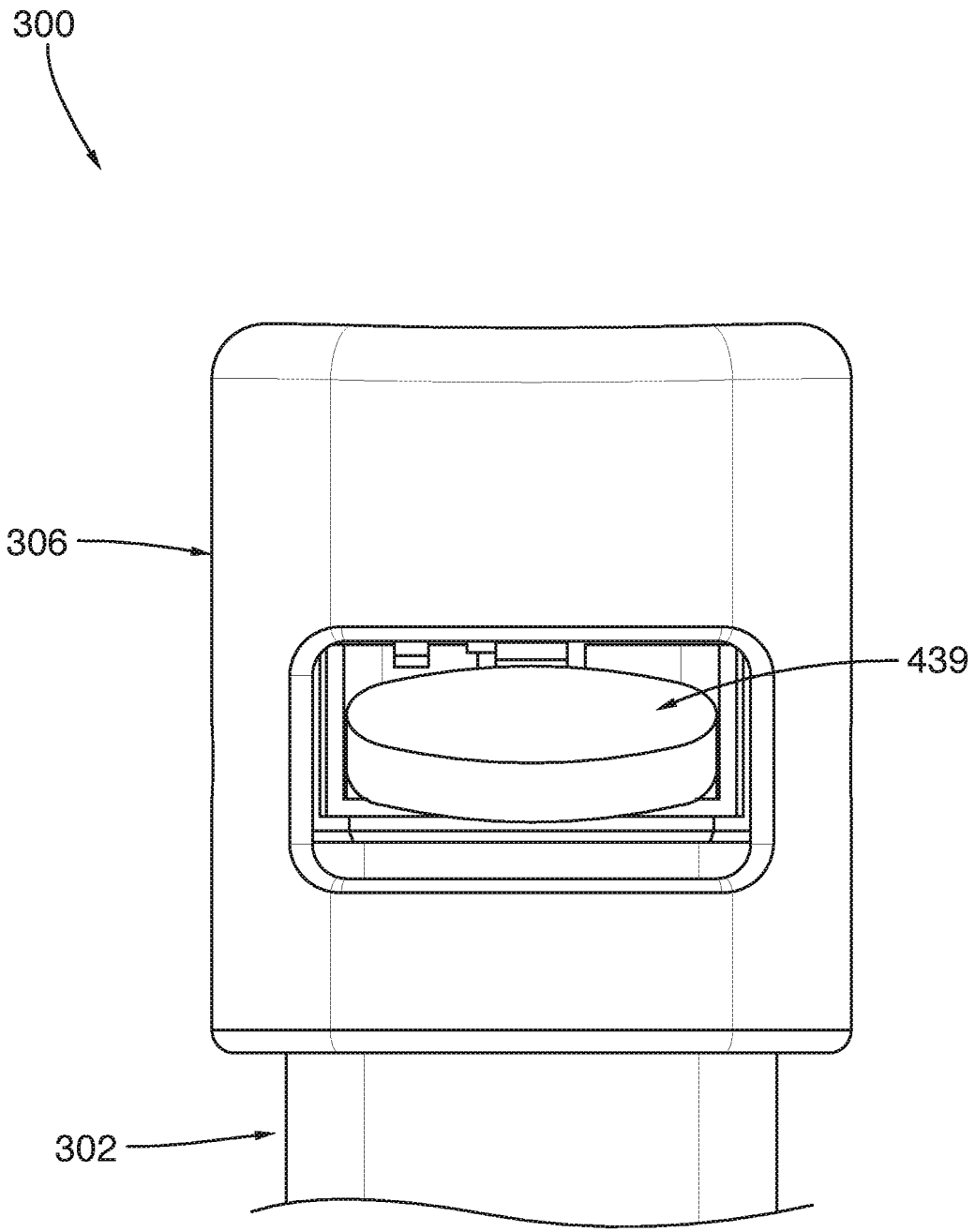
FIG. 57 is a front view of the button of FIG. 46 assembled showing the dispensing of a pill.

Once assembled, the portable dispenser 300 can be actuated by a user by pressing downwardly on the upper end of the external surface 554 of the moving portion 492. As the user actuates the portable dispenser 300, the moving portion 492 is urged downwardly and is guided thanks to the inclined protrusions 548*a*, 548*b* of the static portion being inserted in the corresponding recesses 562*a*, 562*b* of the moving portion. As the moving portion 492 moves downwardly, the diametrically opposed springs 552*a*, 552*b* of the static portion 490 are compressed between the upper end of the internal surface 556 of the moving portion 492 and the upper portion of the static portion 490. As the moving portion 492 is further moved downwardly, the curved groove 570 of the ejecting cam 568 engages with the corresponding rod 536 of the rotating ejector 514, therefore rotating the ejector 514 in a first direction as the rod 536 follows the curved groove 570. As the ejector 514 rotates, the moving portion 492 of the button 306 continues its downward movement and the lower portion 520 of ejector 514 pushes the upper most medication, pill or tablet of the cartridge 304 or 438. The lower most position of the moving portion 492 is reached once the springs 552*a*, 552*b* of the static portion are fully compressed, the inclined protrusions 548*a*, 548*b* of the extending wall 546 are abutting the upper part of the longitudinally extending recesses 562*a*, 562*b* of the moving portion, and the dispensing window 558 is aligned with the main opening 336 of the upper end 312 of the main elongated housing 302. Therefore, a medication, pill or tablet exits the openings 432 or 474 of cartridges 304 or 438 respectively and exits the button 306 through the window 558 as seen in FIG. 57.

Once a pill has been expelled from the portable dispenser 300, the user releases the pressure exerted on the moving portion 492 of the button 306. Therefore, the moving portion 492 is forced upwardly thanks to the springs 552*a*, 552*b* of the static portion 490 exerting an upward force on the moving portion 492. As the moving portion 492 travels upwardly, the curved groove 570 of the cam ejector 568 rotates the rotating ejector 514 in a rearward direction, and once the rod 536 exits the curved groove 570, the torsion spring 516 rotates the ejector 514 until it abuts the stopper 535 of the elliptical frame member 500, thus entering a non-actuated state. The moving portion 492 continues moving upwardly until the inclined protrusions 548*a*, 548*b* of the static portion 490 abut the lower end of the longitudinally extending recesses 562*a*, 562*b* of the moving portion 492, thus preventing further upward movement of the moving portion 492 and reaching the upper most position of the moving portion 492.

Once a pill has been dispensed, the next pill of the cartridge is urged upwardly towards the upper end 312 of the housing 302 thanks to the spring button 378 and the compressed spring 380 exerting an upward force. At each actuation of the button 306 a single pill or medication dose is delivered.

Figure 58:
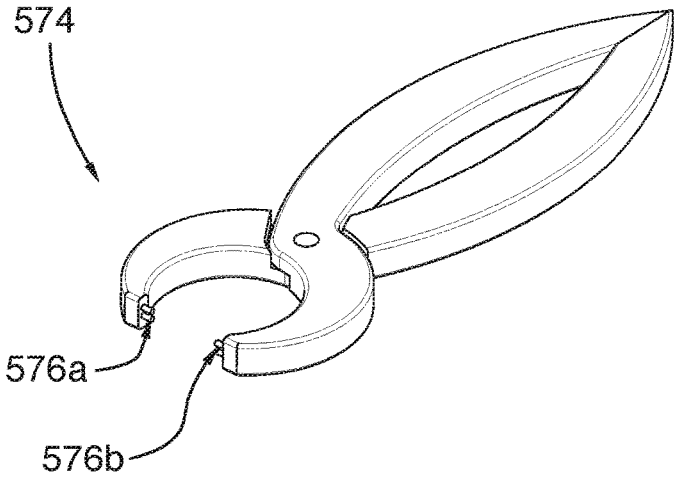
FIG. 58 is a perspective view of a clamp according to one embodiment.

Once the cartridges 304 or 438 are empty, the spring button 378 and the compressed spring 380 are in their upper most position. The empty cartridge 304 or 438 is removed from the upper end 312 of the main elongated housing 302. In order to remove the empty cartridge 304 or 438, the moving portion 492 of the button 306 has to be in the lower most position, thus aligning the elongated holes 560*a*, 560*b* with the holes 544*a*, 544*b* of the static portion 490. The removal of the button 306 is carried out by pushing on the arms 542*a*, 542*b* of the static portion 490 through the elongated holes 560*a*, 560*b* comprised on the external surface of the moving portion 492 using a clamp 574 (FIG. 58) or a similar tool.

In one embodiment, the clamp 574 includes cylindrical protrusions 576*a*, 576*b* which are inserted in the diametrically opposed elongated holes 560*a*, 560*b* of the moving portion 492. The lower cylindrical protrusions of protrusions 576*a*, 576*b* are inserted in hole 544 of the arms 540 to ensure good positioning of the clamp, the upper cylindrical protrusions of protrusions 576*a*, 576*b* push on the arms 540 as the clamp 574 is squeezed. By pushing on the arms 540, a force directed towards the center of the elliptical shape of the button 306 is exerted, thus bending arms 540 for exiting the inclined recesses 344 of the upper end 312 of the main elongated body 302, in which arms 540 were tightly installed. Therefore, as the arms 340 are extracted from the recesses 344, the static portion 490 and the moving portion 492 can be removed together form the housing 302, thus giving access to the upper end 312 of the main elongated body to remove the cartridge 304 or 438.

Once the cartridge 304 or 438 has been removed, a full cartridge 304 or 438 is placed in housing 302. In order to be inserted, the flanges 402, 404, 406 and 408 of the cartridge 304 (or the flanges 480, 482, 484 and 486 of cartridge 438 of the cartridge 438) are aligned with the corresponding guiding grooves 358, 360, 362 and 364. Once the new cartridge 304 or 438 is inserted, the button 306 can be installed on the housing 302 as previously described for allowing the user to dispense pills.

Figure 59:
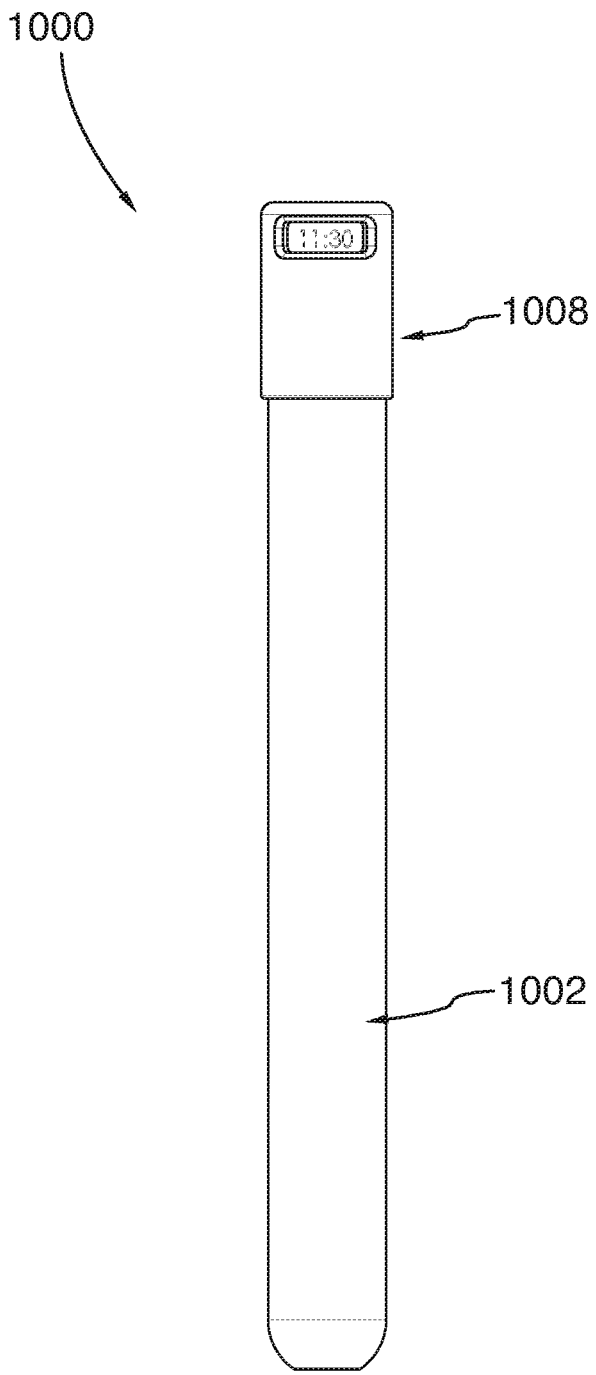
FIG. 59 is a front view of a second type of portable dispenser shown in FIG. 2.
Figure 60:
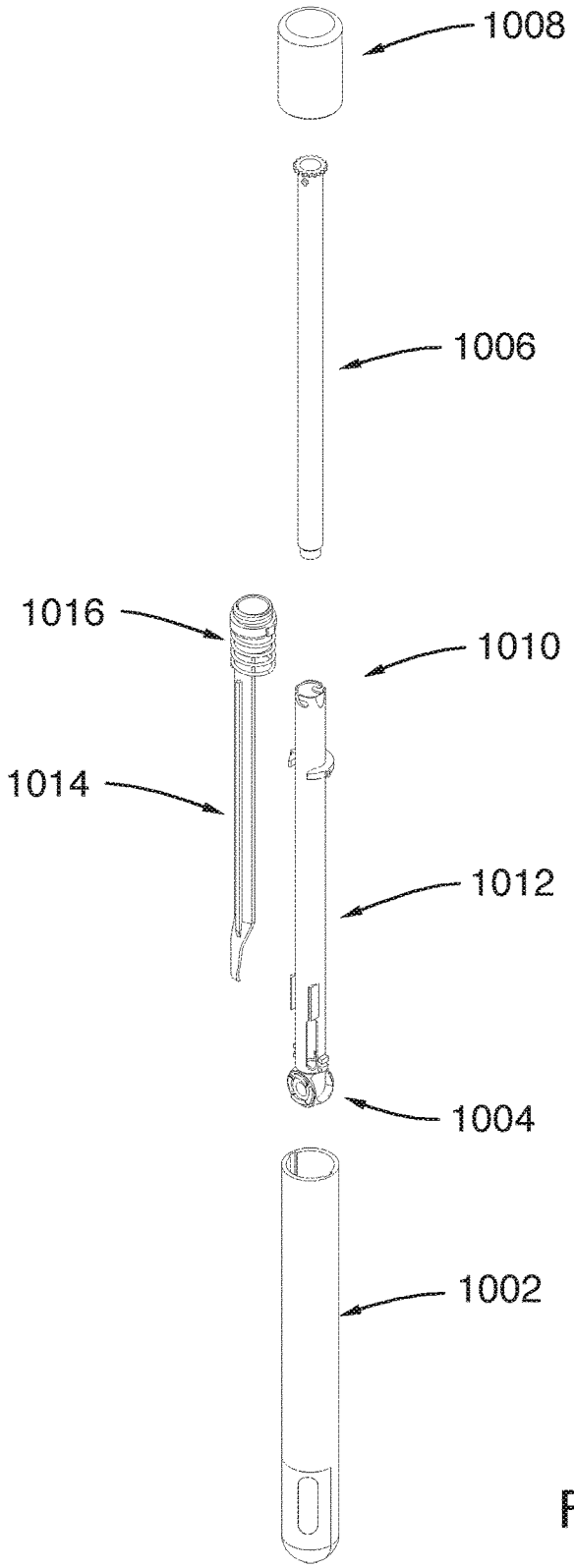
FIG. 60 is an exploded view of the portable dispenser shown in FIG. 59.
Figure 61:
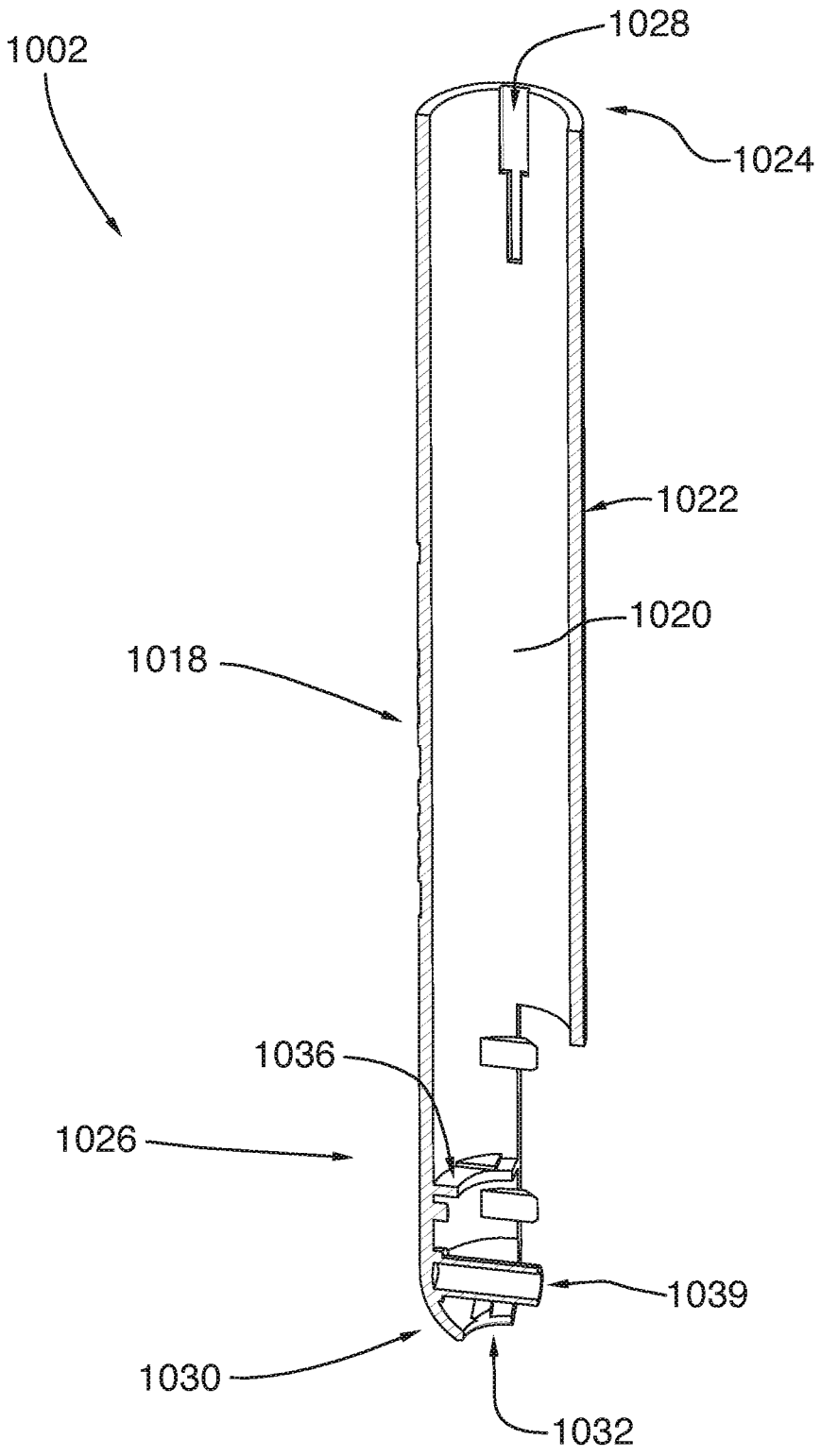
FIG. 61 is a longitudinal cross-sectional view of a casing shown in FIG. 60.
Figure 62:
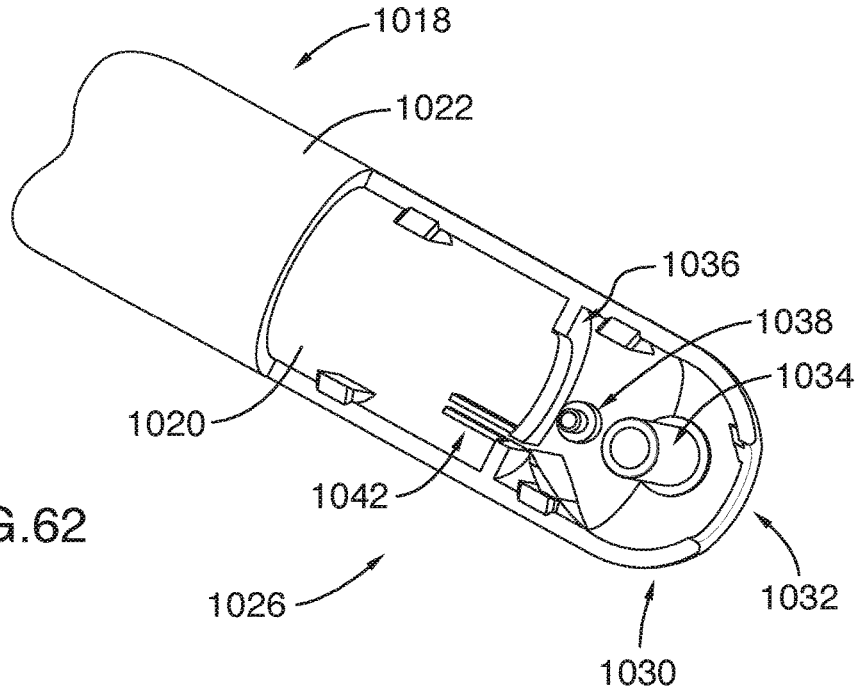
FIG. 62 is an enlarged perspective view of the lower end of the casing shown in 61.
Figure 63:
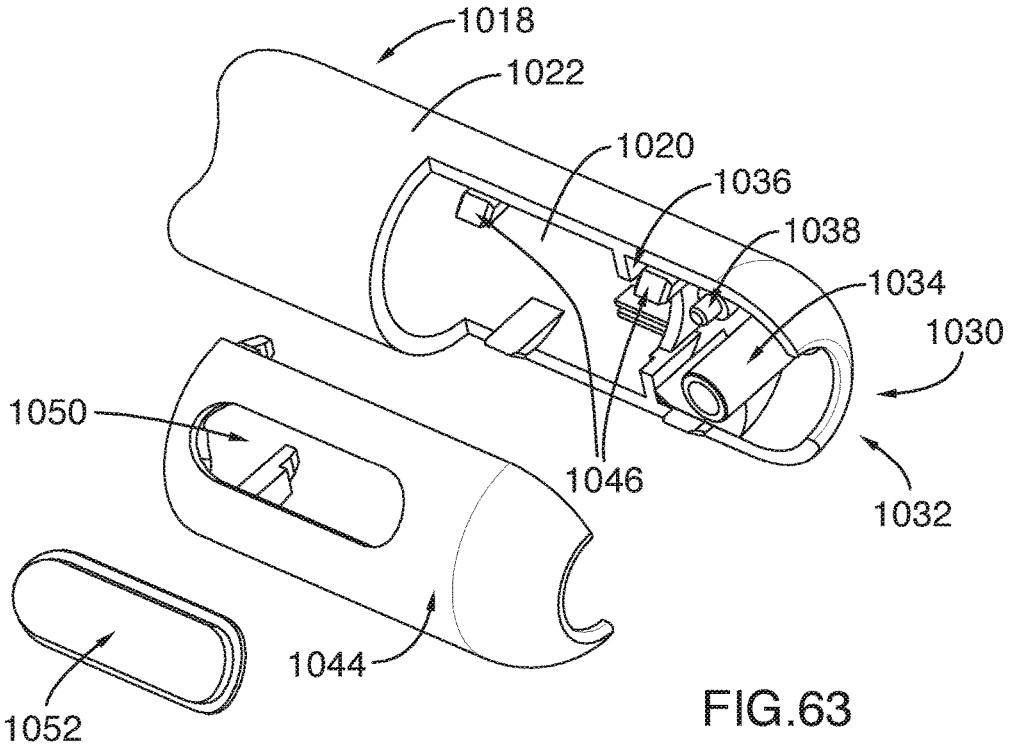
FIG. 63 is an enlarged exploded perspective view of the lower end of the casing showing a cover and a window.
Figure 64:
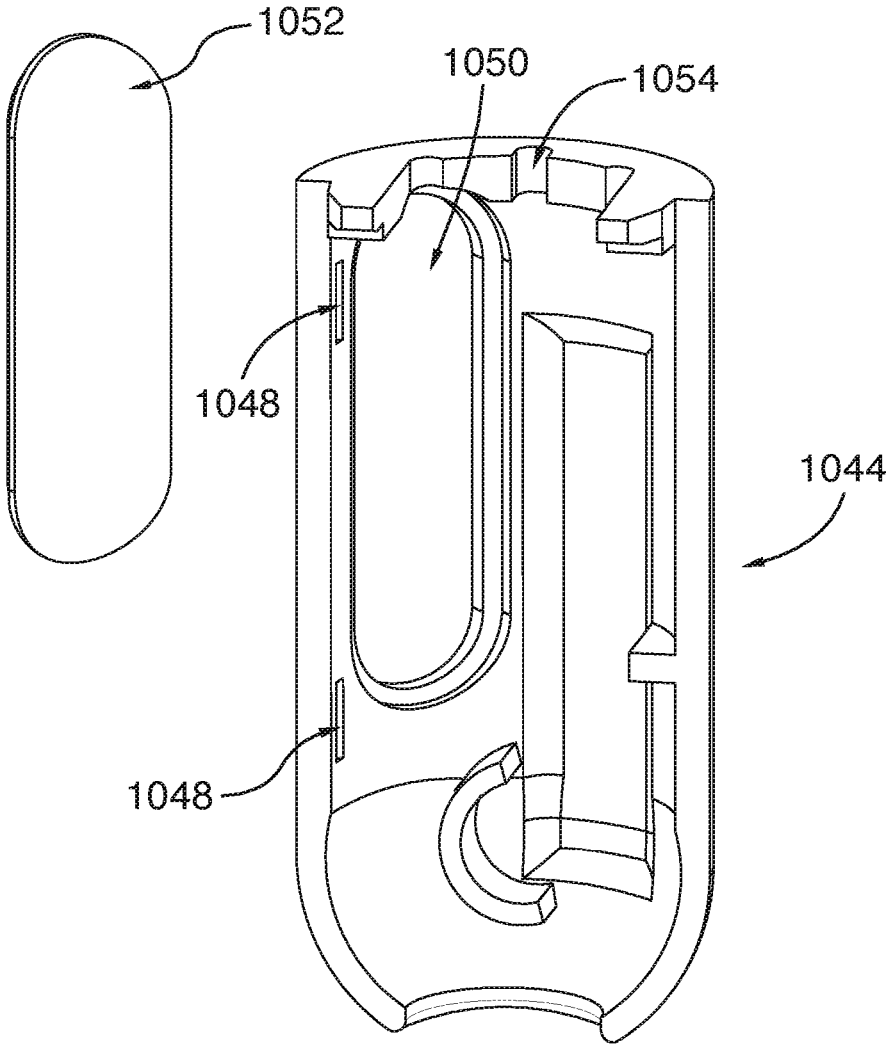
FIG. 64 is an exploded view of the cover and window shown in FIG. 63.

Depicted in FIGS. 59 and 60, there is shown a second embodiment of a portable dispenser 1000. Like dispenser 300, portable dispenser 1000 has a compact size and can be carried like a pen in order for a patient or a user to always have his pills at proximity.

The portable dispenser 1000 comprises a casing 1002 which has a hollow cylindrical shape, a spherical dispenser 1004, positioned at the bottom of the casing 1002 for dispensing pills, a cartridge 1006 for stacking pills, a button 1008 for actuating the portable dispenser 1000, a spring assembly 1010 comprising a container 1012, a rod 1014 and a spring 1016 for engaging the button 1008 and a spherical dispenser 1004 for dispensing pills.

With reference to FIGS. 61 to 64, the portable dispenser 1000 comprises a main casing 1002 having a main cylindrical body 1018 and comprising an inner surface 1020, an outer surface 1022, an upper portion 1024 and a lower portion 1026.

At the upper portion 1024, the casing 1002 comprises two diametrically opposed grooves 1028 with varying widths, which are located on the internal surface 1020 of the main casing 1002, for inserting corresponding protrusions of a container 1012 and protrusions of an elongated rod 1014 as it will further be explained.

The lower portion 1026 extends from the cylindrical body 1018 of the casing 1002 and terminates by a semi-spherical portion 1030 with a dispensing hole 1032. The internal surface 1020 of the lower portion 1026 further comprises a pivot shaft 1034 for rotationally mounting a spherical dispenser 1004 as it will further be explained below. Furthermore, the lower portion 1026 comprises a semi-circular ring 1036 extending towards the center of the cylindrical body 1018 of the portable dispenser 1000 for axially engaging the container 1012, as it will be apparent below. The lower portion 1026 further comprises a horizontal extending protrusion 1038 for engaging a torsion spring 1040, and a vertical groove 1042 extending upward from the semi-circular ring 1036. The casing 1002 further comprises a semi-circular cover 1044 removably installed onto the casing 1002, at the lower portion 1026 thereof, thanks to attaching means such as hooks 1046 being inserted in the corresponding recesses 1048 of the semi-circular cover 1044, thus fixedly securing the cover 1044 to the casing 1002. The cover 1044 comprises an oblong opening 1050 onto which a window 1052 is installed. The window 1052 allows a user to monitor the number of pills left in the cartridge 1006 in order to schedule a cartridge replacement or refill when needed. The cover 1044 further comprises a groove 1054 which will receive a protrusion of the elongated rod 1014 as the cover 1044 is being installed on the main casing 1002.

Figure 65:
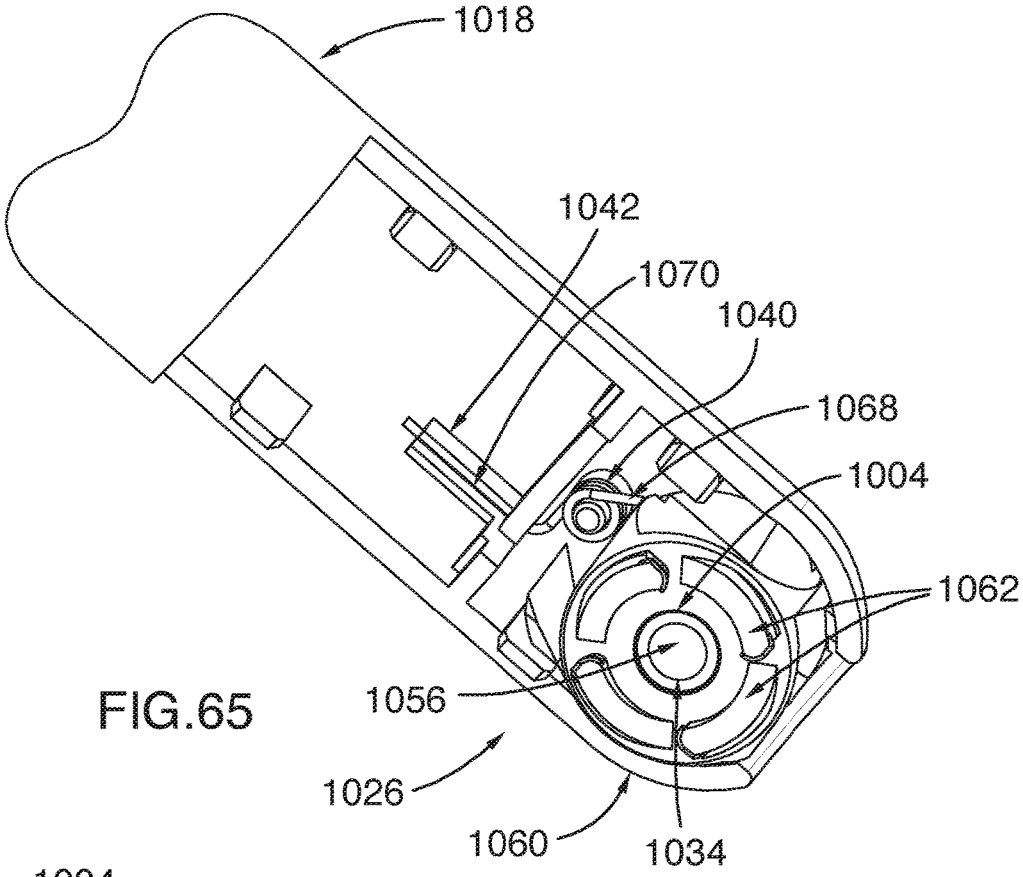
FIG. 65 is an enlarged perspective view of the lower end of the casing shown in FIG. 60 showing a spherical dispenser installed therein.
Figure 66:
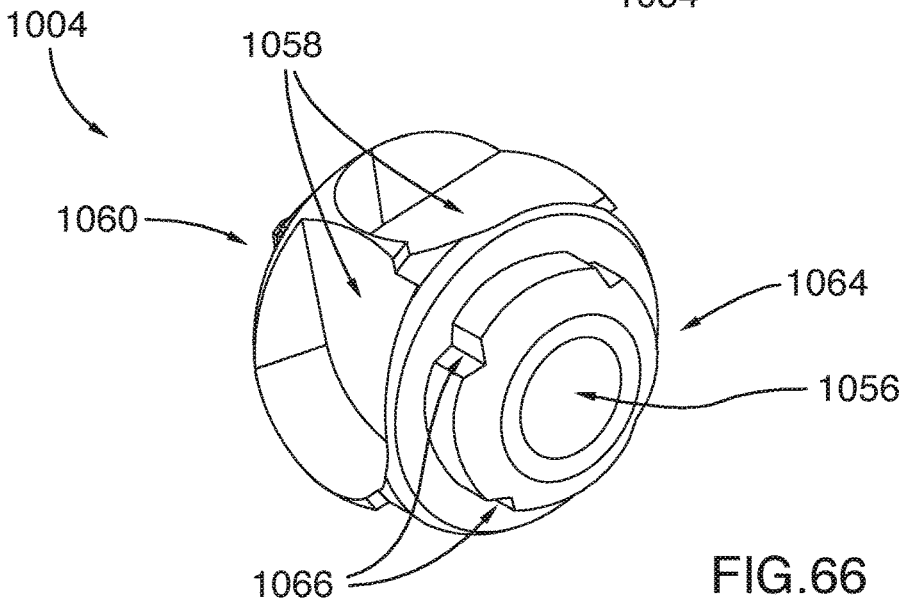
FIG. 66 is a perspective view of the spherical dispenser shown in FIG. 65.

FIGS. 65 and 66 illustrate a preferred embodiment of the spherical dispenser 1004. The spherical dispenser 1004 is installed on the pivot shaft 1034 of the casing 1002 thanks to a main hole 1056. The spherical dispenser 1004 comprises a plurality of receptacles 1058, angled at 90 degrees from one another relative to the axis of the hole 1056, which will receive pills or tablets to be dispensed. The spherical dispenser 1004 comprises a first end 1060 which comprises a plurality of curved protrusions 1062, angled at 90 degrees from one another relative to the axis of the hole 1056, which interacts with the lower end of the rod 1014 of the spring assembly 1010 as the portable dispenser 1000 is actuated. The second end 1064 of the spherical dispenser 1004 comprises a plurality of radial grooves 1066, angled at 90 degrees from one another relative to the axis of the hole 1056, aligned with the receptacles 1058 and which engage a first arm 1068 of a torsion spring 1040. The torsion spring 1040, which is positioned on the horizontal extending protrusion 1038 of the casing 1002, permits to lock the spherical dispenser 1004 when the portable dispenser 1000 is not actuated thanks to a first arm 1068 engaging with one of the plurality of grooves 1066 and a second arm 1070 inserted in the groove 1042 of the casing 1002 for maintaining the position of the torsion spring 1040.

Figure 67:
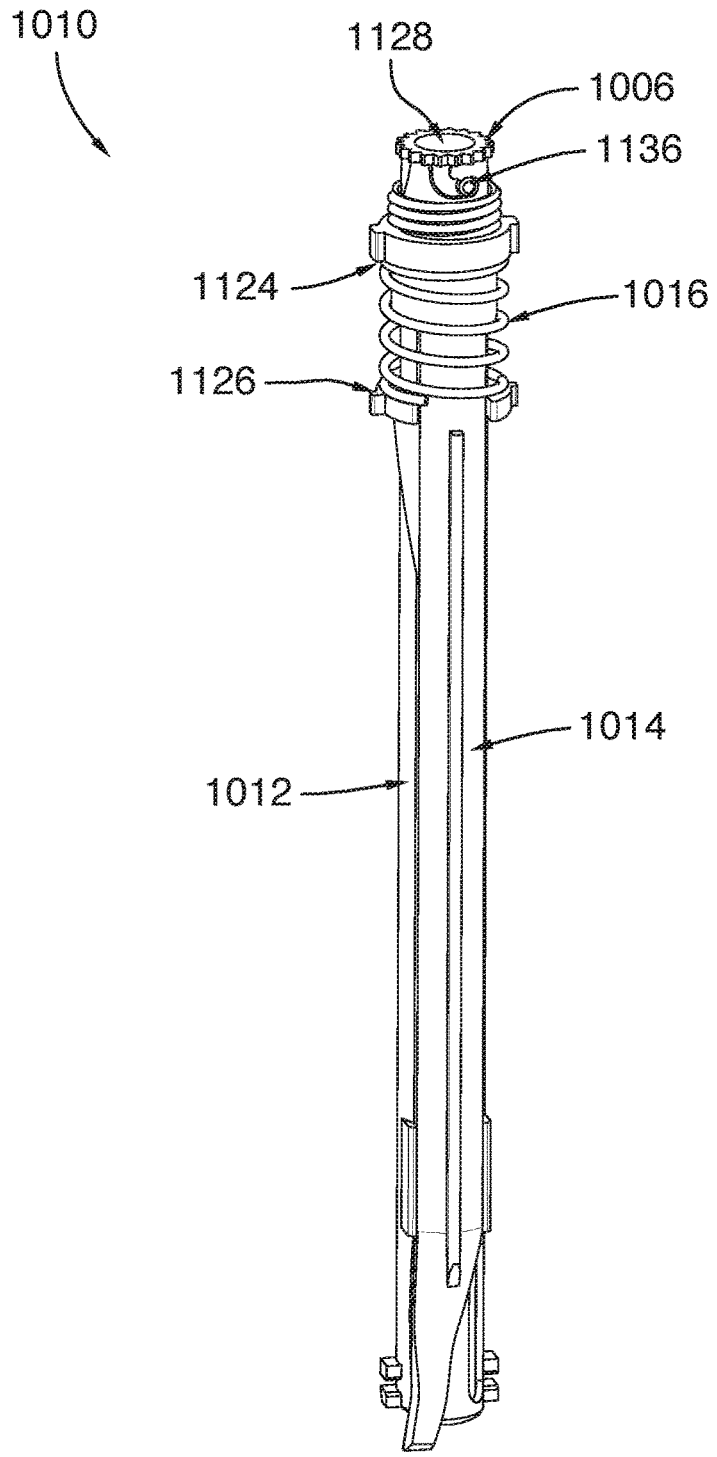
FIG. 67 is a perspective front view of a spring assembly of the portable dispenser shown in FIG. 59.

FIG. 67 illustrates an embodiment of a spring assembly 1010 which is mounted in the casing 1002. The spring assembly comprises a container 1012, an elongated rod 1014 axially mounted thereon and a spring 1016 mounted between the container 1012 and the elongated rod 1014, at the upper end thereof.

Figure 68:
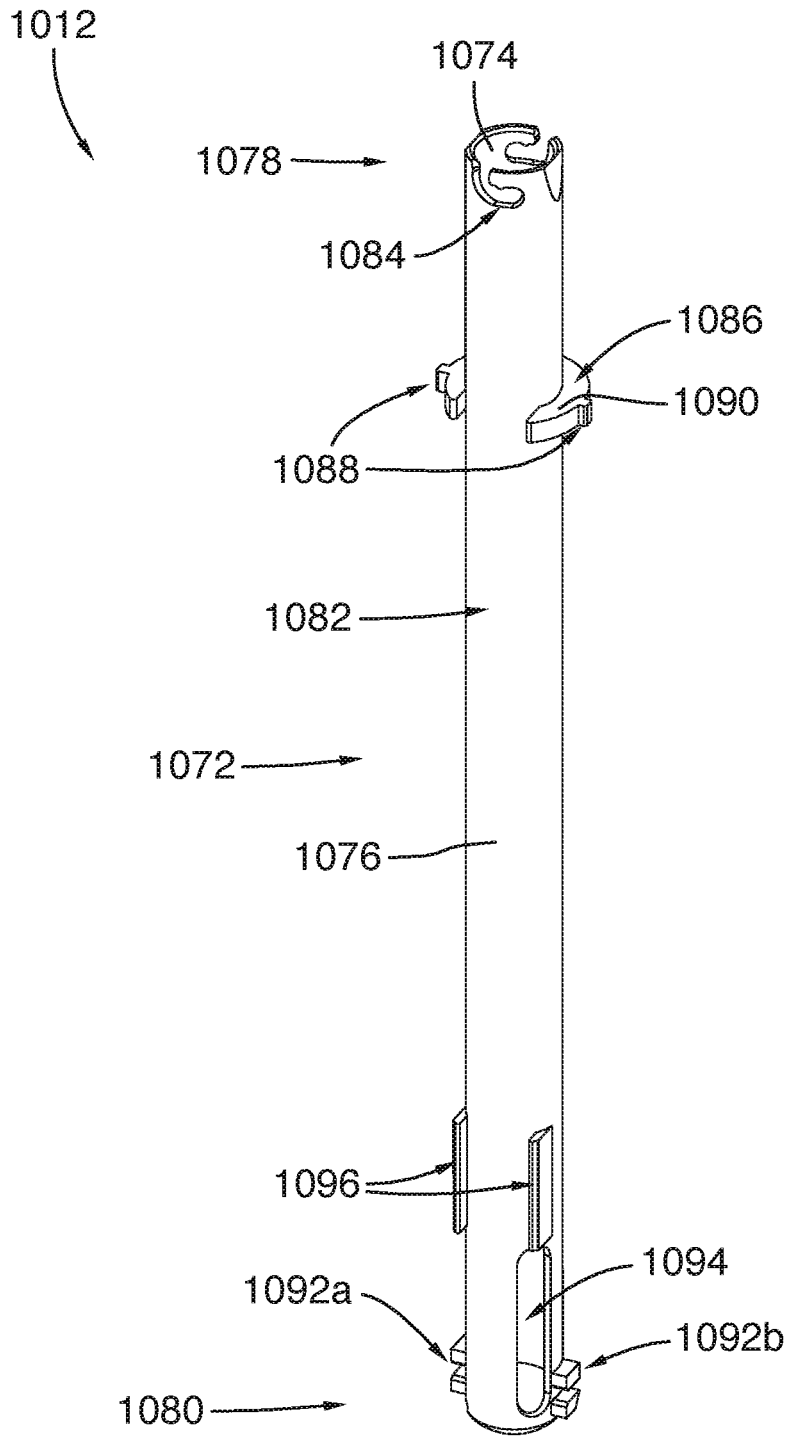
FIG. 68 is a perspective view of a container of the spring assembly shown in FIG. 67.

FIG. 68 illustrates an embodiment of a container 1012 for use with a dispenser 1000. The container 1012 has a cylindrical body 1072, an internal surface 1074, an external surface 1076, an upper portion 1078, a lower portion 1080 and a wall 1082 extending from the lower portion 1080 to the upper portion 1078. Furthermore, the container 1012 has an external diameter smaller than the internal diameter of the main casing 1002.

The upper portion 1078 of the container 1012 comprises diametrically opposed curved grooves 1084. The curved grooves 1084 will engage with the upper end of the cartridge 1006 as it will be explained further.

The external surface 1076 of the cylindrical body 1072 comprises a partially circular ring 1086 mounted thereon at an intermediate distance between the upper portion 1078 and the lower portion 1080. The partially circular ring 1086 comprises diametrically opposed protrusions 1088 extending outwardly therefrom. The upper surface 1090 of the partially circular ring 1086 will engage the lower most coil of a spring 1016 as it will be described later.

The lower portion 1080 of the container 1012 comprises pairs of diametrically opposed protrusions 1092*a*, 1092*b* extending outwardly from the external surface 1076 of the container 1012. Each pair of protrusion 1092*a*, 1092*b* are longitudinally distanced from one another for being inserted in the casing 1002, as it will be explained further below. The lower portion further comprises an oblong opening 1094 between the internal surface 1074 and the external surface 1076 of the container 1012. Extending upwardly proximate to the oblong opening 1094, is a pair of diametrically opposed protrusions 1096 extending outwardly from the external surface 1076 of the cylindrical body 1072.

Figure 69:
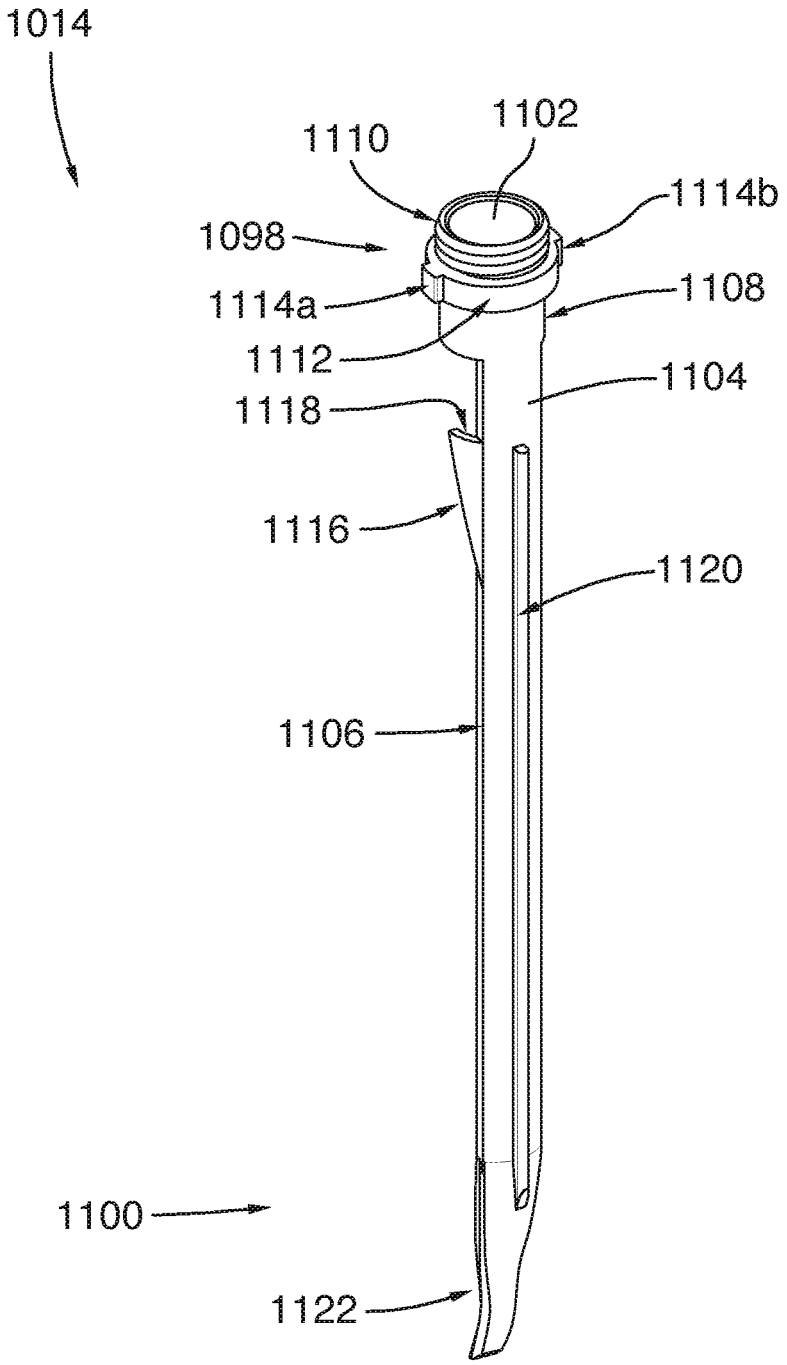
FIG. 69 is a perspective view of the elongated rod shown in FIG. 67.

FIG. 69 illustrates an embodiment of an elongated rod 1014 for use with a spring assembly 1010. In this embodiment, the rod 1014 comprises an upper portion 1098, a lower portion 1100, an internal surface 1102, an external surface 1104 and a slightly curved wall 1106, matching the external surface 1076 of the container 1012 and extending between the upper portion 1098 and the lower portion 1100.

The upper portion 1098 of the rod 1014 has a cylindrical body 1108 for being installed over the container 1012 and comprises a thread 1110 on the external surface 1104. The external surface 1104 of the upper portion 1098 further comprises a circular ring 1112 located under the thread 1110. The ring 1112 is flush with the thread 1110 and comprises a pair of diametrically opposed protrusions 1114*a*, 1114*b* extending outwardly therefrom.

The curved wall 1106 of the rod 1014 extends downwardly from the cylindrical body 1108, has a width generally equal to the width between the extremities of the partially circular ring 1086 of the container 1012, and comprises a protrusion 1116. The protrusion 1116 extends from the wall 1106 in a direction perpendicular to the axially direction of the rod 1014, follows the circular curvature of the wall 1106 and comprises an upper surface 1118 which will interact with partially circular ring 1086 of the container 1012 as it will be explained further.

The curved wall 1106 further comprises a longitudinal elongated protrusion 1120 extending from the protrusion 1116 to the lower portion 1100 of the rod 1014 and engaging the groove 1054 of the cover 1044.

The lower portion 1100 of the rod 1014 has a narrow curved portion extending 1122 to one side of the curved wall 1106 and engaging the plurality of curved protrusion 1062 of the spherical dispenser 1004 for rotating the spherical dispenser 1004 upon actuation of the button 1008, as it will further be explained below.

Figure 70:
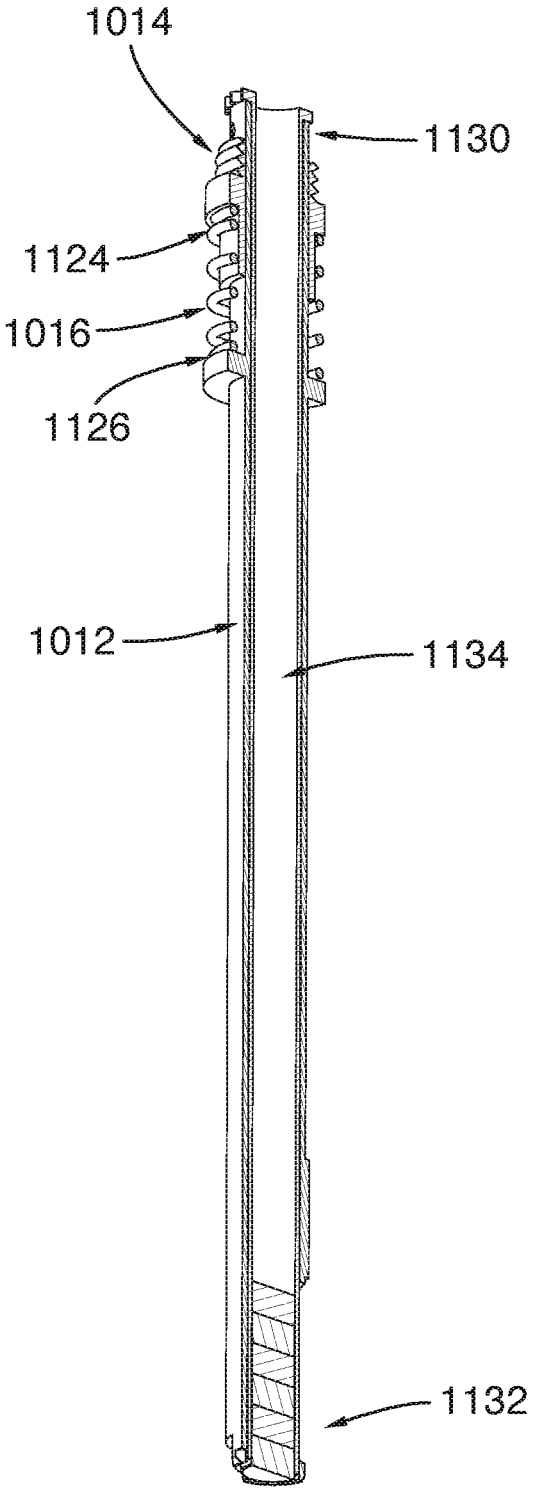
FIG. 70 is a perspective longitudinal cross-sectional view of the spring assembly shown in FIG. 67.

A compression spring 1016, shown in FIGS. 67 and 70, comprising an upper coil 1124 and a lower coil 1126 is inserted between the container 1012 and the rod 1014 by abutting the lower coil 1126 of the spring 1016 to the upper surface of the partially circular ring 1086 of the container 1012 and the upper coil 1124 of the spring 1016 to the lower surface of the circular ring 1112 of the rod 1014.

With reference to FIGS. 67 and 70, the dispenser 1000 further comprises a cartridge 1006 having a cylindrical shape and a main cavity 1128 for stacking pills or tablets. The cartridge 1006 comprises an upper portion 1130, a lower portion 1132 and a wall 1134 extending between the upper portion 1130 and the lower portion 1132. The upper portion 1130 of the cartridge 1006 comprises two diametrically opposed protrusions 1136 which are to be engaged with the complementary diametrically opposed curved grooves 1084 of the container 1012 as it will further be explained. The lower portion 1132 of the cartridge 1006 is the dispensing end from which pill are dispensed by gravity.

Figure 71:
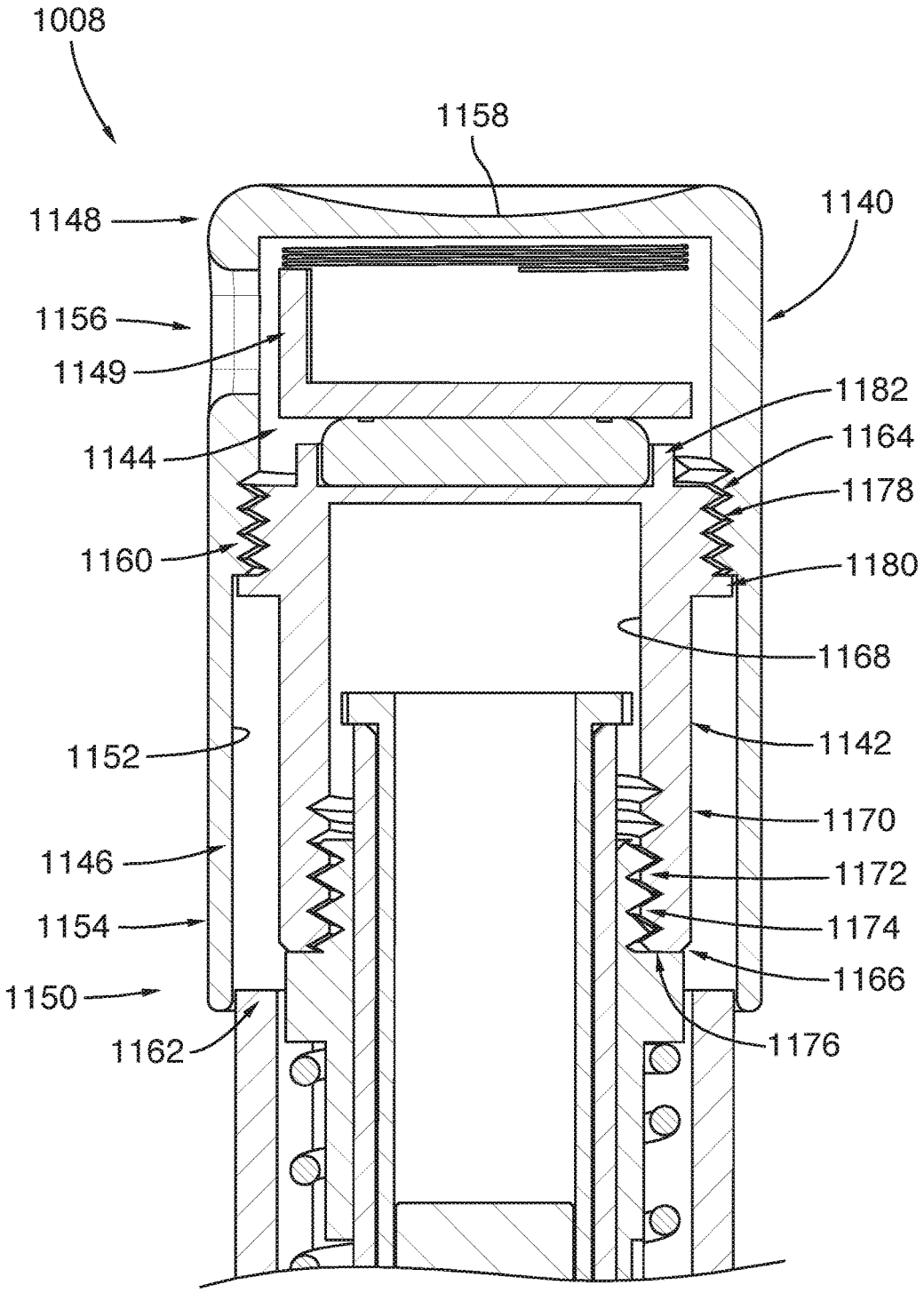
FIG. 71 is a right side enlarged cross-sectional view of a button of the portable dispenser shown in FIG. 59.

FIG. 71 illustrates a preferred embodiment of a button 1008 for triggering the dispensing of pills as it will be further explained. The button 1008 comprises an external cap 1140, an internal cap 1142 and an electronic system 1144 installed therebetween.

The external cap 1140 has a cylindrical body 1146 with an internal diameter larger than the diameter of the casing 1002 and comprises an upper portion 1148, a lower portion 1150, an internal surface 1152 and an external surface 1154.

The upper portion 1148 of the external cap 1140 comprises an opening 1156 for monitoring a visual indicator 1149, thus showing the user when to take his medication. The upper external surface 1158 of the upper portion 1148 has a generally flat or slightly inwardly curved shape to best fit the shape of a finger or a thumb of a user as the button 1008 is being actuated. The internal surface 1152 of the external cap 1140 comprises a thread 1160, located under the opening 1156, for screwing the external cap 1140 onto the internal cap 1142 as it will be explained further below.

The lower portion 1150 of the external cap 1140 is open and comprises a cavity 1162 into which the internal cap 1142 will be inserted. Furthermore, the lower portion 1150 of the external cap 1140 will travel over the casing 1002 upon actuation of the button 1008, as it will be explained further below.

The internal cap 1142 has a hollow cylindrical shape and comprises an upper portion 1164, a lower portion 1166, an internal surface 1168, an external surface 1170 and a wall 1172 extending between the lower portion 1166 and the upper portion 1164. The internal cap 1142 has an external diameter smaller than the diameter of the external cap 1140 and an internal diameter bigger than the diameter of the rod 1014.

The lower end 1166 of the internal cap 1142 comprises a thread 1174, located on the internal surface 1168, which engages the thread 1110 of the elongated rod 1014. The lower portion 1166 of the internal cap 1142 further comprises a lower surface 1176 which abuts the ring 1112 of the rod 1014 as the internal cap 1142 is mounted on the elongated rod 1014.

The upper portion 1164 of the internal cap 1142 comprises a thread 1178 and a stopper 1180, located on the external surface 1170, wherein the stopper 1180 is positioned under the thread 1178 and flush therewith. The external thread 1178 and the stopper 1180 of the internal cap 1142 engage the thread 1160 of the external cap 1140 for screwing and for stopping the external cap 1140, once the external cap 1140 has been completely screwed onto the internal cap 1142 of the button 1008. Furthermore, the upper portion 1164 of the internal cap 1142 comprises a circular wall 1182 extending upward from the upper portion 1164 of the internal cap 1142 and forming a receptacle to receive the electronic system 1144.

A method for assembling and using the portable dispenser 1000 will now be described in accordance with a first embodiment. In this embodiment, a casing 1002 is first provided. The spherical dispenser 1004 and the torsion spring 1040 are then installed in the casing 1002 by inserting the torsion spring 1040 onto the protrusion 1038 of the lower portion 1026 of the casing 1002 and simultaneously inserting the second arm 1070 of the torsion spring 1040 in the groove 1042 of the main casing 1002. The spherical dispenser 1004 is then inserted in the main casing 1002 by aligning the main hole 1056 of the spherical dispenser 1004 with the pivot shaft 1034 of the main casing 1002. The spherical dispenser 1004 is installed once the first arm 1068 of the torsion spring 1040 is inserted in one of the plurality of radial grooves 1066 of the second end 1064 of the spherical dispenser 1004.

Subsequently, the spring assembly 1010 comprising the container 1012, the rod 1014, and the spring 1016 is provided. The spring 1016 is installed on the rod 1014 by abutting the upper most coil 1124 to the lower surface of the circular ring 1112 of the elongated rod 1014. The elongated rod 1014 is subsequently installed onto the container 1012 by inserting the lower end 1100 of the elongated rod 1014 through the space formed between the extremities of the partially-circular ring 1086 of the container 1012. The upper portion 1098 of the rod 1014 is then concentrically aligned with the container 1012 and is axially moved downward over the container 1012. As the rod 1014 is moved downward over the container 1012, the curved wall 1106 of the rod 1014 is inserted between the pair of protrusions 1096 located above the oblong opening 1094 of the container 1012, thus preventing rotational movement of the rod 1014 relative to the container 1012. As the rod 1014 is further moved downward, the upper portion 1098 of the rod 1014 as well as the spring 1016 are inserted over the upper portion 1078 of the container 1012. The rod 1014 is fully installed once the lower most coil 1126 of the spring 1016 abuts the partially circular ring 1086 of the container 1012, the protrusion 1116 of the rod 1014 engages the lower surface of the semi-circular ring 1086 of the container 1012 to prevent upward axial movement of the rod 1014 relative to the container 1012, and once the thread 1110 of the rod 1014 is flush with the diametrically opposed curved grooves 1084 of the container 1012.

The spring assembly 1010 is then inserted in the main casing 1002 by respectfully aligning the pair of diametrically opposed protrusions 1114*a*, 1114*b* of the rod 1014 and the diametrically opposed protrusions 1088 of the partially circular ring 1086 of the container 1012 with the two diametrically opposed grooves 1028 with varying widths of the main casing 1002. The spring assembly 1010 is axially moved downward until the pairs of diametrically opposed protrusions 1092*a*, 1092*b* of the container 1012 engage the semi-circular ring 1036 of the lower portion 1026 of the main casing 1002. The semi-circular ring 1036 is inserted between the pairs of diametrically opposed protrusions 1092*a*, 1092*b* of the container 1012 thus preventing from any axial movement of the container 1012 and therefore the spring assembly 1010 relative to the main casing 1002. Furthermore, once the container is prevented from axial movement, the narrow curved portion 1122 of the rod 1014 is proximate to the plurality of curved protrusions 1062 of the spherical dispenser 1004. The cover 1044 is then installed on the lower portion 1026 of the main casing 1002 thanks to the hooks 1046 engaging in the recesses 1048 for fixedly securing the cover 1044 on the main casing 1002.

The cartridge 1006 is subsequently inserted in the container 1012 by axially aligning the cartridge 1006 with the upper portion 1078 of the container 1012. The cartridge 1006 is therefore moved downward, in the cylindrical body of the container 1012, and installed by inserting the two diametrically opposed protrusions 1136 of the upper portion 1130 of the cartridge 1006 in the two diametrically opposed curved grooves 1084 of the container 1012. Therefore, as the cartridge 1006 is installed in the container 1012, the diametrically opposed protrusions 1136 of the cartridge 1006 engage the diametrically opposed curved grooves 1084 of the container 1012 thus fixedly securing the cartridge 1006 in the container 1012 and preventing any relative axial movement. The lower portion 1132 of the cartridge 1006 is therefore aligned with one of the plurality of receptacles 1058 which will each receive a medication, pill or tablet as the portable dispenser 1000 is actuated and the spherical dispenser 1004 is rotated.

The button 1008 is subsequently assembled. The internal cap 1142 is screwed onto the external cap 1140 by engaging the thread 1178 of the upper portion 1164 of the internal cap 1142 with the thread 1160 of the external cap 1140. The internal cap 1142 is fully screwed onto the external cap 1140, once the thread 1160 of the external cap 1140 abuts the stopper 1180 of the internal cap 1142. The button 1108 is therefore assembled.

The button 1008 is subsequently assembled on the container 1012 by screwing the internal cap 1142 onto the rod 1014. The internal cap 1142 is aligned with the container 1012 and the thread 1174 of the internal cap 1142 is engaged with the thread 1110 of the rod 1014. The portable dispenser 1000 is therefore fully assembled once the button 1008 is assembled on the casing 1002.

It should be understood that different methods for assembling the portable dispensers 1000 are possible and that a person skilled in the art would be able to assemble the portable dispenser 1000 described above by permuting the previously disclosed steps. For example, the portable dispenser 1000 could be assembled through a series of steps in which the button 1008 is first assembled by screwing the internal cap 1142 onto the external cap 1140. Secondly, the spring assembly 1010 is assembled by installing the rod 1014 and the spring 1016 on the container 1012 as previously described. Thirdly, the spring assembly 1010 is inserted and installed in the main casing 1002 by aligning and axially translating the spring assembly 1010 in the main casing 1002 and by engaging the semi-circular ring 1036 of the casing 1002 between the pairs of diametrically opposed protrusions 1092*a*, 1092*b* of the container 1012 thus preventing any axial movement of the container 1012 relative to the main casing 1002. Fourthly, the spherical dispenser 1004 and the torsion spring 1040 are installed in the lower portion 1026 of the main casing 1002 as previously disclosed. The cover 1044 is subsequently installed over the lower portion 1026 of the main casing 1002. Fifthly, the cartridge 1006 is inserted in the container 1012 by axially aligning the cartridge 1006 with the container 1012 and by aligning the two diametrically opposed protrusions 1136 of the cartridge 1006 with the diametrically opposed curved grooves 1084 of the container 1012. As the cartridge 1006 is inserted in the container 1012, the diametrically opposed protrusions 1136 engage with the diametrically opposed curved grooves 1084 thus fixedly securing the cartridge 1006 in the container 1012. Sixthly, the button 1008 is assembled on the spring assembly 1010 by screwing the thread 1174 of the lower portion 1166 of the internal cap 1142 on the thread 1110 of the rod 1014. The portable dispenser 1000 is therefore fully assembled.

Figure 72:
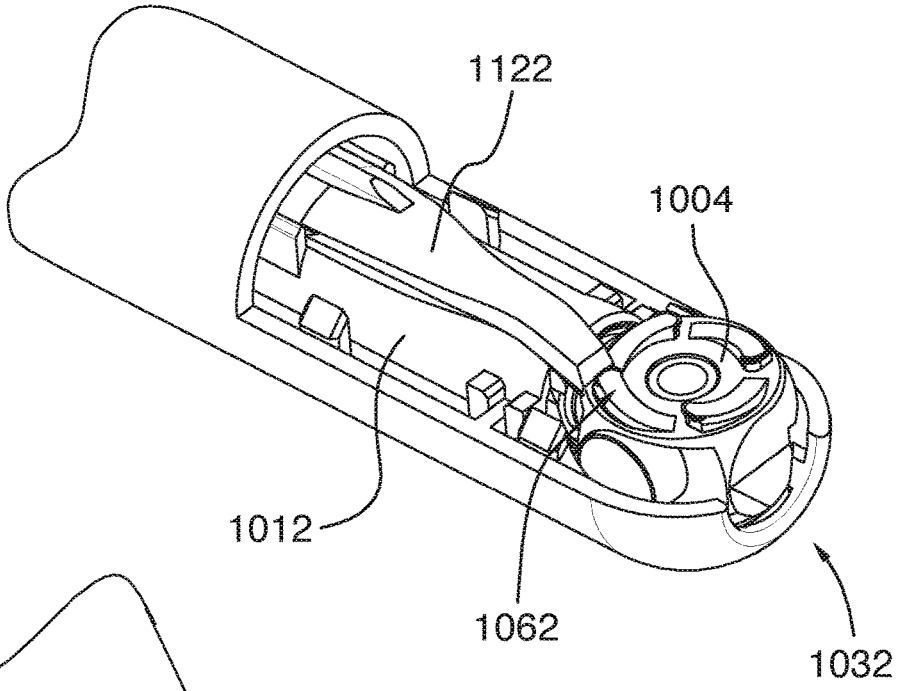
FIG. 72 is an enlarged perspective view of the lower end of the portable dispenser shown in FIG. 59 showing the elongated rod interacting with the spherical dispenser.

In order to dispense a medication, a pill or a tablet, a user presses on the button 1008 of the portable dispenser 1000, thus exerting a downward force on the button 1008, which in turn engages the internal cap 1142 thanks to the thread 1160 of the external cap 1140 engaging with the thread 1178 of the upper portion 1164 of the internal cap 1142. The internal cap 1142 therefore engages the rod 1014 thanks to the thread 1174 of the internal cap 1142 engaging with the thread 1110 of the rod 1014. Therefore, as the container 1012 remains motionless in the main casing 1002 thanks to the pairs of diametrically opposed protrusions 1092*a*, 1092*b* engaged with the semi-circular ring 1036, the elongated rod 1014 is axially downwardly moved and is prevented from any rotational movement thanks to the diametrically opposed protrusions 1114*a*, 1114*b* engaging the two diametrically opposed grooves 1028 with varying widths of the main casing 1002. The force exerted by a user on the button 1008 compresses spring 1016 due to the upper most coil 1124 of the spring 1016 abutting the ring 1112 of the elongated rod 1014 and the lower most coil 1026 of the spring 1016 abutting the semi-circular ring 1086 of the container 1012, thus dampening the movement of the rod 1014. As the rod 1014 is downwardly moved, the narrow portion 1122 is downwardly displaced and engages one of the plurality of curved protrusions 1062 of the spherical dispenser 1004. Therefore, as the narrow portion 1122 of the rod 1014 engages the spherical dispenser 1004, the spherical dispenser 1004 rotates uni-directionally in one direction thanks to the pivot shaft 1034 engaging the main hole 1056 of the spherical dispenser 1004 as shown in FIG. 72.

Figure 73:
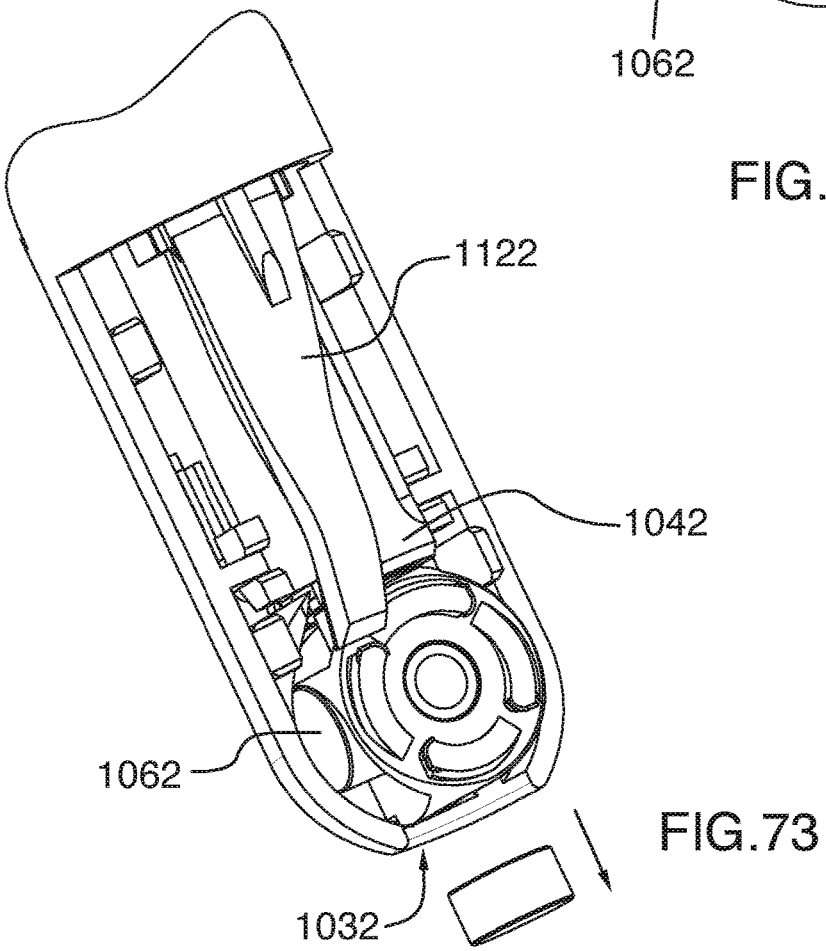
FIG. 73 is enlarged perspective view of the lower end of the portable dispenser shown in FIG. 59 as a tablet is dispensed.

The narrow portion 1122 of the rod 1014 is slightly eccentric relative to the curved wall 1106 of the rod 1014 and as the narrow portion 1122 engages the spherical dispenser 1004, the spherical dispenser 1004 only rotates 90 degrees in one direction to dispense a single dose of medication (e.g. a single pill or tablet). The lower portion 1132 of the cartridge 1006 delivers a single dose of medication each time the spherical dispenser 1004 is rotated 90 degrees thanks to the narrow portion 1122 of the rod 1014 pushing on one of the plurality of curved grooves 1062 of the spherical dispenser 1004. Therefore, as the spherical dispenser 1004 rotates 90 degrees, each empty receptacle 1058 receives a pill when it is aligned with the lower portion 1132 of the cartridge 1006 and the receptacle containing a pill or tablet which is aligned with the dispensing hole 1032 of the casing 1002 dispenses the contained pill thanks to gravity as shown in FIG. 73. In an alternate embodiment, a bias assembly such as a spring assembly could be used to assist in filling empty receptacles 1058 when such receptacles are aligned with the lower portion 1132 of the cartridge 1006.

Once a pill or a dose of medication has been dispensed from the receptacle 1058 aligned with the dispensing hole 1032 of the casing 1002, the user releases the button 1008 which will move the rod 1014 upwardly thanks to the spring 1016 exerting an upward force. As the rod 1014 moves upwardly, the spherical dispenser 1004 remains in its last dispensing position where the receptacle aligned with the dispensing hole 1032 is empty. The first arm 1068 of torsion spring 1040 engages one of the plurality of radial grooves 1066 of the spherical dispenser 1004 thus maintaining the spherical dispenser 1004 in its last position for preventing any further rotation of the spherical dispenser 1004 relative to the main casing 1002. The portable dispenser 1000 enters a non-actuated mode once the spring 1016 of the spring assembly 1010 is fully uncompressed and no pressure is exerted on the button 1008.

As the user dispenses pills according to the prescription of the doctor, the number of pills or tablets will decrease until it reaches a certain threshold, predetermined by the pharmacist, in which case the electronic system 1144 will notify the user and the pharmacist. At that time, the replacement of the cartridge 1006 is achieved by unscrewing the button 1008 from the upper end of the elongated rod 1014 thus giving access to the empty cartridge 1006. Once the pharmacist replaces the cartridge, he programs a dispensing sequence according to the prescription made by the doctor as it will be explained further below.

Figure 74:
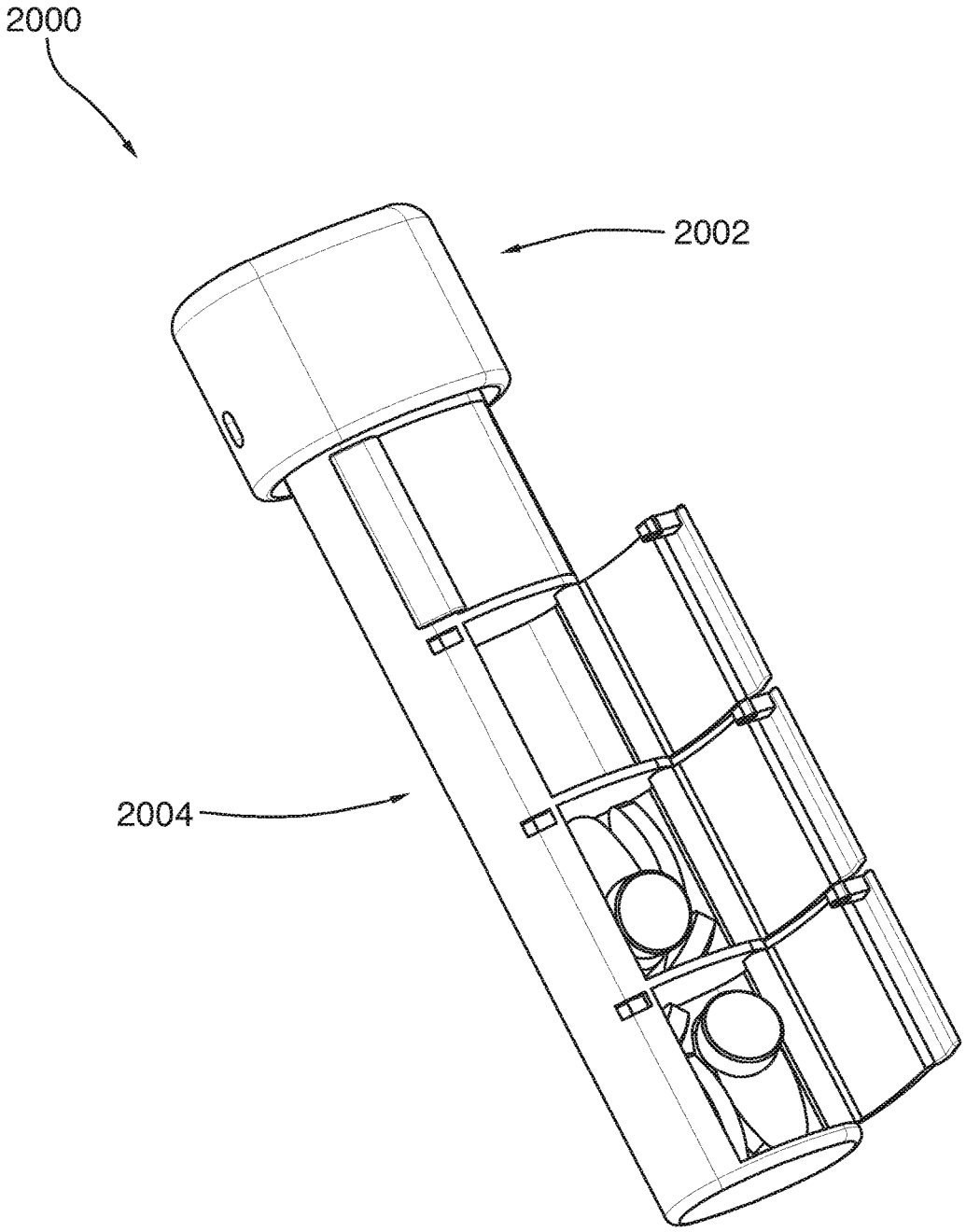
FIG. 74 is a perspective view of a third type of portable dispenser shown in FIG. 2.
Figure 75:
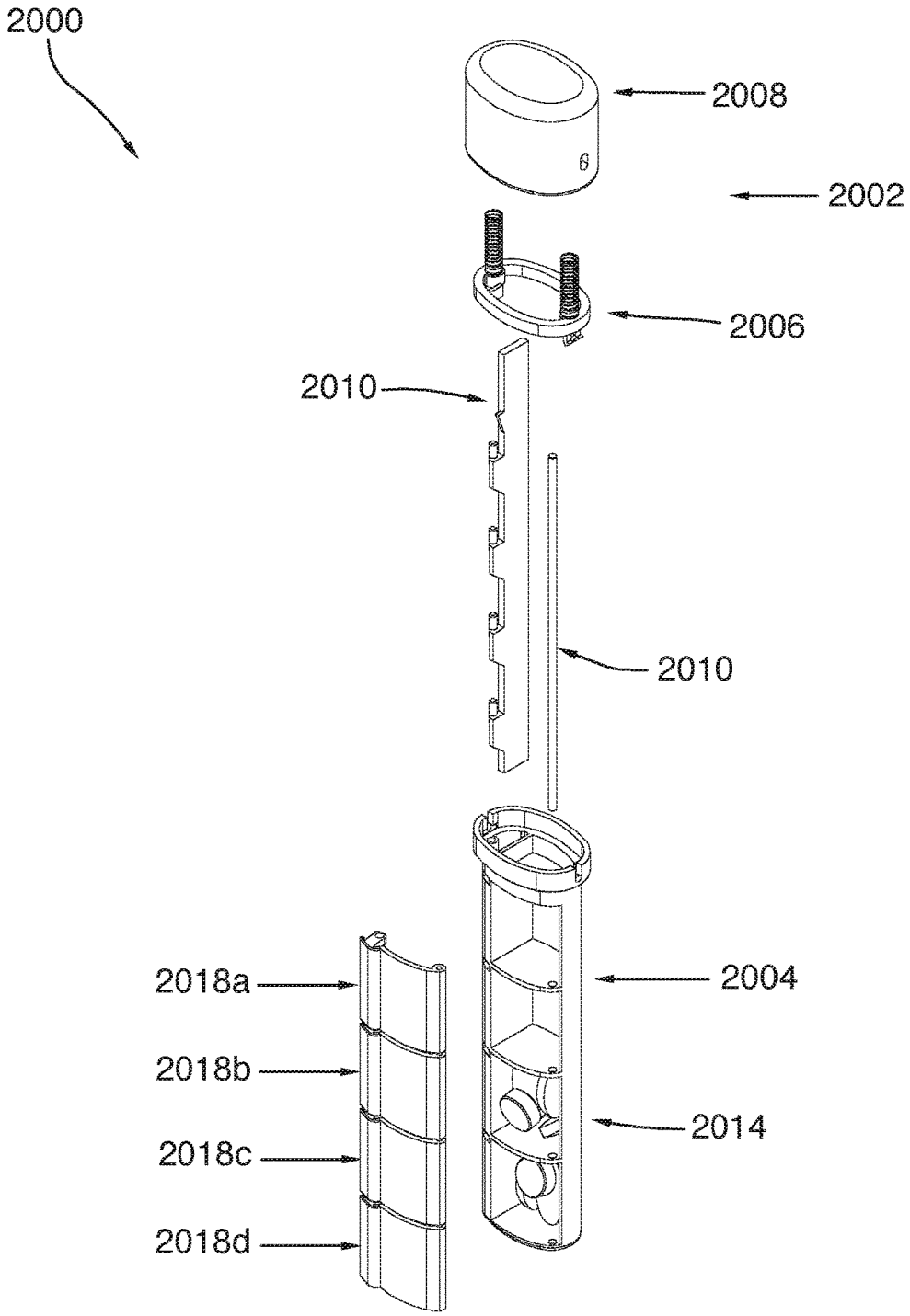
FIG. 75 is an exploded perspective view of the third type of portable dispenser shown in FIG. 74.

With reference to FIGS. 74 and 75, there is shown a third embodiment of a portable tablet dispenser. The portable dispenser 2000, has been developed to allow autonomous patients to take pills or tablets at different times of the day. The portable dispenser 2000 comprises a plurality of compartments or containers for different dispensing periods as prescribed by the doctor and a pharmacist or care giver or the like.

The portable dispenser 2000 is used to temporarily contain pills or tablets and is actuated thanks to a button 2002 which unlocks a plurality of doors 2018*a*, 2018*b*, 2018*c* and 2018*d* to give access to the medication contained in the containers. The portable dispenser 2000 can be used to make medication easier and more accessible. The portable dispenser 2000 is compact and easy to carry and has the size of a small pen which can be carried by a user at all times of the day.

With reference to FIGS. 74 and 75, the portable dispenser 2000 comprises a container assembly 2004 having a generally elliptical shape for containing a plurality of pills or tablets, a button 2002, comprising a static portion 2006, a movable portion 2008 and an actuating arm 2010, and an electronic system 2012.

Figure 76:
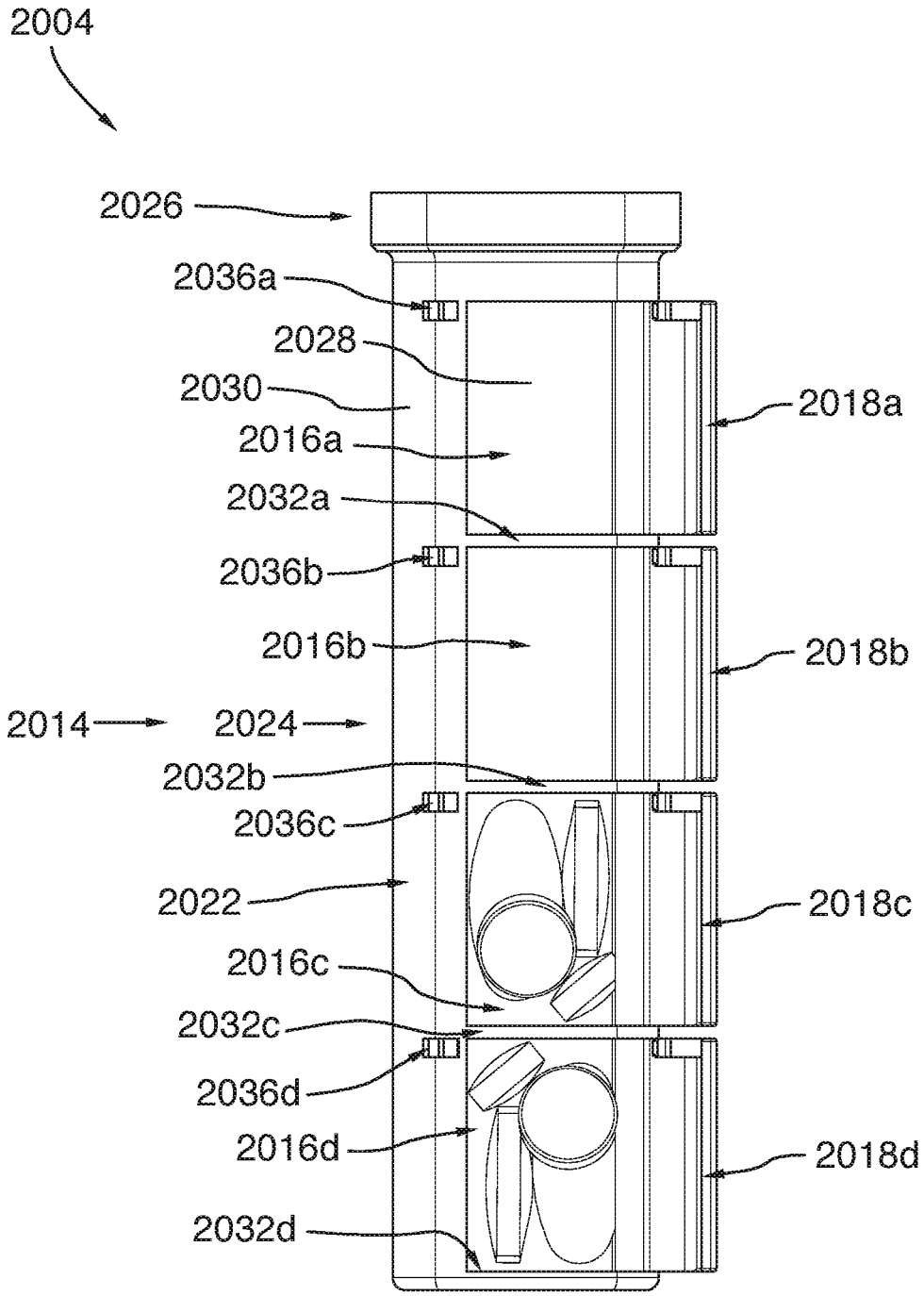
FIG. 76 is a front view of a housing of the portable dispenser shown in FIG. 74 with a corresponding plurality of doors mounted thereon, in the open position.
Figure 77:
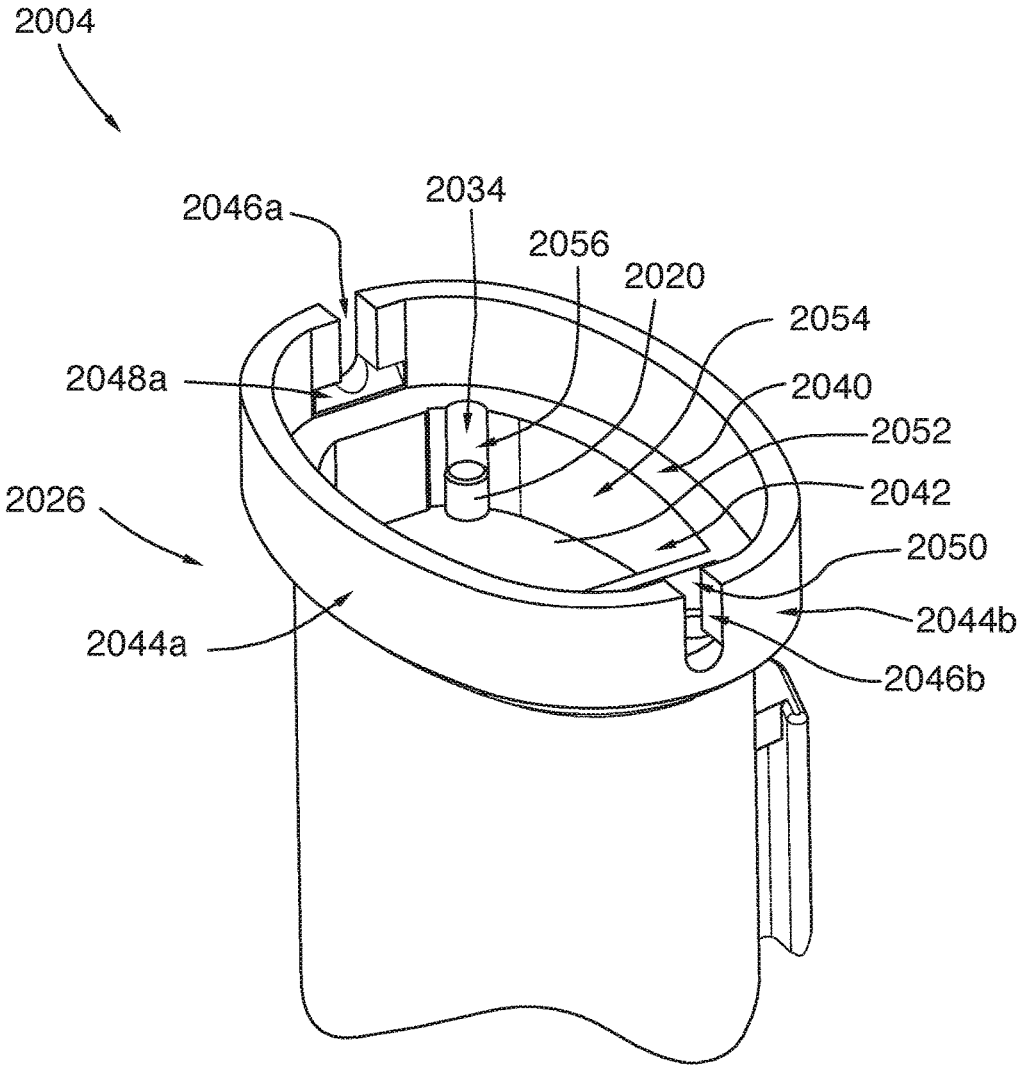
FIG. 77 is an enlarged perspective view of the upper portion of the housing shown in FIG. 76.
Figure 78:
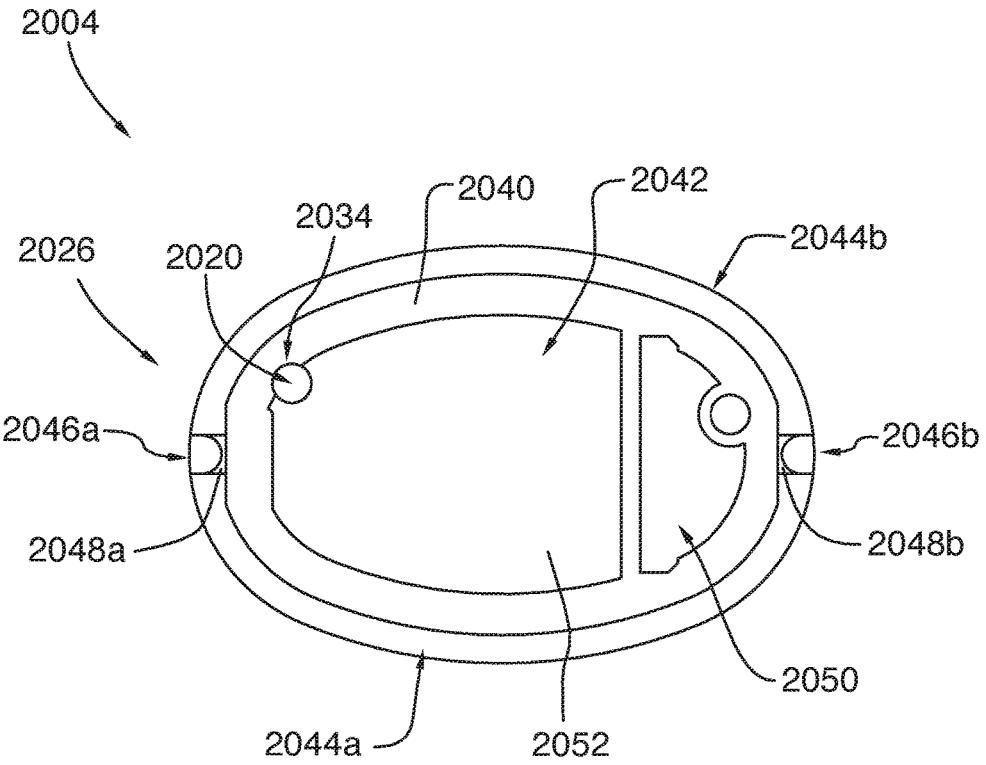
FIG. 78 is a top view of the housing shown in FIG. 76.

With reference to FIGS. 76 to 78, the container assembly 2004 will now be described. The container assembly 2004 comprises a housing 2014 having an elliptical body divided in a plurality of compartments or containers 2016*a*, 2016*b*, 2016*c*, 2016*d* for receiving pills, a plurality of doors 2018*a*, 2018*b*, 2018*c* and 2018*d* for closing the compartments 2016*a*, 2016*b*, 2016*c* and 2016*d*, and an elongated pivot shaft 2020 for pivotably mounting the plurality of doors 2018*a*, 2018*b*, 2018*c* and 2018*d* to the housing 2014.

The housing 2014 has an elliptical body 2022 comprising a container portion 2024, an upper portion 2026, an internal surface 2028 and an external surface 2030.

The container portion 2024 has an elliptical body 2022 and is divided into the plurality of compartments 2016*a*, 2016*b*, 2016*c* and 2016*d* separated by a plurality of walls 2032*a*, 2032*b*, 2032*c* and 2032*d* extending from the internal surface 2028 and aligned with the external surface 2030. The compartments 2016*a*, 2016*b*, 2016*c* and 2016*d* are assigned to a dispensing period of the day and comprise a plurality of different medication (e.g. pills or tablets) which rest against the internal surface 2028 of the elliptical body 2022 when stored in the dispenser 2000. The plurality of walls 2032*a*, 2032*b*, 2032*c* and 2032*d* further comprise a hole 2034, located proximate to the external surface 2030 of the elliptical body 2022, for mounting a pivot shaft 2020 as it will further be described.

The external surface 2030 of the container portion 2024 comprises a plurality of slots 2036*a*, 2036*b*, 2036*c* and 2036*d* corresponding to the number of compartments 2016*a*, 2016*b*, 2016*c* and 2016*d*, located proximate therefrom. The slots 2036*a*, 2036*b*, 2036*c* and 2036*d* which create an opening between an opening 2050 extending the entire length of the main housing 2014 from the upper portion 2026 and the external surface 2030 of the main housing 2014. The plurality of slots 2036*a*, 2036*b*, 2036*c* and 2036*d* each receives a protrusion 2038 from the plurality pivoting doors 2018*a*, 2018*b*, 2018*c* and 2018*d* and are aligned therewith for locking the pivoting doors in a closed state as it will become apparent below.

As depicted in FIGS. 77 and 78, the upper portion 2026 of the housing 2014 is an open end slightly bigger than the elliptical shape of the container portion 2024 and comprises an upper surface 2040 extending from the elliptical body 2022 of the container portion 2024, a recess 2042 and a pair of spaced-apart curved walls 2044*a*, 2044*b* extending from the upper surface 2040, in the longitudinal direction of the housing 2014 (i.e. vertically when the housing 2014 stands upright).

A pair of diametrically opposed longitudinal slots 2046*a*, 2046*b* is provided in the curved walls 2044*a*, 2044*b*. A pair of inclined recesses 2048*a*, 2048*b* extending perpendicular to the longitudinal slots 2046*a*, 2046*b* is also provided, proximate to the upper surface 2040 of the upper portion 2026 of the housing 2014. As it will become apparent below, the slots 2046*a* and 2046*b* collaborate to guide the button 2002 during its installation onto the upper portion 2026 of the housing 2014, and to fixedly secure the button 2002 to the housing 2014 for the operation of the dispenser 2000 as it will become apparent below. The upper surface 2040 further comprises an opening 2050 extending downwardly through the entire length of the container portion 2024 and sized to receive an actuating arm 2020 as it will be explained further.

The upper portion 2026 further comprises a recess 2042 extending downwardly from the upper surface 2040 toward an upper surface 2052 of the elliptical body 2022. The upper surface 2052 comprises a hole 2034 for inserting a pivot shaft 2020 for engaging the doors 2018*a*, 2018*b*, 2018*c* and 2018*d*. A vertical wall 2054, extending from the upper surface 2040 to the upper surface 2052 of the elliptical body 2022 comprises a partial groove 2056 matching the shape of the pivot shaft 2020 when inserted therein.

To close the compartments 2016*a*, 2016*b*, 2016*c* and 2016*d* of the container portion 2024, the plurality of pivoting doors 2018*a*, 2018*b*, 2018*c* and 2018*d* are installed on the shaft 2020, for opening and closing the plurality of compartments when the dispensing period begins and finishes respectively.

Figure 79:
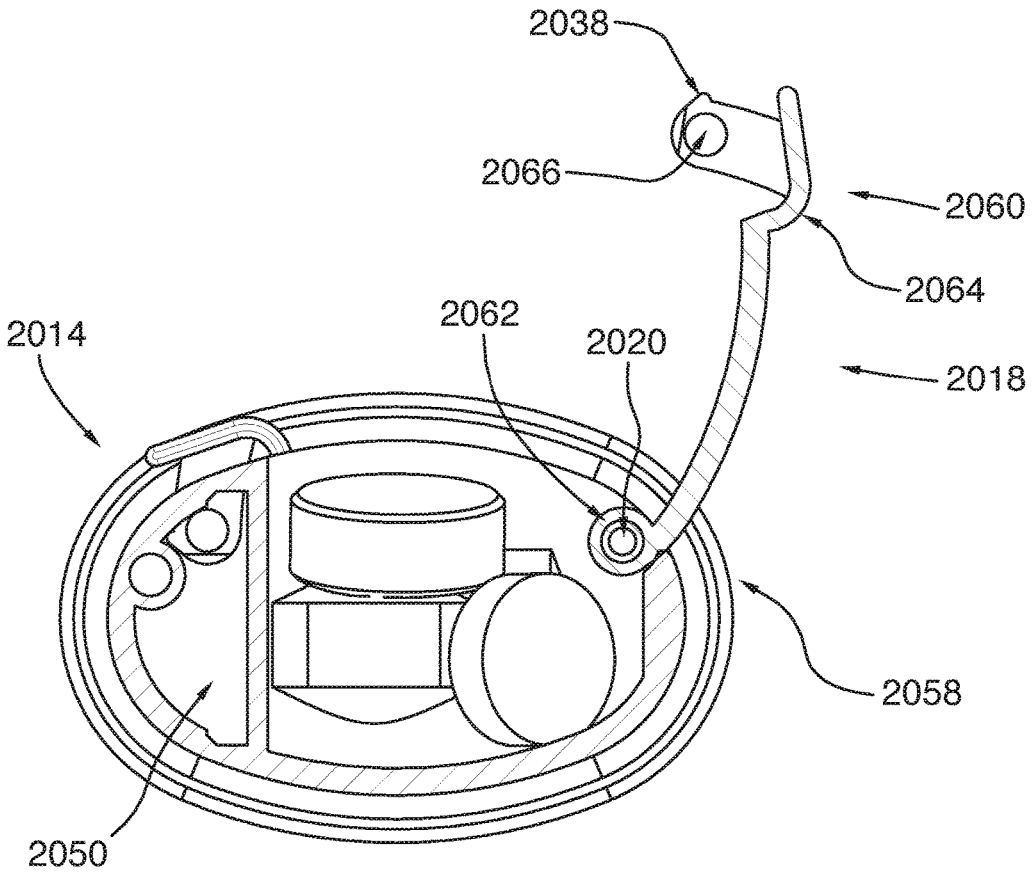
FIG. 79 is a bottom cross-sectional view of the housing shown in FIG. 76.

With reference to FIG. 79, the pivoting doors 2018*a*, 2018*b*, 2018*c* and 2018*d* have a width corresponding to the distance between two consecutive walls 2018*a*, 2018*b* of the elliptical body 2022. The pivoting doors 2018*a*, 2018*b*, 2018*c* and 2018*d* comprise a first end 2058 and a second end 2060. The first end 2058 comprises a hole 2062 aligned with the hole 2034 of the container portion 2024. The shaft 2020 inserted through the hole 2034 therefore provides a pivoting attachment of the plurality of doors 2018*a*, 2018*b*, 2018*c* and 2018*d* to the container portion 2024. The pivoting doors 2018*a*, 2018*b*, 2018*c* and 2018*d* have a generally slightly incurved shape, to best fit the general elliptical shape of the container portion 2024. The second end 2060 of the pivoting doors 2018*a*, 2018*b*, 2018*c* and 2018*d* comprises a curved external surface 2064 in the shape of a lip which will help a user open the door during the dispensing period to get access to his pills. The second end 2060 further comprises a protrusion 2038 which comprises a hole 2066 which will be inserted in one of the plurality of corresponding slots 2036*a*, 2036*b*, 2036*c* and 2036*d* of the external surface 2030 of the container portion 2024. As it will become apparent below, the slots 2036*a*, 2036*b*, 2036*c* and 2036*d* and holes 2066 collaborate to maintain the doors 2018*a*, 2018*b*, 2018*c* and 2018*d* in a closed state.

Figure 80:
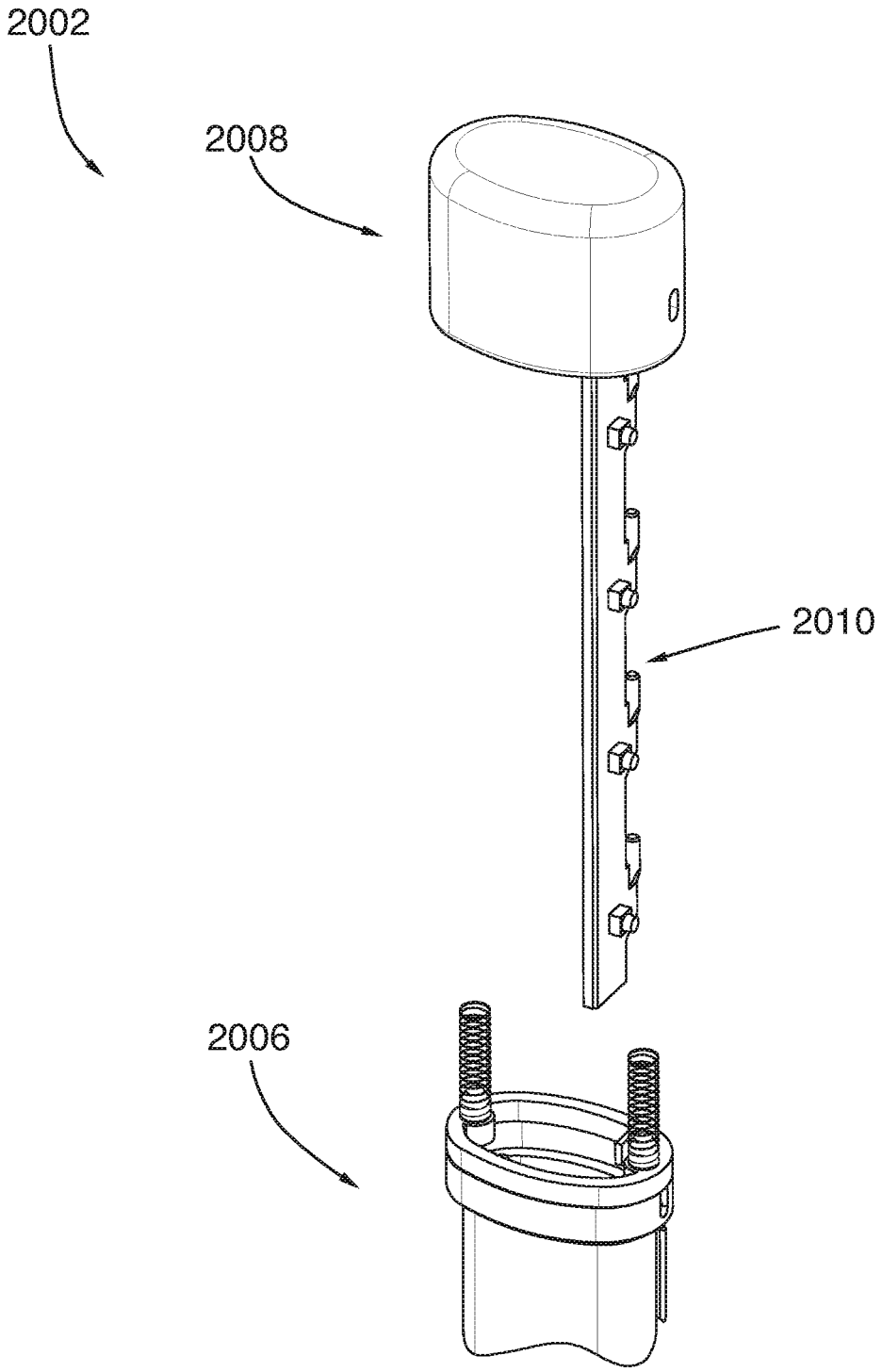
FIG. 80 is an enlarged perspective, partially exploded, view of a button of the portable dispenser shown in FIG. 74 with the static portion installed on the housing and the moving portion of the button removed.

With reference to FIG. 80, the button 2002 of the dispenser 2000 will now be described. The button 2002 has the general shape of a cap or a button and comprises a static portion 2006 fixedly maintained on the upper portion 2026 of the housing 2014 and a movable portion 2008 movable between an actuated state and a released state.

Figure 81:
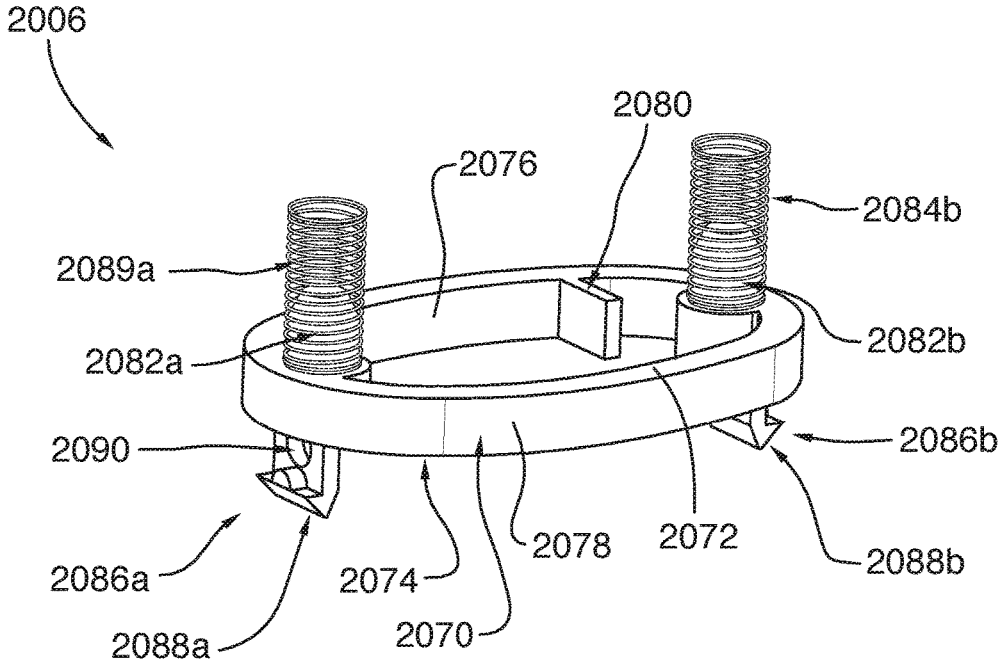
FIG. 81 is a perspective view of the static portion of the button shown in FIG. 80.
Figure 82:
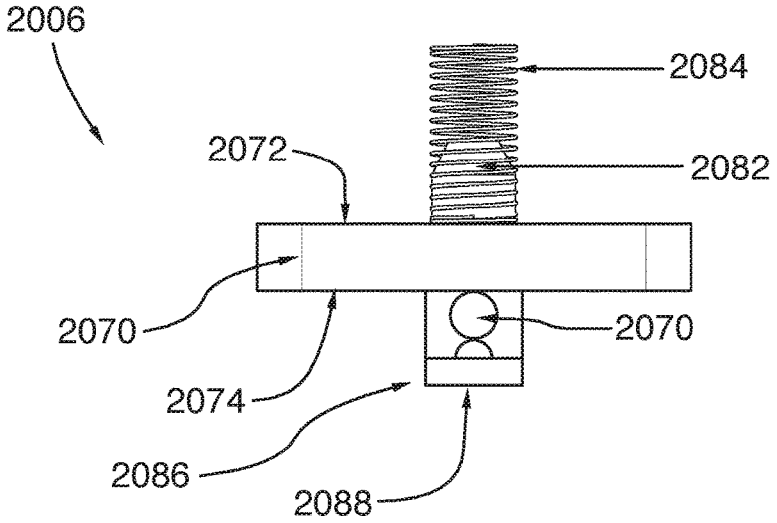
FIG. 82 is a right side view of the static portion of the button shown in FIG. 80.

In accordance with the illustrated embodiment, FIGS. 81 and 82, the static portion 2006 of the button 2002 comprises an elliptical frame member 2070 having a shape corresponding to the cross-section of the upper portion 2026 of the housing 2014 and is configured to be received within the pair of spaced-apart curved walls 2044*a*, 2044*b*.

The elliptical frame member 2070 of the static portion 2006 comprises an upper surface 2072, a lower surface 2074, an internal surface 2076 and an external surface 2078.

The internal surface 2076 of the elliptical frame member 2070 comprises a cross member 2080, having the same width as the elliptical frame member 2070 and extending towards the center of the elliptical frame member 2070. The cross member 2080 is aligned with the opening 2050 of the upper portion 2026 of the housing 2014, as the static portion 2006 of the button 2002 is inserted on the upper portion 2026 of the housing 2014 and interacts with an actuating arm 2010 of the movable portion 2008 of the button 2002 to limit the upwardly movement of the movable portion 2008 as it will be explained further below.

Extending downwardly from the elliptical frame member 2070 are least two diametrically opposed longitudinal arms 2086*a*, 2086*b*, each comprising at their extremity a hook 2088*a*, 2088*b* and a hole 2090. As the static portion 2006 is mounted on the upper portion 2026 of the housing 2014 the longitudinal arms 2086*a*, 2086*b* are bent inwardly towards the center of the elliptical shape of the housing 2014. As the static portion 2006 is further axially translated, the hooks 2088*a*, 2088*b* of the longitudinal arms 2086*a*, 2086*b* enter the inclined recesses 2048*a*, 2048*b*, thus bending outwardly the arms 2086*a*, 2086*b* and tightly securing the static portion 2006 to the upper portion 2026 of the container 2014, in a snap engagement, and preventing the static portion 2006 from any unwanted rotation or translation relative to the container 2014.

Extending upwardly from the elliptical frame member 2070 are diametrically opposed circular protrusions 2082*a*, 2082*b*, onto which springs 2084*a*, 2084*b* are installed in order to interact with the movable portion 2008 of the button 2002 during actuation of the button 2002 as it will be explained further.

The lower surface 2074 of the elliptical frame member 2070 is oriented toward the housing 2014 and abuts the upper end of the spaced-apart curved walls 2044*a*, 2044*b* of the upper portion 2026 as the static portion 2006 is installed on the upper portion 2026 of the housing 2014.

Figure 83:
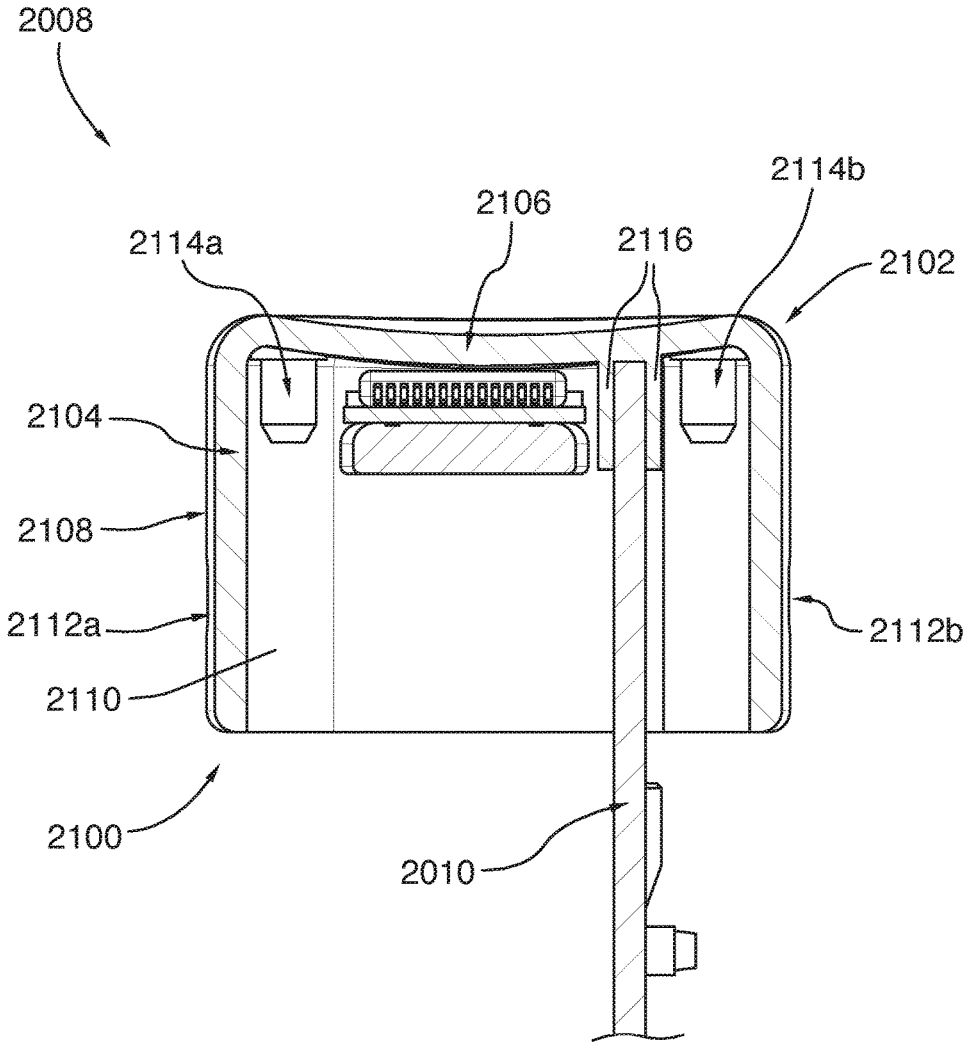
FIG. 83 is a front cross-sectional view of the moving portion of the button shown in FIG. 80.
Figure 84:
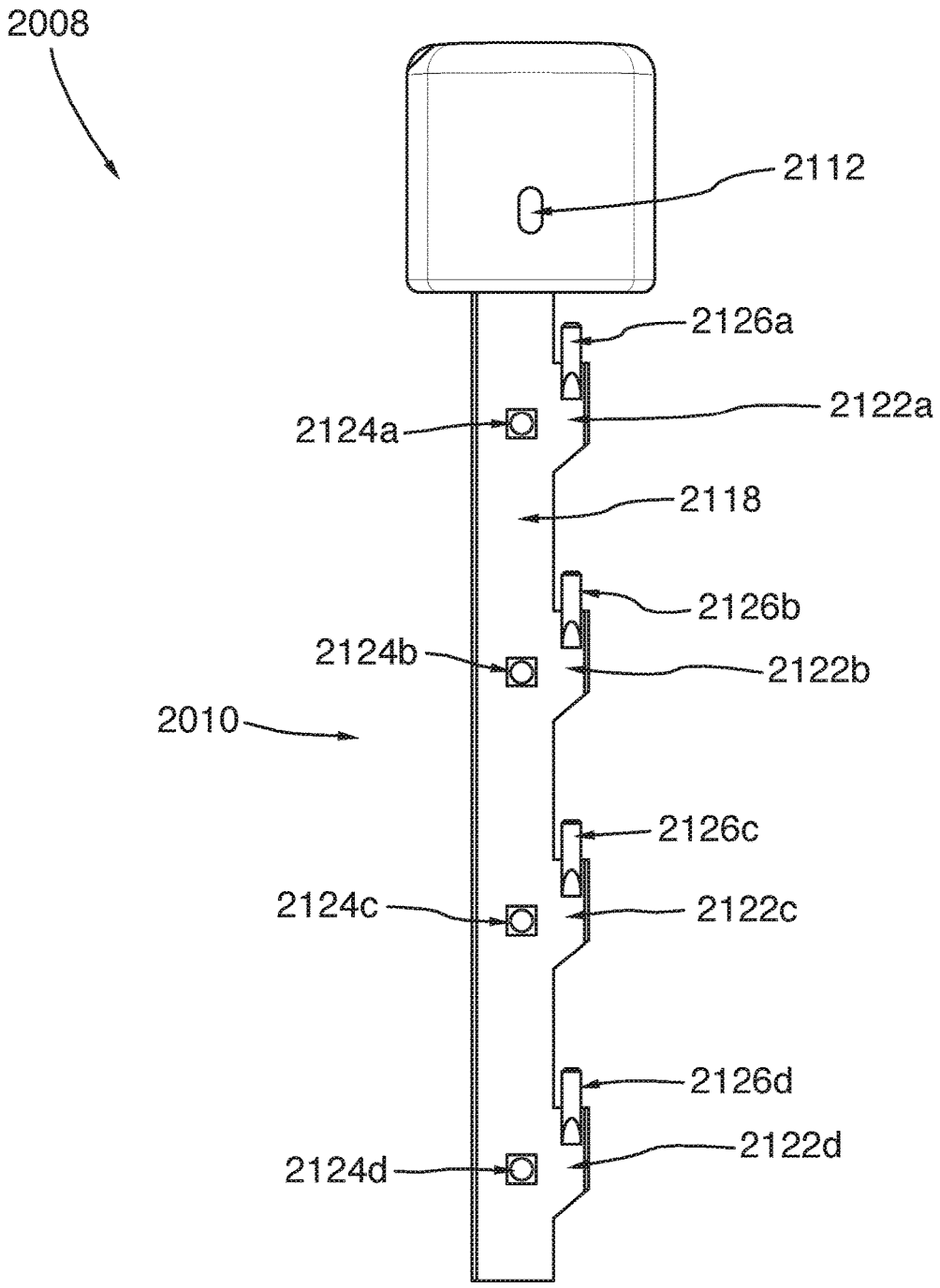
FIG. 84 is a left side view of the moving portion of the button showing an lock mechanism.

FIGS. 83 and 84 illustrate the movable portion 2008 of the button 2002. The movable portion 2008 has a hollow elliptical shape corresponding to the external shape of the static portion 2006 and sized and shaped to receive therein the static portion 2006 of the button 2002 and to reciprocate freely over it upon actuation of a user.

With reference to FIG. 83, the movable portion 2008 has an open lower end 2100, an upper end 2102 and a curved wall 2104 extending between the lower end 2100 and the upper end 2102, the curved wall 2104 having a generally elliptical cross-section. At the upper end 2102 thereof, the movable portion 2008 is closed by a generally elliptical top wall 2106. Together, the curved wall 2104 and the top wall 2106 define an outer face 2108 and an inner face 2110 of the movable portion 2008. The outer face 2108 of top wall 2106 is generally flat or slightly inwardly curved to best fit the shape of a finger or a thumb of a user as the button 2002 is being actuated.

The movable portion 2008 includes a pair of diametrically opposed elongated holes 2112*a*, 2112*b* for removing the button 2002 as it will be explained in greater details.

The movable portion 2008 also includes a pair of diametrically opposed circular protrusions 2114*a*, 2114*b* extending downwardly from the top inner face 2110 of wall 2106. When the movable portion 2008 of the button 2002 is properly installed over the static portion 2006, the circular protrusions 2114*a*, 2114*b* of the movable portion 2008 are vertically aligned with the circular protrusions 2082*a*, 2082*b* of the static portion 2006. The circular protrusions 2114*a*, 2114*b* engage the upper most coil of the springs 2084*a*, 2084*b* of the static portion 2006 and collaborate with the circular protrusions 2114*a*, 2114*b* of the movable portion 2008 for guiding their compression. More precisely, once the movable portion 2008 is installed over the static portion 2006, the upper part of the springs 2084*a*, 2084*b* is axially aligned with the circular protrusions 2114*a*, 2114*b* and the upper coils abuts the internal face 2110 of the upper wall 2106 of the movable portion 2008, therefore axially maintaining the springs 2084*a*, 2084*b* during compression and expansion as the button 2000 is actuated.

The inner face 2110 of the elliptical top wall 2106 includes a pair of flanges 2116 located between the circular protrusion 2114*a*, 2114*b*, offset from the center of the top wall 2106.

Together, the flanges 2116 define a recess for receiving a lock mechanism in the form of an actuating arm 2010, which is designed to lock the plurality of doors 2018*a*, 2018*b*, 2018*c* and 2018*d* as it will further be explained below.

Figure 85:
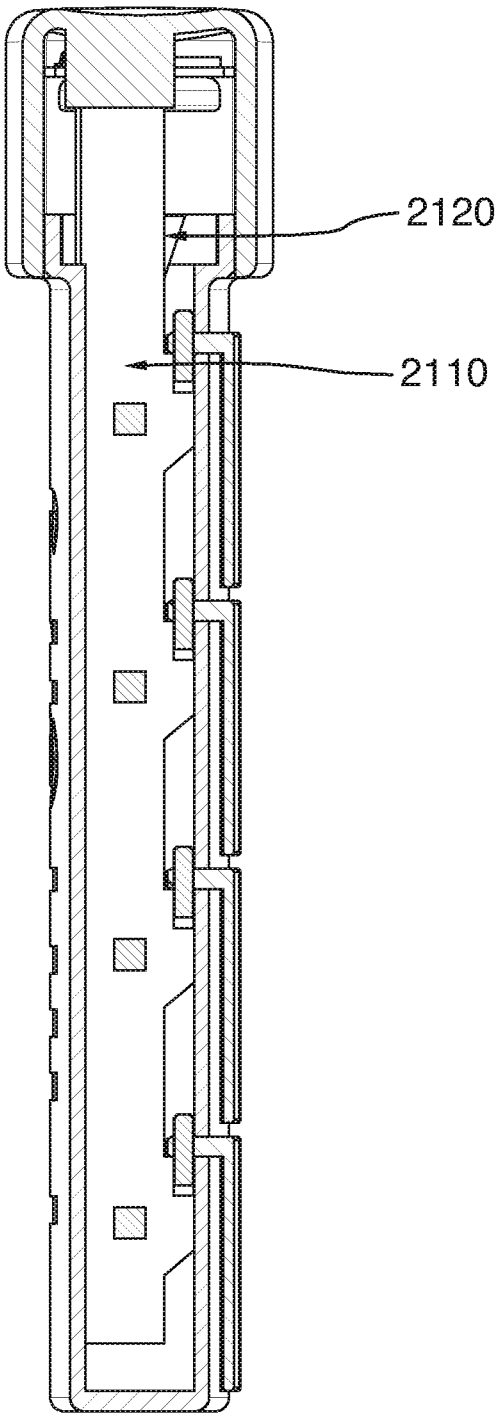
FIG. 85 is a left side cross-sectional view of the portable dispenser of FIG. 74 with the doors in a closed position.
Figure 86:
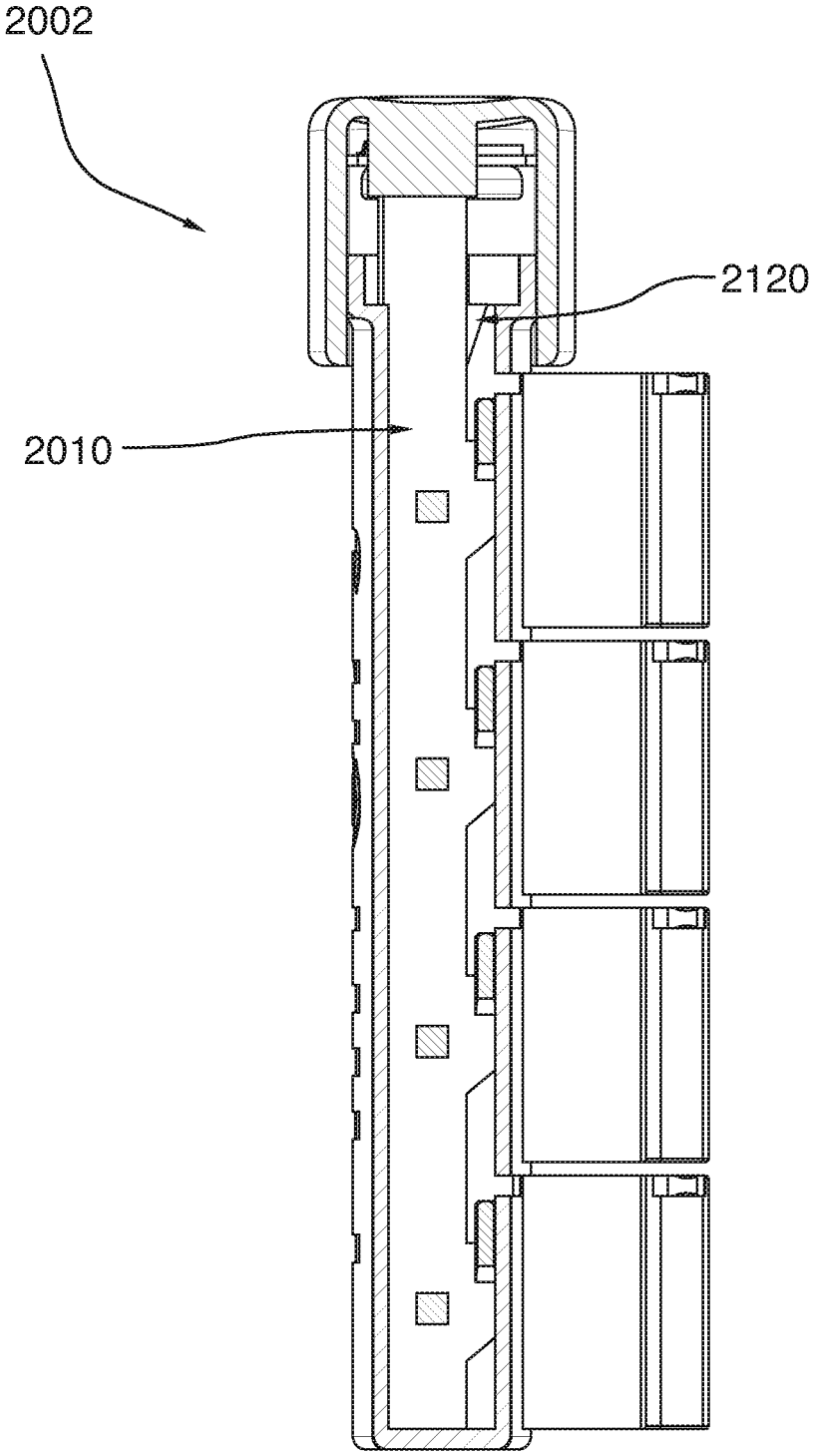
FIG. 86 is a left side cross-sectional view of the portable dispenser of FIG. 74 with the doors in an open position.

The arm 2010, as shown in FIGS. 84 to 86, comprises a body 2118, a stopper 2120 and a plurality of protrusions 2122*a*, 2122*b*, 2122*c* and 2122*d* extending perpendicularly to the longitudinal axis of the body 2118. The body 2118 comprises a plurality of visual indicators 2124*a*, 2124*b*, 2124*c* and 2124*d* which could be LEDs or the like. The visual indicators 2124*a*, 2124*b*, 2124*c* and 2124*d* are aligned with the plurality of protrusions 2122*a*, 2122*b*, 2122*c* and 2122*d* which are aligned with the plurality of compartments 2016*a*, 2016*b*, 2016*c* and 2016*d* of the container portion 2024 as the button 2002 is installed on the container 2014. Each protrusion 2122*a*, 2122*b*, 2122*c* and 2122*d* comprises a rod 2126*a*, 2126*b*, 2126*c* and 2126*d* which are inserted in the previously disclosed holes 2066 of the pivoting doors 2018*a*, 2018*b*, 2018*c* and 2018*d* for locking them in a closed state. The elongated arm 2010 is inserted in the opening 2050 of the upper portion 2026 as the movable portion 2008 is installed over the static portion 2006 and the static portion 2006 is installed on the container 2014.

A method for assembling and using the portable dispenser 2000 will now be described in accordance with a preferred embodiment. In this embodiment, the container assembly 2004 is first assembled by positioning each pivoting door 2018*a*, 2018*b*, 2018*c* and 2018*d* between two consecutive walls 2032*a*, 2032*b*, 2032*c* and 2032*d* and aligning the hole 2062 of the pivoting doors 2018*a*, 2018*b*, 2018*c* and 2018*d* with the holes 2034 of the walls 2032*a*, 2032*b*, 2032*c* and 2032*d*. Subsequently, the pivot shaft 2020 is inserted in the hole 2034 through the plurality of walls, thus engaging the plurality of pivoting doors at the hole 2062 of their first end 2058. The container assembly 2004 is fully assembled once the pivoting doors are rotatably installed on the shaft 2020 and are disposed consecutively over the plurality of compartments to allow opening and closing.

The static portion 2006 is subsequently installed on the upper portion 2026 of the container 2014 thanks to the hooks 2088*a*, 2088*b* of the diametrically opposed longitudinal arms 2086*a*, 2086*b* being inserted in the corresponding inclined recesses 2048*a*, 2048*b* of the upper portion 2026 of the container 2014 in a snap engagement.

Subsequently, the movable portion 2008 is assembled by inserting the arm 2010 in the recess of the upper surface 2106 of the movable portion 2008. The movable portion is then inserted axially over the static portion 2006 by aligning the circular protrusions 2114*a*, 2114*b* of the movable portion 2008 with the springs 2084*a*, 2084*b* of the static portion 2006. The movable portion 2008 is moved axially towards the housing 2014, thus compressing the springs 2084*a*, 2084*b*, for inserting the arm 2010 in the opening 2050 of the upper portion 2026 of the housing 2014. The portable dispenser 2000 is fully assembled once the button 2002 is installed over the container assembly 2004.

Once assembled, the portable dispenser 2000 can either be in an open state as shown in FIG. 86 or in a closed state as shown in FIG. 85.

Starting from a closed state, the portable dispenser 2000 is actuated by pressing downwardly on the upper end 2102 of the movable portion 2008 of the button 2002. As the user actuates the portable dispenser 2000, the movable portion 2008 will be urged downwardly, compressing the diametrically opposed springs 2084*a*, 2084*b* of the static portion 2006 between the upper end 2102 the movable portion 2008 and the elliptical frame member 2070 of the static portion 2006. The movable portion will therefore downwardly move the arm 2010 longitudinally in the opening 2050 of the upper portion 2026. The rods 2126*a*, 2126*b*, 2126*c* and 2126*d* of the arm or lock mechanism 2010 are therefore moved outside of the holes 2066 of the second end 2060 of the pivoting doors, in an unlocked position.

The portable dispenser 2000 reaches an open state once the rods 2126*a*, 2126*b*, 2126*c* and 2126*d* are completely moved outside of the holes 2066 of the pivoting doors, and once the springs 2084*a*, 2084*b* of the static portion 2006 are fully compressed. In the open state, the user can open the pivoting door aligned with the blinking visual indicator and grab his pills.

Once the dispensing period is finished, the pressure exerted on the movable button is released. Therefore, the movable portion 2008 of the button 2002 moves outwardly thanks to the springs 2084*a*, 2084*b* of the static portion 2006 exerting an outward force on the movable portion 2008. The movable portion 2008 continues moving outwardly until the stopper 2120 of the arm 2010 abuts the cross member 2080 of the static portion 2006, thus limiting the outward axial movement of the arm or lock mechanism 2010 and therefore stopping the axial outward movement of the movable portion 2008 relative to the static portion 2006.

Having described the various components of the system 1, a method for assembling and operating the system 1 will now be described in accordance with one embodiment.

In this embodiment, a carousel 10 is first provided. The carousel base 12 equipped with the electronic system 16 and rotating means 20 is first provided and positioned on a plane surface such as a table or a counter top. The dispensing device 21 is then mounted on the base 12 by coupling the complementary receptacles 23 to the plurality of holes 61 of the protrusions 60 thanks to screws or the like.

The carousel support 14 is then mounted on the carousel base 12 by aligning the cylindrical body 76 of the support 14 with the cylindrical body 42 of the base 12. The support 14 is therefore, vertically downwardly moved by abutting the internal surface 78 of the cylindrical body 76 of the support 14 on the external surface 46 of the cylindrical body 42 of the carousel base 12. The support 14 is fully mounted on the base 12 once the annular portion 66 of the support 14 abuts the annular groove 44 of the base 12 and once the cog wheel 82 of the support 14 engages with the gear 31 of the rotating means 20.

The plurality of adaptors 160, 190, 250 of the different portable dispensers 300, 1000, 2000 are then positioned on the support 14 by abutting the recesses 178, 210, 266 of each adaptor with the step 84 of the support 14. As the plurality of adaptors 160, 190, 250 are installed on the support 14, a coupling ring 85 is positioned in the grooves 184, 212, 274 of the plurality of adaptors 160, 190, 250 thus coupling the plurality of adaptors 160, 190, 250. Subsequently, the actuating device 18 is mounted on the base 12 by inserting the inverted L-shaped device 140 and the actuating shaft 144 of the actuating device 18 in the eccentric conduit 50 of the base 12. The actuating shaft 144 is subsequently coupled to the electronic system 16 of the modular system 1 for controlling the vertical movement of the actuating device 18. The carousel 10 is therefore fully assembled.

The modular system 1 can operate regardless of the number of portable dispensers installed on the carousel 10 and comprises an electronic system 16, mounted in the base 12 of the carousel 10, for managing and automating the dispensing of pills or tablets from the various portable dispensers 300, 1000, 2000. Furthermore, each portable dispenser 300, 1000, 2000 comprises an autonomous electronic system 572, 1144, 2012 respectively. The electronic systems 16, 572, 1144, 2012 generally comprise communication means, processing means, a memory, visual and audio indicators, a timer and a battery. It should be understood that each portable dispenser 300, 1000, 2000 and the carousel are constantly and wirelessly connected to each other and to internet through Wi-Fi or Bluetooth or the like. As it will become appreciated, the electronic system or controller of the system 1 can comprises a component associated with the carousel 10 and a component associated with the portable dispensers 300, 1000 and 2000.

The communication means, which could use Bluetooth, Wi-Fi protocols or the like, allow the plurality of portable dispensers 300, 1000, 2000 to communicate with the carousel 10 and vice-versa for permanently monitoring the dispensing cycles. The communication means further allow for either the portable dispensers or the carousel 10 to communicate with a doctor or a pharmacist through a secured website to inform on the dispensing cycles of each portable dispensers associated to a patient or to notify that a patient has not been following the dispensing periods. Moreover, the communication means will send a notification to a pharmacist when the cartridge of either the portable dispenser 300 or 1000 needs a refill. The communication means can also communicate with one's smart phone, for example a family member or the patient himself, to inform on the dispensing cycle and the next dispensing periods. In case of an emergency the communication means can automatically send a medical record associated with the portable dispensers and therefore the patient, informing the emergencies on the medication, the dosage or the medical history of a patient which will have been pre-programmed by a pharmacist. It should be understood that the pharmacist pre-programs all the portable dispensers and the carousel by programming the dispensing periods according to the prescription of the doctor.

The processing means allow to automatically rotate the carousel support 14 and actuate the actuating device 18 when a specific dispensing period is reached as determined by a prescription assigned to each patient which can be associated to more than one portable dispenser. The processing means further allow synchronization between the plurality of portable dispensers and the carousel 10 as the portable dispensers are removed or installed from/on the carousel 10 to inform for example on the number of pills left in the cartridges. Furthermore, the processing means can compile a dispensing report to be sent on a weekly basis to a doctor.

The electronic systems further comprises a memory which saves the time when a medication has been dispensed from the portable dispensers and keeps a data record of the number of pills contained in each cartridge. Moreover, as the portable dispensers are repositioned on the carousel, the memories of each portable dispensers are synchronized with the electronic system of the carousel.

Visual and audio indicators, as well as a timer, indicate when a dispensing period is reached by sounding a different alarm according to the patient. Moreover, a timer is used for a patient to enter a duration during which he will be gone, the visual indicator will therefore signal which portable dispensers to remove according to the prescription.

Each electronic system 572, 1144, 2012 of the portable dispensers 300, 1000, 2000 comprises a battery for allowing the portable dispensers to work autonomously when not installed on the carousel 10. Furthermore, the batteries are charged once the portable dispensers are positioned back on the carousel 10.

The modular system 1 is activated once a dispensing period is reached and an audio signal such as an alarm is triggered. The alarm can be specific to each user if the carousel is shared between a plurality of users like in hospitals or nursing homes. Therefore, the processing means trigger the rotating means 20 for rotating the carousel support 14 with the different portable dispensers 300, 1000, 2000 positioned thereon thanks to the cog wheel 82 engaging the gear 31. During the rotation of the support 14, each portable dispenser communicates with the electronic system 16 and is synchronized thanks to the communicating device 148 of the actuating device 18. Once the correct portable dispenser, either 300 or 1000, corresponding to the portable dispenser assigned to the dispensing period, is aligned with the release conduit 52 of the carousel base 12, the actuating device 18 is downwardly moved thanks to the processing means actuating the shaft 144, thus moving the L-inverted shape 140 downward until the pusher pad 150 pushes on the button of a portable dispenser. When the button, either 306 or 1008 of the portable dispensers 300 or 1000, is lowered a single pill is dispensed. For the portable dispenser 300, installed on the adaptor 160, the pill is dispensed through the dispensing conduit 182. For the portable dispenser 1000, installed on the adaptor 190, the pill is dispensed through the dispensing conduit 208. The pill travels through the release conduit 52 of the base 12 and is received in the dispensing device 21. Subsequently, the user can position the receptacle or cup 13 under the base 12 to recover his medication.

Alternatively, if a user wants to automatically fill portable dispensers 2000, the filling assembly 19 is positioned under the carousel base 12 by abutting the first end 88 of the guide element 81 to the back wall 35 of the base 12. A care giver or a user further opens the plurality of doors of portable dispenser 2000 and inserts portable dispenser 2000 in tablet distributor 83 through the funnelled opening 120 of the tablet distributor 83. The tablet distributor is engaged in the guide element 81 by aligning the protrusion **126*a* of the container 83 with the groove 98 of the guide element 81 and the protrusion 126*b* with the groove 96. The processing means will synchronize with the portable dispenser 2000 and dispense pills according to the prescription of the patient. The processing means therefore trigger the moving means 87 of the filling assembly 19 for moving the tablet distributor 83, comprising the portable dispenser 2000, thanks to the gear 93 engaging the mechanical rack 102. The container 83 is moved under the release conduit 52 of the base 12 and stopped at each of the four compartments of the portable dispenser 2000. The processing means therefore trigger the rotating means 20 to rotate four times the support 14 and to dispense pills, at each revolution, in the compartment of the portable dispenser 2000 aligned with the release conduit 52. At each revolution the tablet distributor is moved to the following compartment which is therefore aligned with the release conduit 52. Once the filling of the portable dispenser 2000 is reached, a user can remove the portable dispenser 2000 from the container 83**.

Alternatively, the modular system 1 can comprise a locking mechanism present on each portable dispenser 300, 1000, 2000 for unlocking the buttons 306, 1008, 2002 once a dispensing period is reached for dispensing pills. The locking mechanism therefore locks the buttons 306, 1008, 2002 once the dispensing period is over to prevent the user from dispensing an excessive amount of pills and overdosing. Furthermore the unlocking of the portable dispensers can be achieved thanks to a wireless or magnetic identification accessory worn by the user such as a bracelet or a watch for allowing only the prescribed user to dispense pills and to prevent unauthorized users, such as children, to activate the portable dispensers. Once a pill has been dispensed, the portable dispenser automatically looks itself until the next dispensing period. Furthermore, the carousel 10 could comprise a reset button for resetting a dispensing period if a user misplaces his pills. Therefore, only the patient wearing the identification accessory described above can press on the reset button which will trigger a new dispensing period.

The invention claimed is:

1. A modular medication dispensing system comprising:

a medication dispenser support, said medication dispenser support comprising a base for placing the support on a surface, the base including a base dispensing opening, the medication dispenser support further comprising a magazine movably mounted on said base, said magazine comprising at least two removably receivable adaptors configured to removably receive a single portable dispenser, each of said at least two removably receivable adaptors comprising an adaptor opening, wherein when the adaptor dispensing opening of a first adaptor is in registry with the base dispensing opening, the first adaptor is in a dispensing position relative to the base;

at least one portable medication dispenser, the at least one portable medication dispenser being removably receivable on one of the at least two removably receivable adaptors of the medication dispenser support, the at least one portable medication dispenser being configured to accommodate a medication to be dispensed and being operable to dispense doses of the medication;

an actuator operatively coupled to the medication dispenser support, the actuator being configured to operate the at least one portable medication dispenser when it is removably received on one of the at least two removably receivable adaptors of the medication dispenser support; and an electronic controller operatively connected to the actuator, the electronic controller controlling the operation of the actuator for operating the at least one portable medication dispenser removably received on one of the at least two removably receivable adaptors of the medication dispenser support to dispense the doses of the medication.

2. The modular medication dispensing system of claim 1, wherein the doses of the medication are in the form of tablets, pills, capsules, caplets, caps, gel caps, pellets, lozenges, pastilles, candy, liquid substances, or powder.

3. The modular medication dispensing system of claim 1, wherein the magazine is a circular magazine rotatably mounted on the base.

4. The modular dispensing system of claim 1, wherein when the first adaptor is in the dispensing position and a first portable dispenser is removably received in the first adaptor, the actuator is operatively coupled to the first portable dispenser to operate the same.

5. The modular dispensing system of claim 3, the modular dispensing system further comprising a rotating means operatively coupled to the base and to the circular magazine, the rotating means being operable for urging rotation of the circular magazine relative to the base to position the first adaptor in the dispensing position.

6. The modular dispensing system of claim 4, wherein the rotating means is operatively connected to the electronic controller, the electronic controller controlling the operation of the rotating means for urging rotation of the circular magazine relative to the base to position the first adaptor in the dispensing position, the electronic controller controlling the operation of the rotating means according to at least one parameter related to the administration of the medication.

7. The modular dispensing system of claim 3, wherein the actuator is fixedly mounted to the base and engages the first portable dispenser in the dispensing position, the actuator being movable between a released position and an actuated position, wherein when the actuator moves from the released position to the actuated position, it operates the portable dispenser to dispense a single dose of the medication.

8. The modular medication dispensing system of claim 3, wherein the at least two adaptors are identical.

9. The modular medication dispensing system of claim 3, wherein the at least two adaptors are configured differently.

10. The modular medication dispensing system of claim 3, wherein the at least two adaptors are removably mounted to the circular magazine.

11. The modular medication dispensing system of claim 9, wherein one of the at least two adaptors has a first end adjacent to the circular magazine when removably positioned on the circular magazine and a second end, the dispensing opening of the adaptors being located at the first end.

12. The modular medication system of claim 11, wherein the other of the at least two adaptors has a first end adjacent to the circular magazine when removably positioned on the circular magazine and a second end, the dispensing opening of the other of the at least two adaptors extending from the second end to the first of end via a conduit.

13. The modular medication system of claim 3, wherein the circular magazine further comprises at least one storage compartment, each of the at least one storage compartment being configured for removably storing a portable medication dispenser.

14. The modular medication system according to claim 1, wherein the at least one portable medication dispenser comprises:

a housing having a first end and a second end, the second end of the housing comprising a dispensing opening;

a medication cartridge removably mounted in the housing, between the first end and the second end, the medication cartridge comprising a first end and a second end in registry with the dispensing opening of the housing, the medication cartridge further comprising the medication to be dispensed;

a bias assembly mounted to the first end of the housing and engaging the medication at the first end of the medication cartridge; and a button removably mounted to the second end of the housing, the button being reciprocable between a released position and a dispensing position to dispense doses of the medication through the dispensing opening of the housing, wherein when the button is moved from the released position to the dispensing position, a dose of the medication is dispensed from the second end of the cartridge through the dispensing opening, and when the button is returned from the dispensing position to the released position, the bias assembly biases the medication toward the second end of the medication cartridge for a subsequent dose of medication to be dispensed.

15. The modular medication system according to claim 1, wherein the at least one portable medication dispenser comprises:

a housing having a first end and a second end, the first end of the housing comprising a dispensing opening;

a medication cartridge removably mounted in the housing, between the first end and the second end, the medication cartridge comprising a first end in registry with the dispensing opening of the housing and a second end, the medication cartridge further comprising the medication to be dispensed;

a dose dispensing mechanism mounted in the dispensing opening of the housing, the dose dispensing mechanism being configure to dispense single doses of the medication; and a button removably mounted to the second end of the housing and operatively connected to the dose dispensing mechanism, the button being reciprocable between a released position and a dispensing position to dispense doses of the medication through the dispensing opening of the housing, wherein when the button is moved from the released position to the dispensing position, the button operates the dose dispensing mechanism to dispense a dose of the medication from the first end of the cartridge through the dispensing opening, and when the button is returned from the dispensing position to the released position, the bias assembly biases the medication toward the first end of the medication cartridge for a subsequent dose of medication to be dispensed.

16. The modular medication system of claim 15, wherein the at least one portable medication dispenser further comprises a bias assembly mounted to the second end of the housing and engaging the medication at the second end of the medication cartridge.

17. The modular medication system according to claim 1, wherein the at least one portable medication dispenser comprises:

a housing having a first end and a second end, and a plurality of compartments distributed between the first end and the second end, each of the plurality of compartments being configured to receive a plurality of medications and corresponding to a specific period of time for which the plurality of medications is to be administered to a user;

a plurality of doors, the doors being mounted to the housing and being operable between a closed position for individually closing each of the plurality of compartments and an open position for accessing the plurality of medications at the specific period of time;

a lock mechanism mounted to the housing and coupled to the plurality of doors, the lock mechanism being operable between a locked position to maintain the plurality of doors in the closed position and an unlocked position to allow each of the plurality of doors to be opened individually; and a button mounted to the second end of the housing and operatively coupled to the lock mechanism, the button being reciprocable between a released position and a dispensing position, wherein when the button is moved from the released position to the dispensing position, the button forces the lock mechanism into the unlock position while when the button is moved from the dispensing position to the lock mechanism is forced into the lock position.

18. The modular medication system according to claim 17, the modular medication system further comprising a filling assembly for filling the plurality of containers of the least one portable medication dispenser.

19. The modular medication system according to claim 18, wherein the filling assembly is operatively connected to the electronic controller.

20. The modular medication system according to claim 1, wherein the electronic controller is mounted to the medication dispensing support.

21. The modular medication system according to claim 1, wherein the electronic controller is mounted to the at least one portable medication dispenser.

22. The modular medication system according to claim 1, wherein the electronic controller comprises a first component mounted to the medication dispensing support and a second component mounted to the at least one portable medication dispenser, the first and second components of the electronic controller being electronically connected to control the dispensing of the medication.

* * * * *